US011540672B2

(12) United States Patent
Stafford et al.

(10) Patent No.: US 11,540,672 B2
(45) Date of Patent: Jan. 3, 2023

(54) BATHTUB CLOSURE SYSTEMS AND METHODS

(71) Applicant: Safeway Safety Step, LLC, West Chester, OH (US)

(72) Inventors: Christopher Brian Stafford, Liberty Township, OH (US); Lance Middleton, Soddy Daisy, TN (US); Houston E. Lay, Batavia, OH (US)

(73) Assignee: SAFEWAY SAFETY STEP, LLC, West Chester, OH (US)

( * ) Notice: Subject to any disclaimer, the term of this patent is extended or adjusted under 35 U.S.C. 154(b) by 0 days.

(21) Appl. No.: 17/466,487

(22) Filed: Sep. 3, 2021

(65) Prior Publication Data

US 2021/0393086 A1 Dec. 23, 2021

Related U.S. Application Data

(63) Continuation of application No. 16/365,216, filed on Mar. 26, 2019, now abandoned, which is a continuation of application No. 15/804,936, filed on Nov. 6, 2017, now abandoned, which is a continuation of application No. 14/815,549, filed on (Continued)

(51) Int. Cl.
*A47K 3/00* (2006.01)

(52) U.S. Cl.
CPC ..... *A47K 3/006* (2013.01)

(58) Field of Classification Search
CPC ..... A47K 3/006; A47K 3/008; A47K 3/16; A47K 3/40
See application file for complete search history.

(56) References Cited

U.S. PATENT DOCUMENTS 426,536 A 4/1890 Johnson
2,052,628 A 9/1936 Higgins
(Continued)

FOREIGN PATENT DOCUMENTS

CA 1049997 A1 3/1979
DE 20214218 U1 1/2003
(Continued)

OTHER PUBLICATIONS

GreyB Services, Validity Search Report, dated Aug. 25, 2008, 41 pages.

(Continued)

*Primary Examiner* — Janie M Loeppke
(74) *Attorney, Agent, or Firm* — Ulmer & Berne LLP

(57) ABSTRACT

A bathtub closure system may include a step configured to be retrofit onto a bathtub and a plug. The step may include a first side panel, a second side panel, and an elongated platform defining a cavity configured to facilitate ingress and egress into the bathtub, and a first attachment recess extending downward from the first top surface less than an entire height of the first side panel or extending downward from the second top surface less than an entire height of the second side panel. The plug includes a body and a first attachment member affixed to the body and corresponding to the first attachment recess defined by the step. The plug cooperates with the step to form a substantially watertight seal when the first attachment member is mated with the first attachment recess and the body of the plug is positioned at least partially within the cavity.

20 Claims, 53 Drawing Sheets

Related U.S. Application Data

Jul. 31, 2015, now abandoned, which is a continuation-in-part of application No. 14/698,668, filed on Apr. 28, 2015, now abandoned.

(60) Provisional application No. 62/031,622, filed on Jul. 31, 2014, provisional application No. 62/012,879, filed on Jun. 16, 2014, provisional application No. 62/007,098, filed on Jun. 3, 2014, provisional application No. 62/006,510, filed on Jun. 2, 2014, provisional application No. 61/985,098, filed on Apr. 28, 2014.

(56) References Cited

U.S. PATENT DOCUMENTS

| | | | |
|---|---|---|---|
| 2,063,864 | A | 12/1936 | Zinkil |
| 2,075,933 | A | 4/1937 | Friedlander |
| 2,122,626 | A | 7/1938 | Smith |
| 2,511,756 | A | 6/1950 | Wallace |
| 2,520,129 | A | 8/1950 | Dall et al. |
| 2,569,825 | A | 10/1951 | Otis |
| 2,818,578 | A | 1/1958 | Cantrell |
| 2,896,991 | A | 7/1959 | Martin, Jr. |
| 2,942,907 | A | 6/1960 | Nagel et al. |
| 2,984,510 | A | 5/1961 | Hoffmann |
| 2,991,482 | A | 7/1961 | Brass |
| 3,066,316 | A | 12/1962 | Russell |
| 3,184,807 | A | 5/1965 | Schornstheimer et al. |
| 3,276,804 | A | 10/1966 | Heppner |
| 3,380,078 | A | 4/1968 | Hanson |
| 3,416,166 | A | 12/1968 | Hanson |
| 3,439,506 | A | 4/1969 | Martin |
| 3,492,037 | A | 1/1970 | Hutchinson |
| 3,600,025 | A | 8/1971 | Brainard |
| 3,633,862 | A | 1/1972 | Breen |
| 3,663,971 | A | 5/1972 | Bonhote |
| 3,719,960 | A | 3/1973 | Russell |
| 3,971,080 | A | 7/1976 | Walker |
| 4,067,071 | A | 1/1978 | Murray et al. |
| 4,092,037 | A | 5/1978 | Greenwald |
| 4,158,585 | A | 6/1979 | Wright |
| 4,290,154 | A | 9/1981 | Benjamin |
| 4,346,485 | A | 8/1982 | Reed et al. |
| 4,360,935 | A | 11/1982 | Barrett |
| 4,364,132 | A | 12/1982 | Robinson |
| 4,542,545 | A | 9/1985 | Johnson et al. |
| 4,546,506 | A | 10/1985 | Houle et al. |
| 4,553,299 | A | 11/1985 | Ebert |
| 4,561,160 | A | 12/1985 | Nicol et al. |
| 4,796,312 | A | 1/1989 | Corlew |
| 4,802,247 | A | 2/1989 | Leichle et al. |
| 4,871,204 | A | 10/1989 | Cook et al. |
| 4,890,341 | A | 1/1990 | Forbes |
| 4,953,241 | A | 9/1990 | Williams |
| 4,993,087 | A | 2/1991 | Roquebrune |
| 5,050,252 | A | 9/1991 | Cuttriss |
| 5,184,358 | A | 2/1993 | Gruidel et al. |
| 5,241,713 | A | 9/1993 | Wang |
| 5,275,518 | A | 1/1994 | Guenther |
| 5,341,524 | A | 8/1994 | Zellner |
| 5,351,345 | A | 10/1994 | Sills et al. |
| 5,446,929 | A | 9/1995 | Sills et al. |
| 5,463,780 | A | 11/1995 | Harris et al. |
| 5,473,799 | A | 12/1995 | Aoki |
| 5,549,149 | A | 8/1996 | Sills et al. |
| 5,560,092 | A | 10/1996 | Roiger |
| 5,606,751 | A | 3/1997 | Baker |
| 5,628,851 | A | 5/1997 | Lawler |
| 5,701,614 | A | 12/1997 | Appleford et al. |
| 6,061,846 | A | 5/2000 | Peterson |
| 6,085,367 | A | 7/2000 | Guiste |
| 6,112,344 | A | 9/2000 | Guenther |
| 6,212,704 | B1 | 4/2001 | Peterson |
| 6,226,810 | B1 | 5/2001 | Weddendorf et al. |
| 6,256,806 | B1 | 7/2001 | Ditommaso |
| 6,272,698 | B1 | 8/2001 | Stafford |
| 6,334,225 | B1 | 1/2002 | Brinkmann |
| 6,381,769 | B1 | 5/2002 | Lofquist |
| 6,430,759 | B1 | 8/2002 | Beltran |
| 6,615,420 | B1 | 9/2003 | Hyden et al. |
| 6,735,792 | B2 | 5/2004 | Johansson |
| 6,766,543 | B1 | 7/2004 | Hollis et al. |
| 6,893,199 | B2 | 5/2005 | Michels |
| 7,100,405 | B2 | 9/2006 | West |
| D539,398 | S | 3/2007 | Stafford |
| 7,299,509 | B1 | 11/2007 | Neidich |
| 7,597,652 | B2 | 10/2009 | Walker et al. |
| D605,818 | S | 12/2009 | Farley |
| D610,657 | S | 2/2010 | Torres |
| 7,778,937 | B2 | 8/2010 | Ferrara et al. |
| 7,926,126 | B2 | 4/2011 | Whitley |
| 8,230,568 | B2 | 7/2012 | Stafford |
| 8,375,478 | B2 | 2/2013 | Luo |
| 8,505,128 | B2 | 8/2013 | Staudinger |
| 8,732,871 | B2 | 5/2014 | Neidich et al. |
| 8,898,824 | B2 | 12/2014 | Neidich et al. |
| 9,131,809 | B2 | 9/2015 | Stafford et al. |
| 9,375,115 | B2 | 6/2016 | Stafford et al. |
| 9,578,993 | B2 | 2/2017 | Stafford et al. |
| D790,047 | S | 6/2017 | Stafford et al. |
| D797,266 | S | 9/2017 | Stafford et al. |
| 10,750,910 | B2 | 8/2020 | Mckee et al. |
| 2004/0034917 | A1 | 2/2004 | Noro et al. |
| 2004/0064883 | A1 | 4/2004 | Appleford et al. |
| 2004/0237184 | A1 | 12/2004 | Longman |
| 2005/0044620 | A1 | 3/2005 | Metcalf |
| 2005/0102746 | A1 | 5/2005 | Wright et al. |
| 2005/0199025 | A1 | 9/2005 | West |
| 2005/0210938 | A1 | 9/2005 | Doyle et al. |
| 2006/0080772 | A1 | 4/2006 | Saiz et al. |
| 2006/0230526 | A1 | 10/2006 | Skinner |
| 2008/0000158 | A1 | 1/2008 | Ranelli et al. |
| 2008/0083063 | A1 | 4/2008 | Libit et al. |
| 2008/0087283 | A1 | 4/2008 | Cromack et al. |
| 2008/0092361 | A1 | 4/2008 | Neidich |
| 2008/0109954 | A1 | 5/2008 | Neidich |
| 2008/0111383 | A1 | 5/2008 | Van Ravenhorst |
| 2008/0222787 | A1 | 9/2008 | Staudinger |
| 2009/0010420 | A1 | 1/2009 | Khanna |
| 2010/0037382 | A1 | 2/2010 | Spiker et al. |
| 2010/0156120 | A1 | 6/2010 | Luo |
| 2010/0212083 | A1 | 8/2010 | Stafford |
| 2010/0236041 | A1 | 9/2010 | Stafford |
| 2010/0263119 | A1 | 10/2010 | Neidich et al. |
| 2011/0099787 | A1 | 5/2011 | Stafford |
| 2011/0307547 | A1 | 12/2011 | Backer et al. |
| 2012/0005820 | A1 | 1/2012 | Stafford |
| 2012/0102013 | A1 | 4/2012 | Martini |
| 2012/0123667 | A1 | 5/2012 | Guziec |
| 2012/0192350 | A1 | 8/2012 | Stafford et al. |
| 2012/0216343 | A1 | 8/2012 | Stafford et al. |
| 2012/0284122 | A1 | 11/2012 | Brandis |
| 2012/0303402 | A1 | 11/2012 | Koury |
| 2012/0304376 | A1 | 12/2012 | Neidich et al. |
| 2013/0051546 | A1 | 2/2013 | Fried et al. |
| 2013/0051549 | A1 | 2/2013 | Klemm |
| 2013/0090957 | A1 | 4/2013 | Popkey et al. |
| 2013/0127634 | A1 | 5/2013 | Grumbles, III |
| 2013/0304534 | A1 | 11/2013 | Mehta et al. |
| 2014/0040282 | A1 | 2/2014 | Mann et al. |
| 2015/0305573 | A1 | 10/2015 | Stafford et al. |
| 2015/0335206 | A1 | 11/2015 | Stafford et al. |
| 2016/0000272 | A1 | 1/2016 | Jin |

FOREIGN PATENT DOCUMENTS

| | | | |
|---|---|---|---|
| EP | 162103 | A1 | 11/1985 |
| EP | 457093 | A1 | 11/1991 |
| EP | 700655 | A1 | 3/1996 |
| EP | 913115 | A1 | 5/1999 |
| EP | 933052 | A2 | 8/1999 |
| EP | 1428467 | A1 | 6/2004 |
| EP | 1447038 | A2 | 8/2004 |

(56) References Cited

FOREIGN PATENT DOCUMENTS

| | | | |
|---|---|---|---|
| EP | 1747747 | A2 | 1/2007 |
| GB | 853067 | A | 11/1960 |
| GB | 880368 | A | 10/1961 |
| GB | 2038981 | A | 7/1980 |
| GB | 2381746 | A | 5/2003 |
| JP | 10137313 | A | 5/1998 |
| JP | 2002336325 | A | 11/2002 |
| WO | 2006110085 | A1 | 10/2006 |

OTHER PUBLICATIONS

Safety Bath Inc., Door Insert Kit Installation Manual, Ituna SK, Canada, dated Mar. 2008, 17 pages.
Safety Bath Inc., Door Insert Kit, Measurement and Installation, 5 pages.

BATHTUB CLOSURE SYSTEMS AND METHODS

REFERENCE TO RELATED APPLICATIONS

This application is a continuation of U.S. Non-Provisional application Ser. No. 16/365,216, filed Mar. 26, 2019, which is a continuation of U.S. Non-Provisional application Ser. No. 15/804,936, filed Nov. 6, 2017, which is a continuation of U.S. Non-Provisional application Ser. No. 14/815,549 filed on Jul. 31, 2015, which is a continuation-in-part of U.S. Non-Provisional Ser. No. 14/698,668 filed on Apr. 28, 2015, which claims priority to U.S. Provisional Patent Application No. 61/985,098 filed on Apr. 28, 2014, U.S. Provisional Patent Application No. 62/006,510 filed on Jun. 2, 2014, U.S. Provisional Patent Application No. 62/007,098 filed on Jun. 3, 2014, and U.S. Provisional Patent Application No. 62/012,879 filed on Jun. 16, 2014, and claims priority to U.S. Provisional Application No. 62/031,622 filed on Jul. 31, 2014, the disclosures of which are incorporated by reference herein in their entirety.

TECHNICAL FIELD

Embodiments of the technology relate, in general, to bathtub closure systems, and in particular to bathtub closure systems having a plug, cover, or door associated therewith.

BACKGROUND

It is well recognized that many people, because of advancing age or infirmities, reach a stage in life where they cannot step over the usual sidewall of a bathtub for bathing or showering in the tub. It is, of course, possible to remove the bathtub and to install a shower-system that does not require a user to step over the usual bathtub sidewall. However, a less costly solution to the problem of providing access to a shower is often found in cutting out a portion of the bathtub sidewall and providing a replacement insert that provides a much lower sidewall portion that the user can easily step through to enter the bathtub. With this arrangement the tub does not need to be removed, so the tub and the already available shower unit discharging into the tub can be used and the entire area where the tub is located does not need to be remodeled and refinished.

SUMMARY

Embodiments described herein include a bathtub closure system having a step, the step having a first side panel, a second side panel, and an elongated platform defining a cavity, where the cavity can be configured to facilitate ingress and egress into a bathtub. The bathtub closure system can include a closure, where the closure can be coupled with the step and can cooperate with the step to form a substantially watertight seal when the closure is in a closed position. The bathtub closure system can include a support portion, where the support portion can be co-molded with the step and have a substantially U-shaped configuration extending in a generally downward direction from the step to support the step during use.

Embodiments described herein include a bathtub system having a step saddle, the step saddle having a first side panel, a second side panel, and an elongated platform defining a substantially U-shaped cavity, where the substantially U-shaped cavity can be configured to facilitate ingress and egress into a bathtub. The bathtub system can include a support portion, the support portion can include a body having a first leg and a second leg projecting in a substantially downward direction from the step saddle such that the support portion can be configured to support the step saddle during use. The bathtub system can include a plurality of support members, where each of the plurality of support members can have a substantially frustoconical shape and a top surface.

Embodiments described herein include a bathtub closure system that can include a step, the step being substantially hollow, where the step can include a first side panel, a second side panel, and an elongated platform defining a cavity, where the cavity can be configured to facilitate ingress and egress into a bathtub. The bathtub closure system can include a hinged door, where the hinged door can be coupled with the step and can cooperate with the step to form a substantially watertight seal when the hinged door is in a closed position. The bathtub closure system can include a support portion, the support portion being co-molded with the step and having a substantially U-shaped configuration, where the support portion can include a first leg extending in a generally downward direction, a second leg extending in a generally downward direction, and a plurality of support members, each of the plurality of support members having a substantially frustoconical configuration and a top surface, where the plurality of support members, the first leg, and the second leg can define a support portion cavity.

BRIEF DESCRIPTION OF THE DRAWINGS

The present disclosure will be more readily understood from a detailed description of some example embodiments taken in conjunction with the following figures.

11, shown having a lateral retention mechanism configured to secure the plug to the step.

Figure 13:
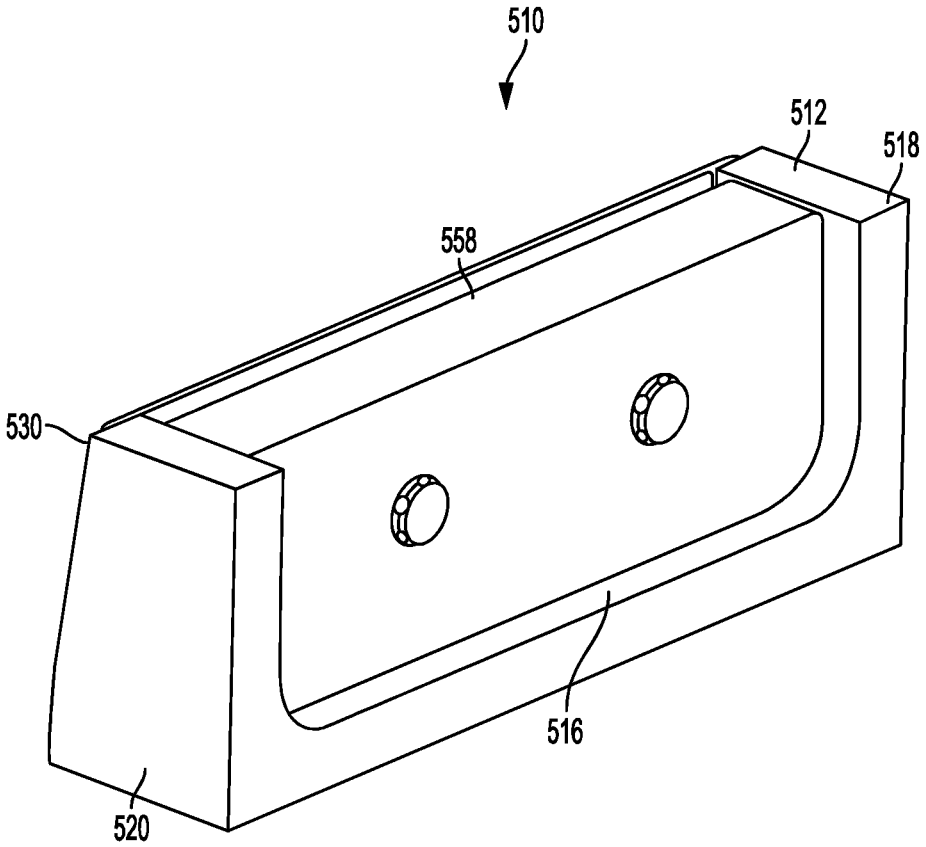

FIG. 13 is a perspective exterior view of a bathtub overlay system, according to an alternate embodiment, having a step and a plug with an associated cover.

Figure 14:
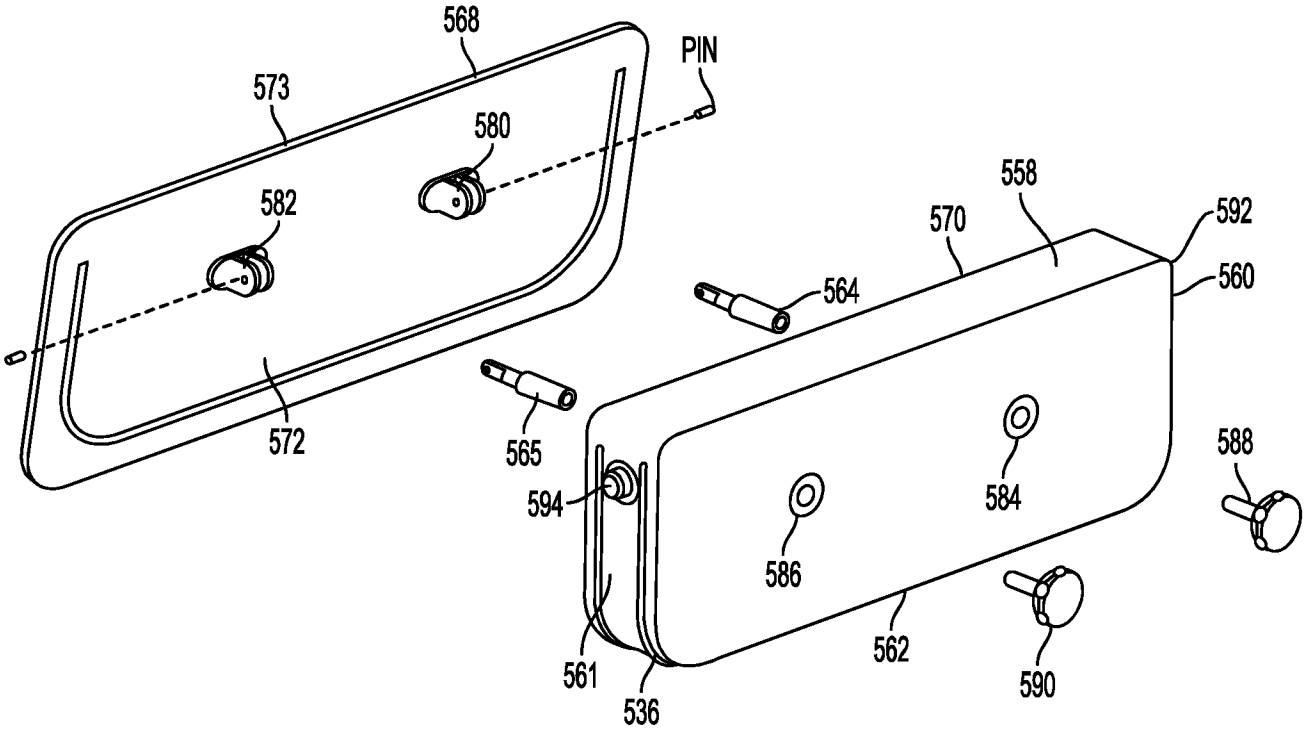

FIG. 14 is an exploded view of the plug and associated cover of FIG. 13.

Figure 15:
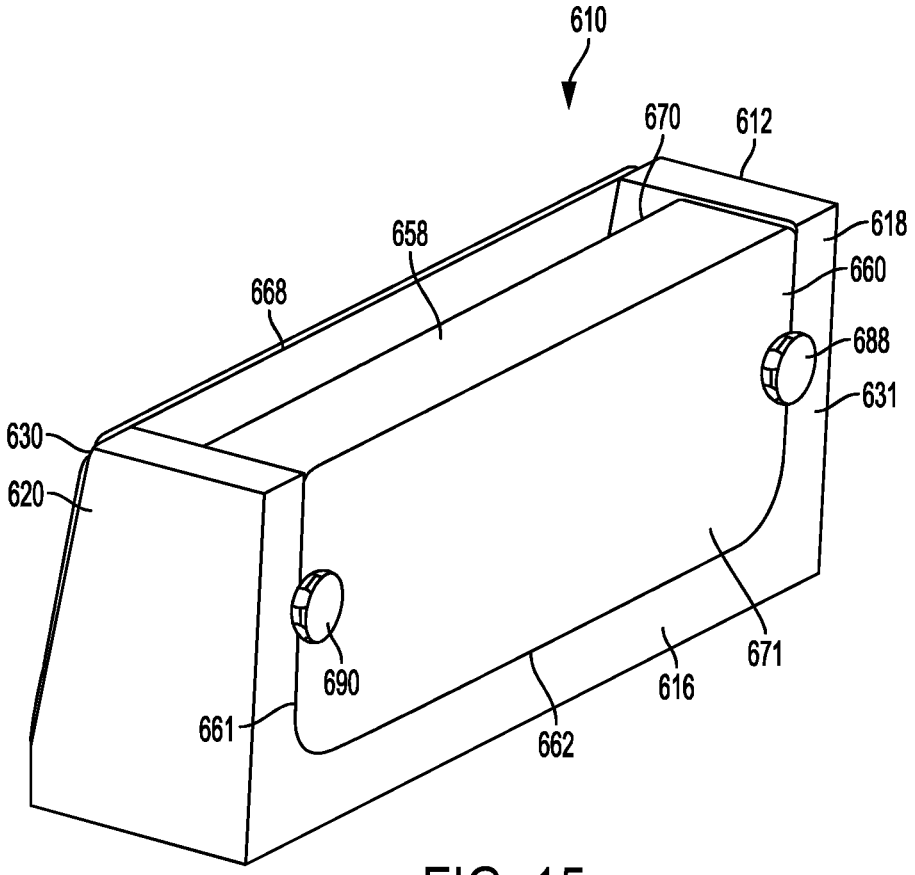

FIG. 15 is a perspective exterior view of a bathtub overlay system, according to an alternate embodiment, having a step, a cover, and a plug secured to the step and cover with a plurality of fasteners.

Figure 16:
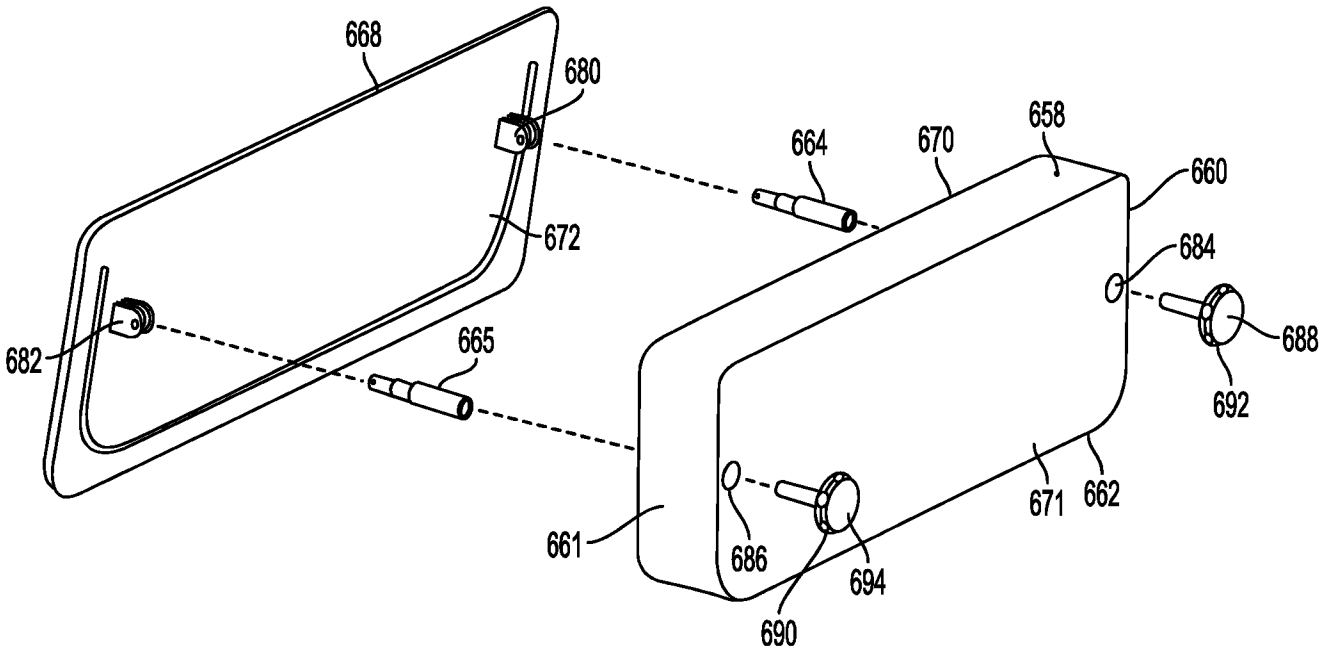

FIG. 16 is an exploded view of the cover, plug, and plurality of fasteners of FIG. 15.

Figure 17:
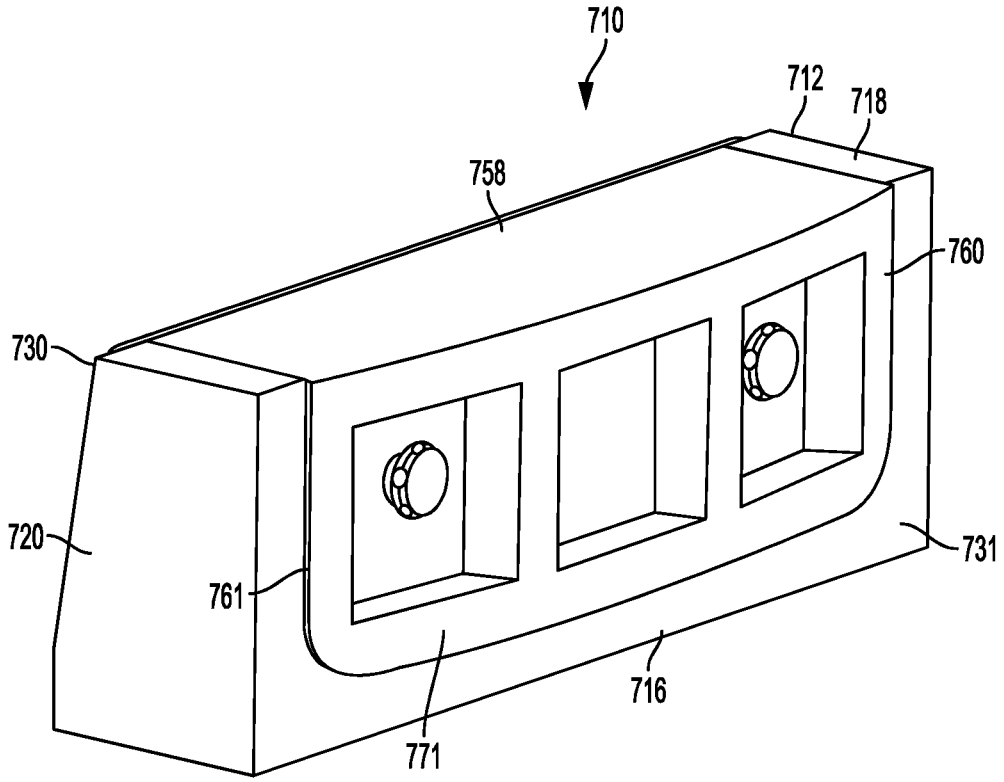

FIG. 17 is a perspective exterior view of a bathtub overlay system, according to an alternate embodiment, having a step, a cover, and a plug secured to the step and cover with a plurality of fasteners.

Figure 18:
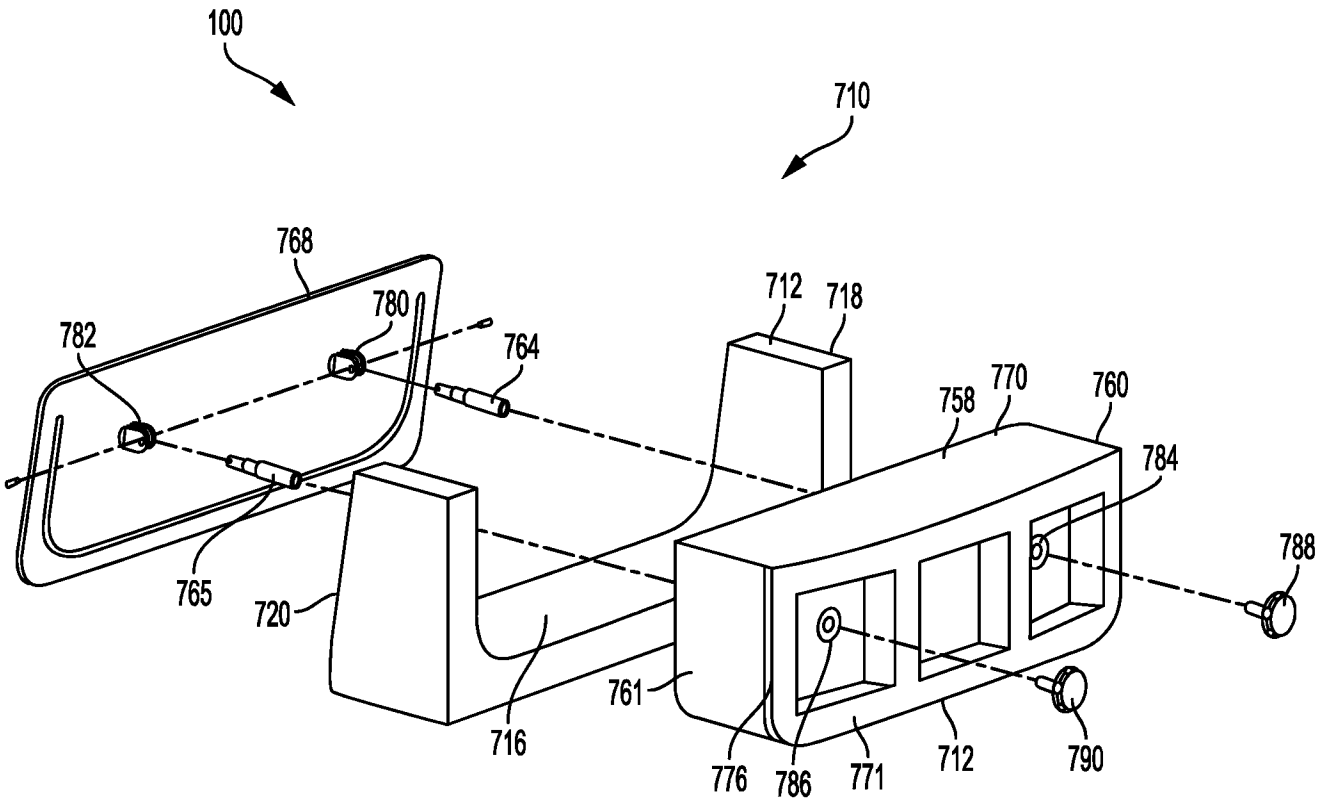

FIG. 18 is an exploded view of the bathtub overlay system of FIG. 17.

Figure 19A:
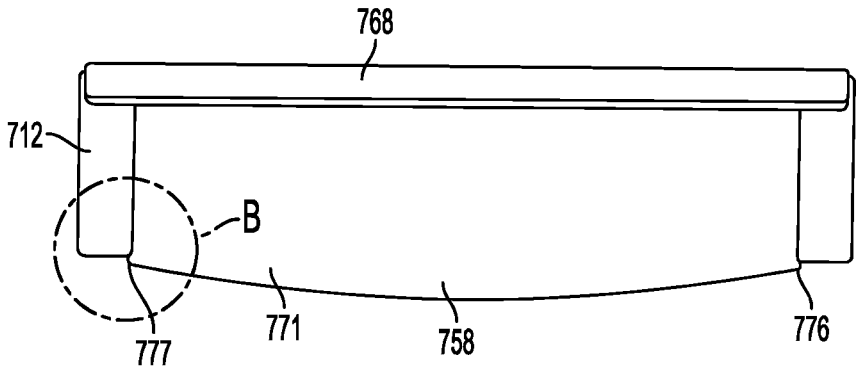

FIG. 19A is a top view depicting the bathtub overlay system of FIG. 17, the plug having a first flared edge and a second flared edge, where the first flared edge and the second flared edge are configured to couple the plug with the step.

Figure 19B:
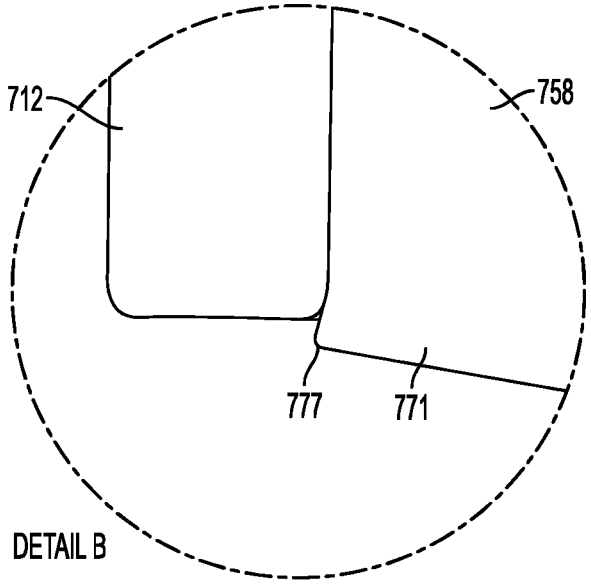

FIG. 19B is a more detailed top view of FIG. 19A, at reference section B, showing the relationship between the first flared edge and the plug.

Figure 20:
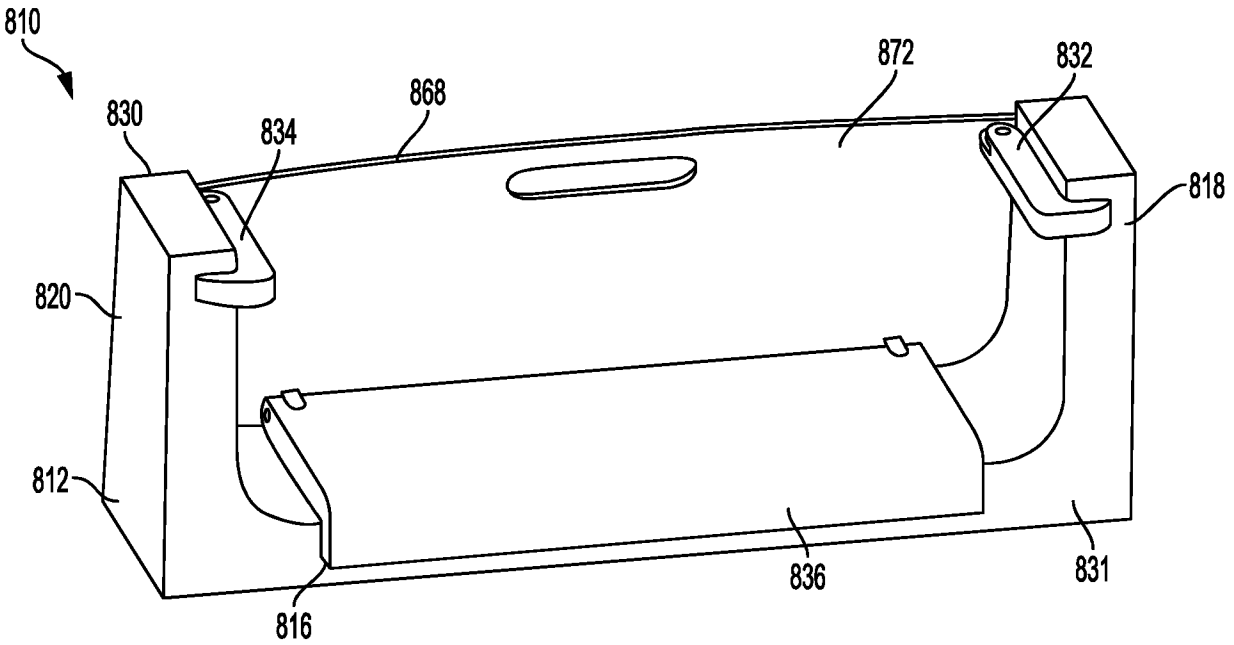

FIG. 20 is a perspective exterior view of a bathtub overlay system, according to an alternate embodiment, having a cover secured to a step with a plurality of hinged clamps, the plurality of hinged clamps being shown in an engaged position.

Figure 21:
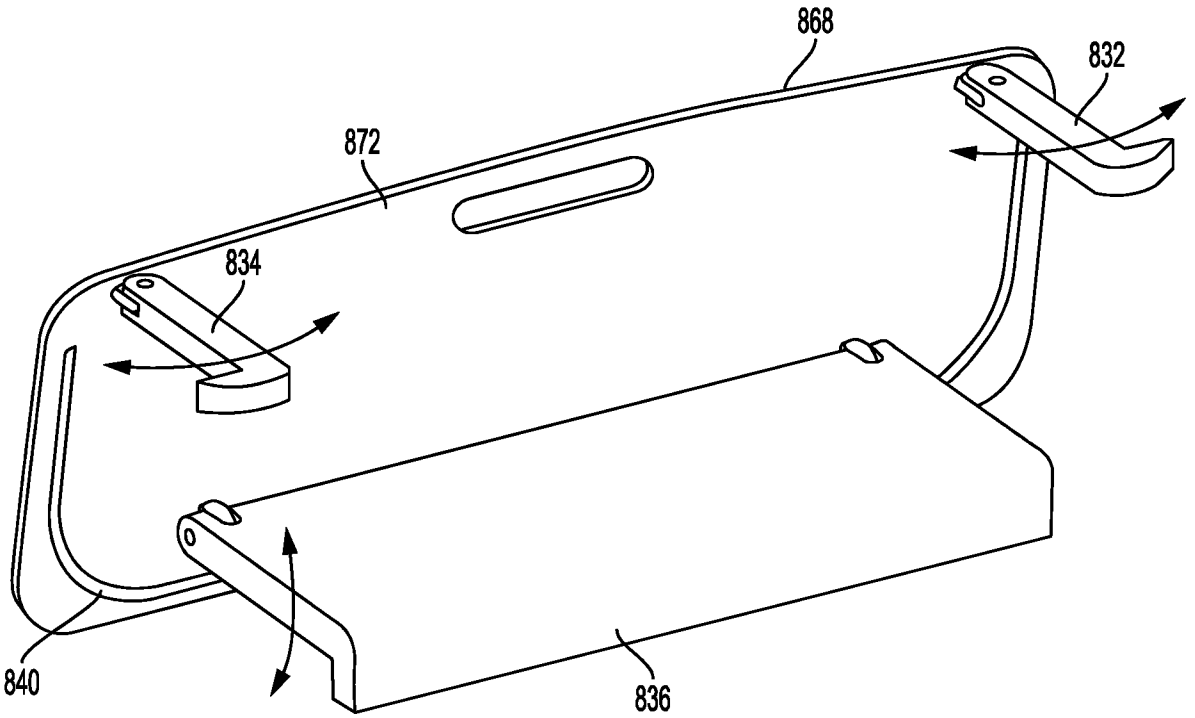

FIG. 21 is a perspective view of cover of FIG. 17 illustrating the range of motion of the plurality of hinged clamps according to one embodiment.

Figure 22:
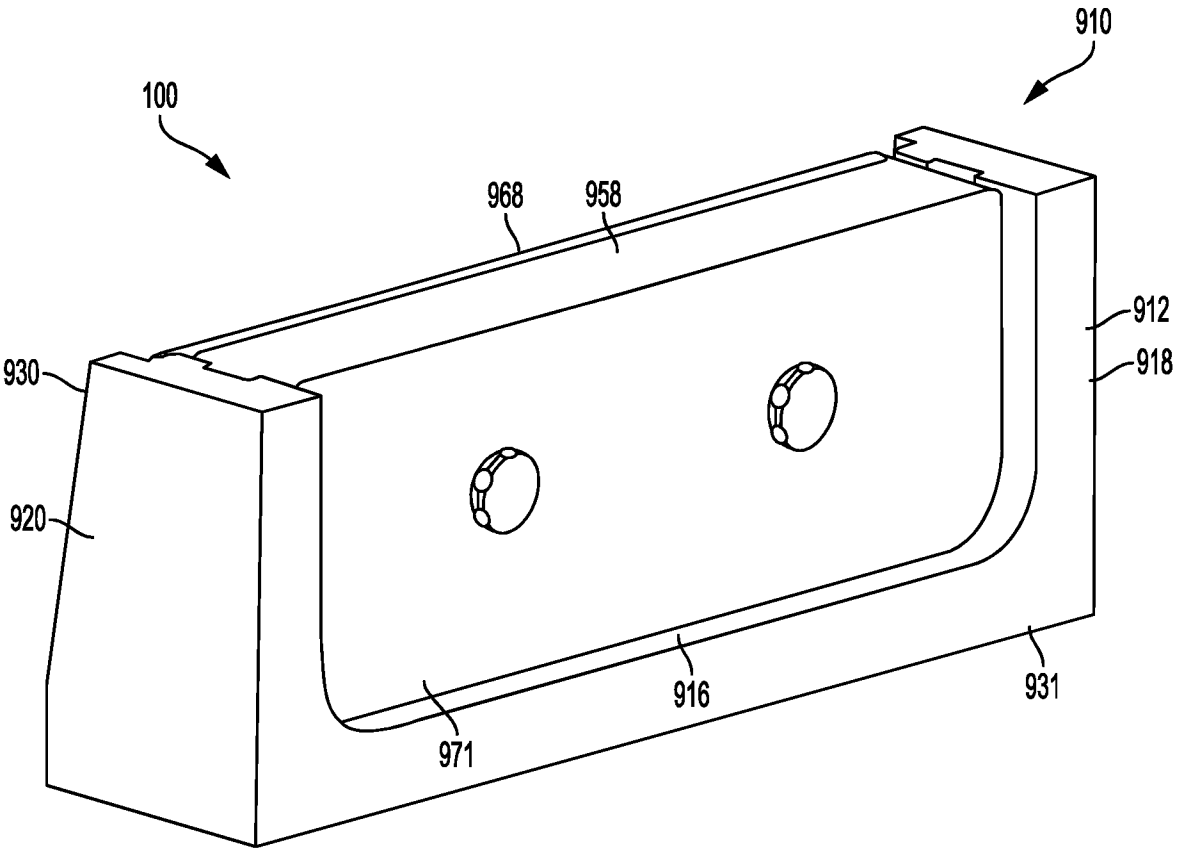

FIG. 22 is a perspective exterior view of a bathtub overlay system, according to an alternate embodiment, having a step, a cover, and a plug secured to the step and cover with a plurality of hand screws.

Figure 23:
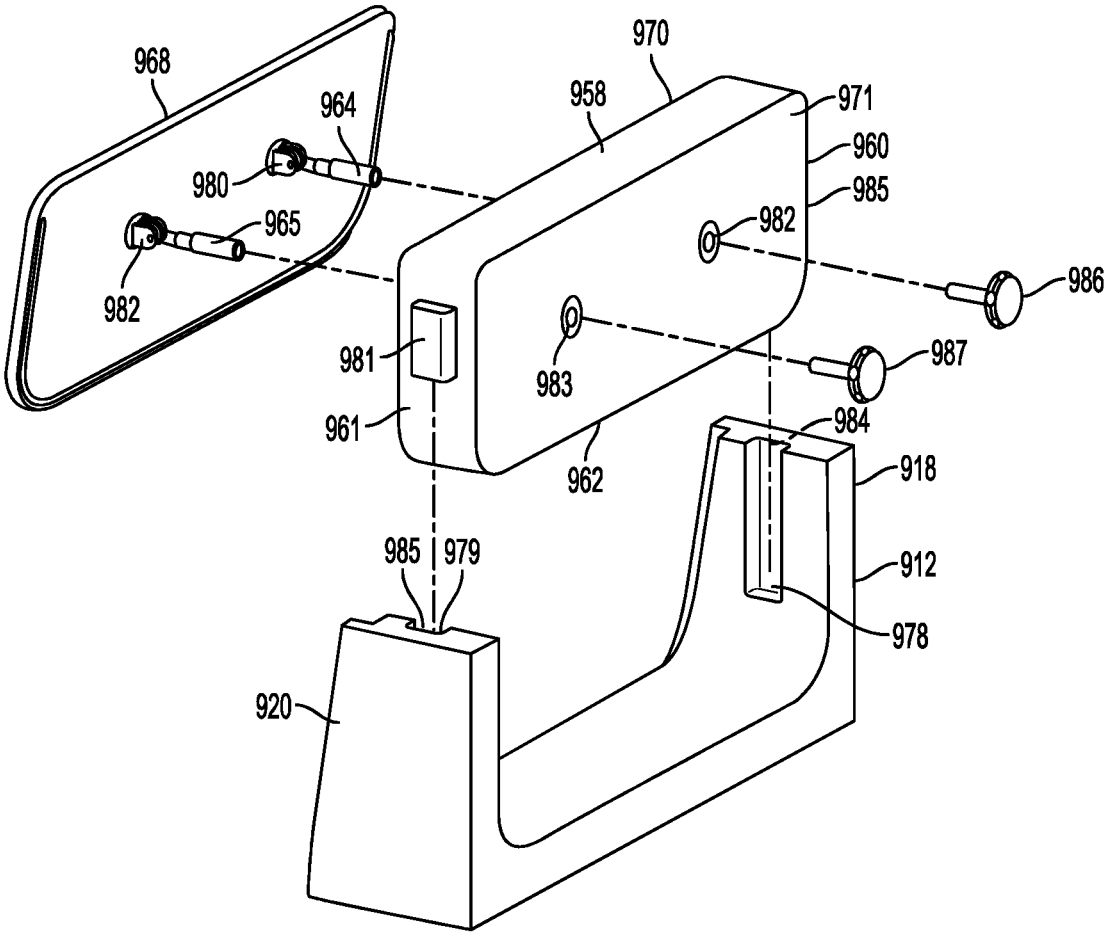

FIG. 23 is an exploded view of the bathtub overlay system of FIG. 22.

Figure 24:
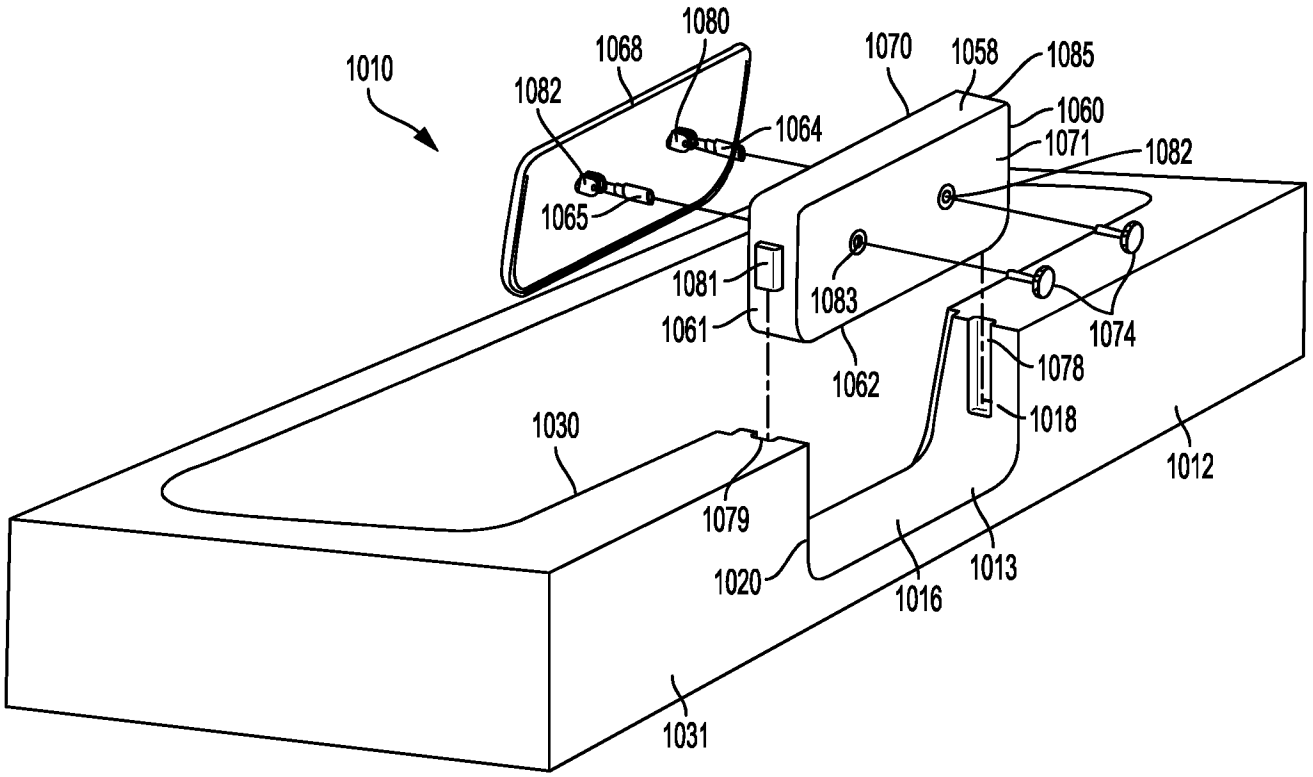

FIG. 24 is an exploded view of a bathtub overlay system, according to an alternate embodiment, shown associated with a bathtub having a cutout.

Figure 25:
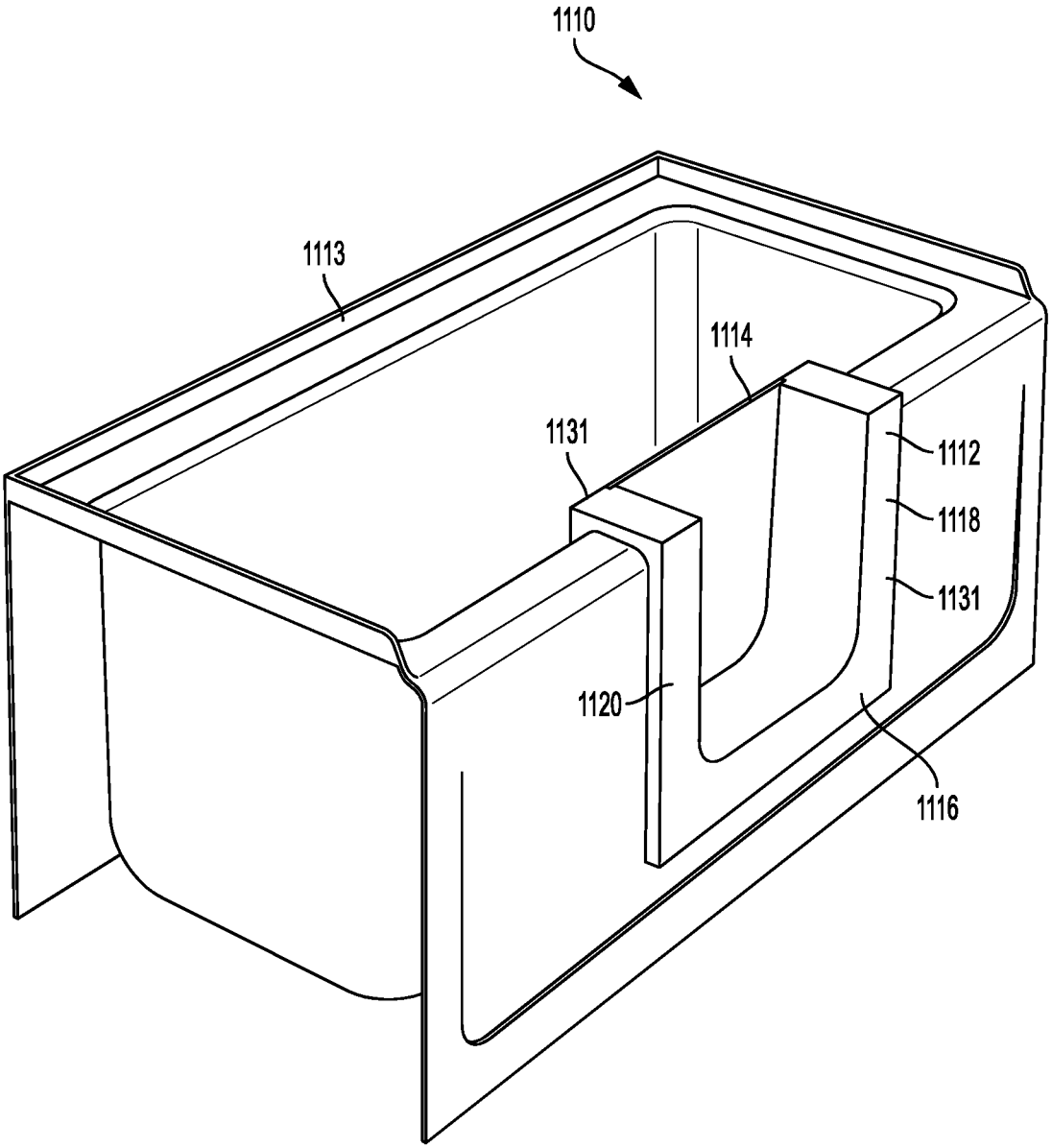

FIG. 25 is a perspective exterior view of a bathtub overlay system, according to an alternate embodiment, having a step and an associated door, the bathtub overlay system being shown with a bathtub.

Figure 26:
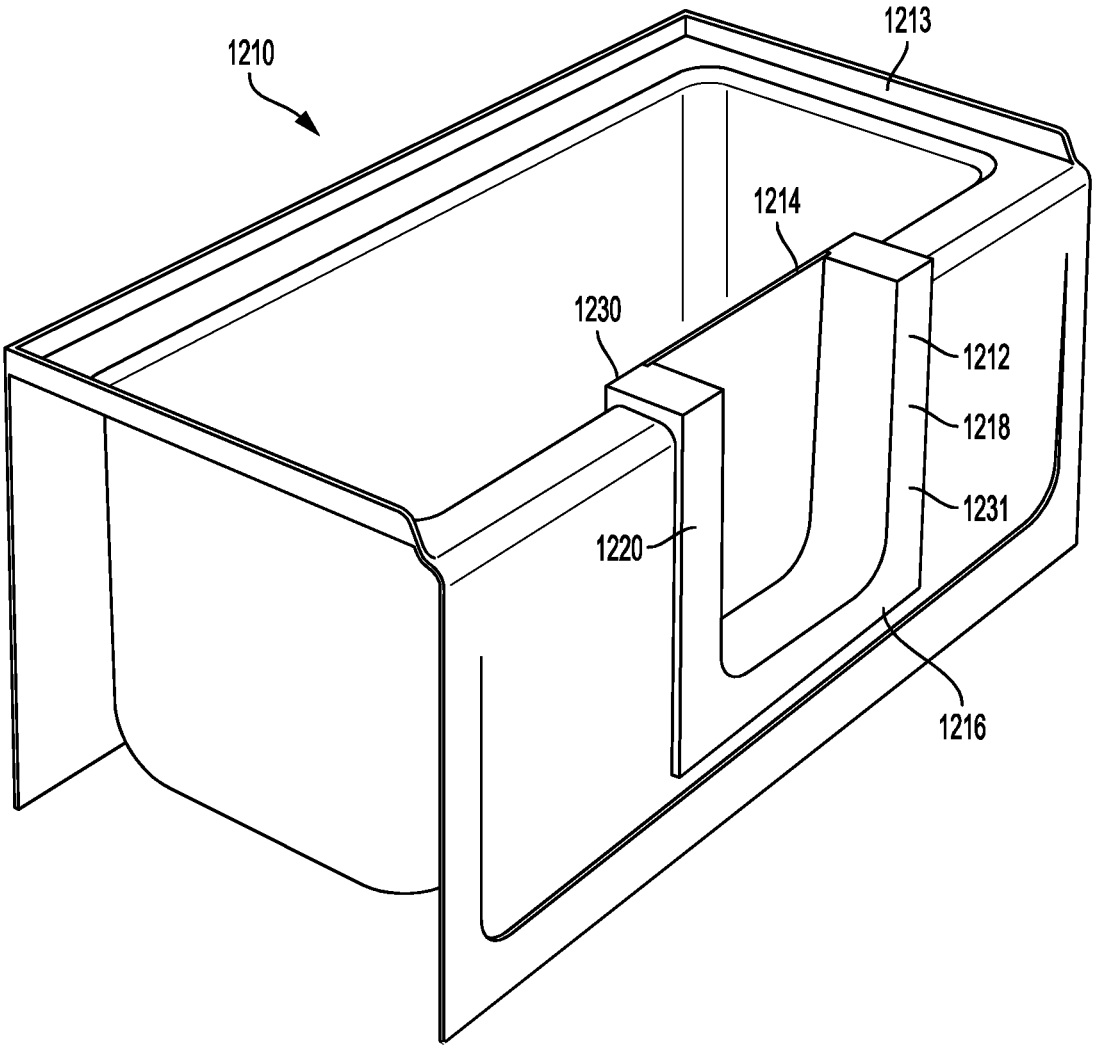

FIG. 26 is a perspective exterior view of a bathtub overlay system, according to an alternate embodiment, having a low threshold step and an associated door, the bathtub overlay system being shown with a bathtub.

Figure 27:
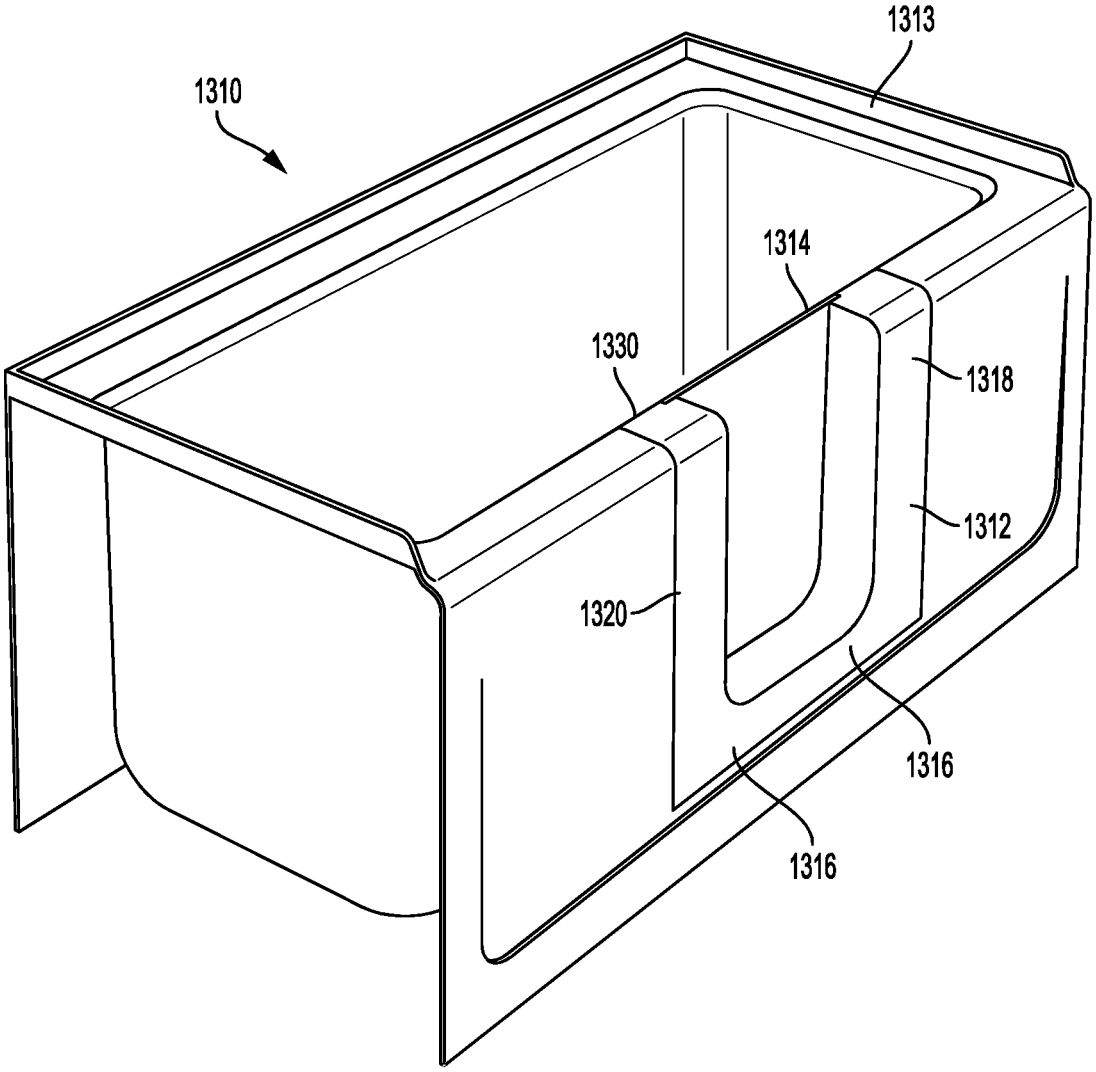

FIG. 27 is a perspective exterior view of a bathtub overlay system, according to an alternate embodiment, having a low threshold step and an associated door, the bathtub overlay system being shown substantially flush with an exterior surface of a bathtub.

Figure 28:
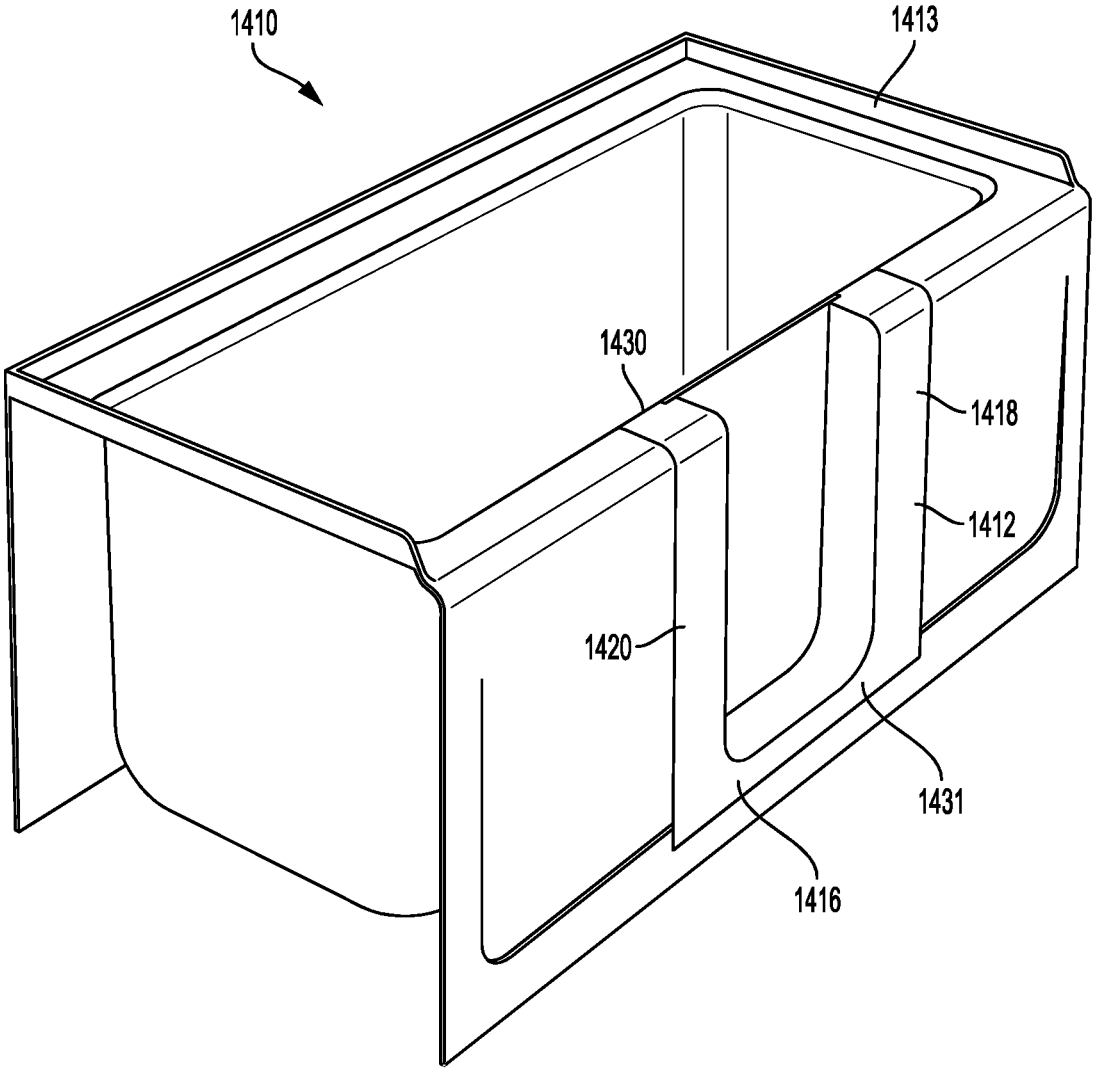

FIG. 28 is a perspective exterior view of a bathtub overlay system, according to an alternate embodiment, having a low threshold step and an associated door, the bathtub overlay system being shown substantially flush with an exterior surface of a bathtub and the low threshold step extending near the bottom of the bathtub.

Figure 29:
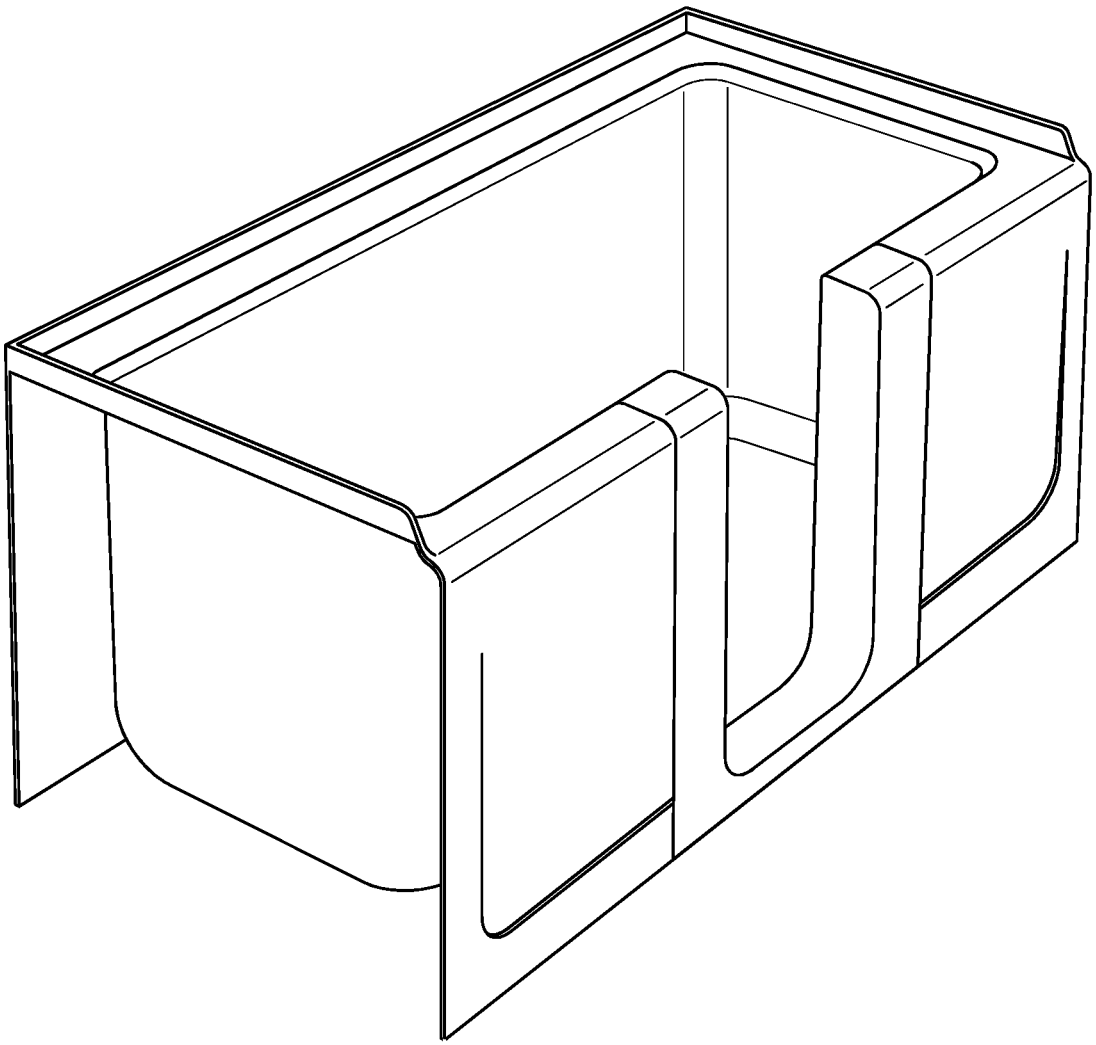

FIG. 29 is a perspective exterior view of a bathtub overlay system, according to an alternate embodiment, having a low threshold step and a removable plug, the bathtub overlay system being shown substantially flush with an exterior surface of a bathtub and the low threshold step extending near the bottom of the bathtub.

Figure 30:
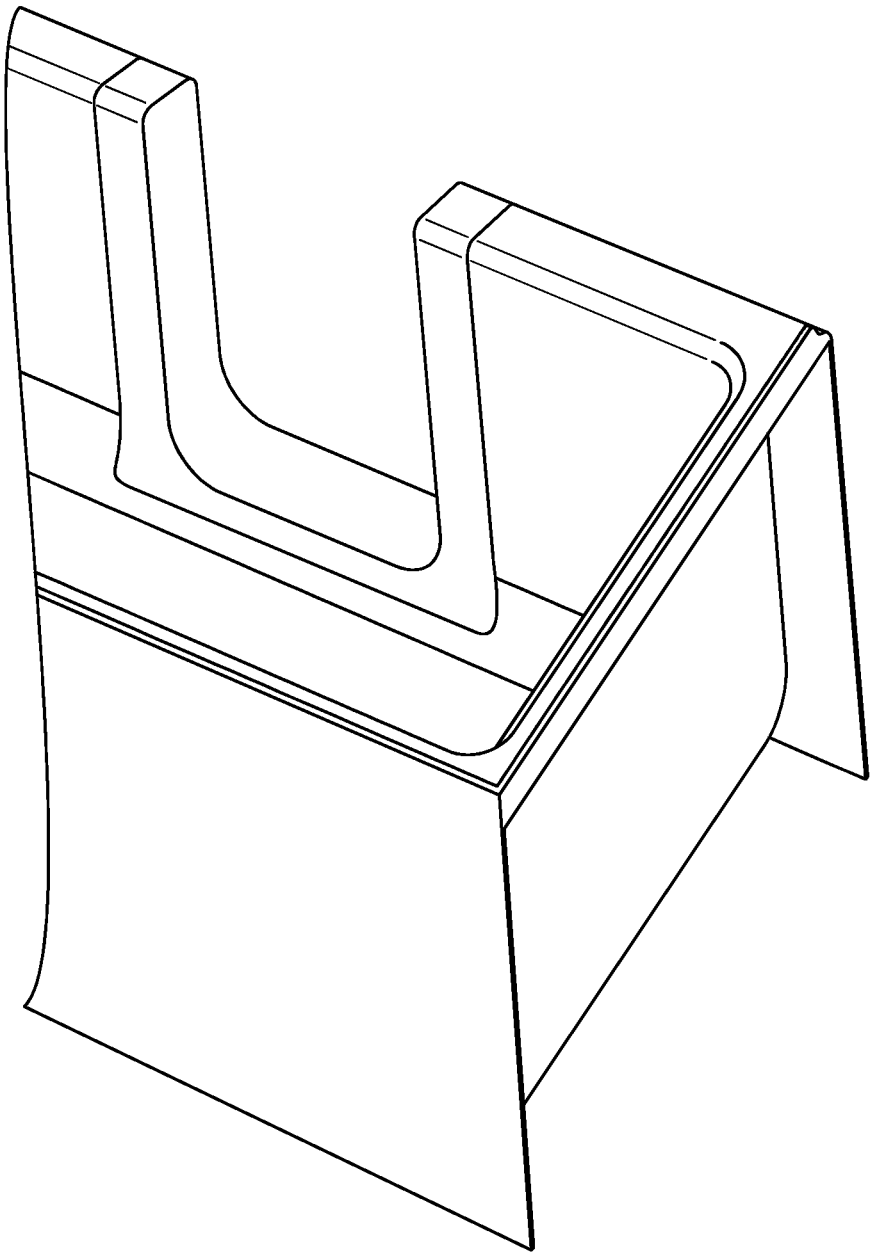

FIG. 30 is a perspective interior view of a bathtub overlay system according to one embodiment.

Figure 31:
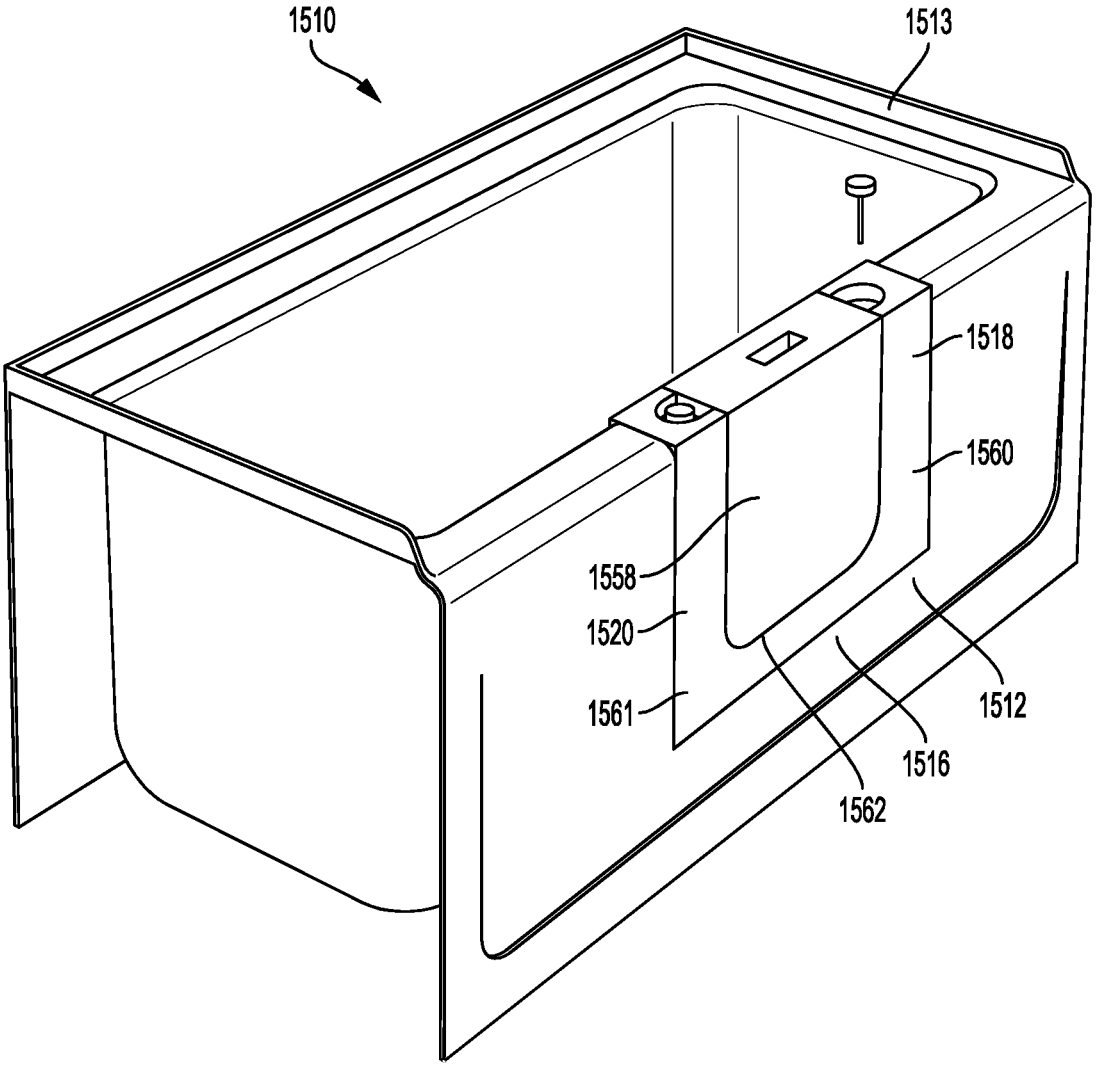

FIG. 31 is a perspective exterior view of a bathtub overlay system, according to an alternate embodiment, having a step and a removable plug, the bathtub overlay system being shown substantially flush with an exterior surface of a bathtub.

Figure 32C:
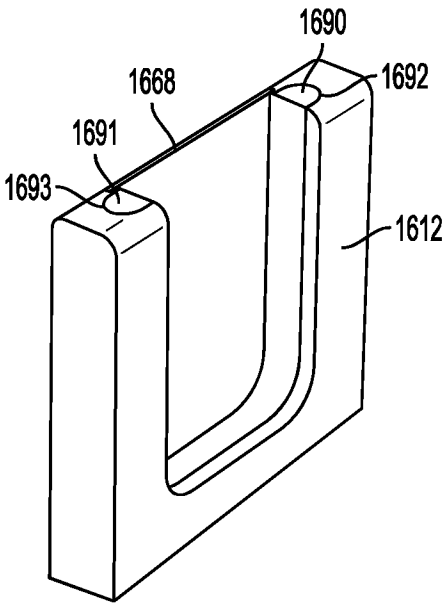
Figure 32B:
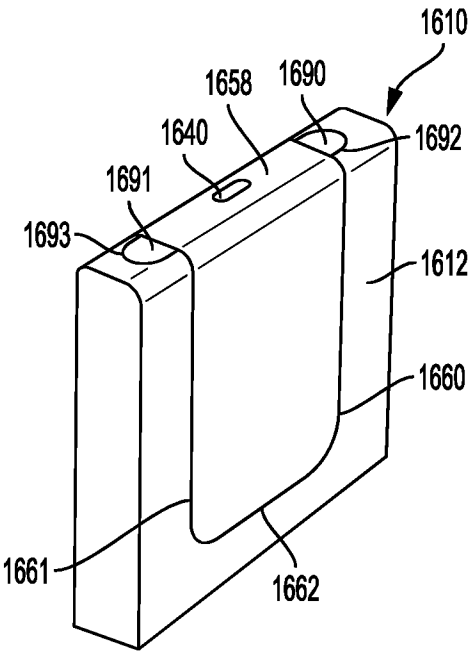
Figure 32A:
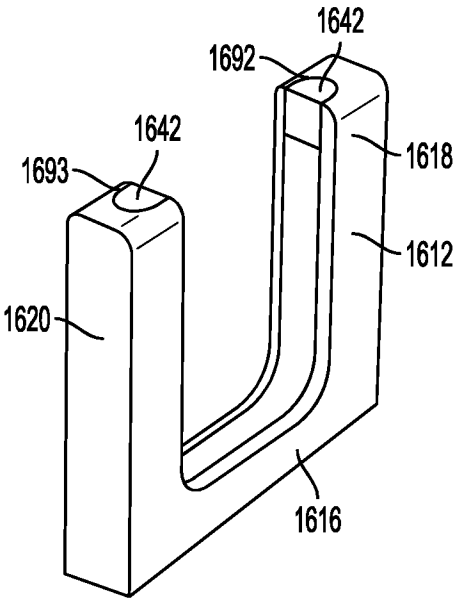

FIGS. 32A-C are a perspective view of a modular bathtub overlay system shown with a step, a step associated with a removable plug, and a step associated with a door, according to one embodiment.

Figure 33:
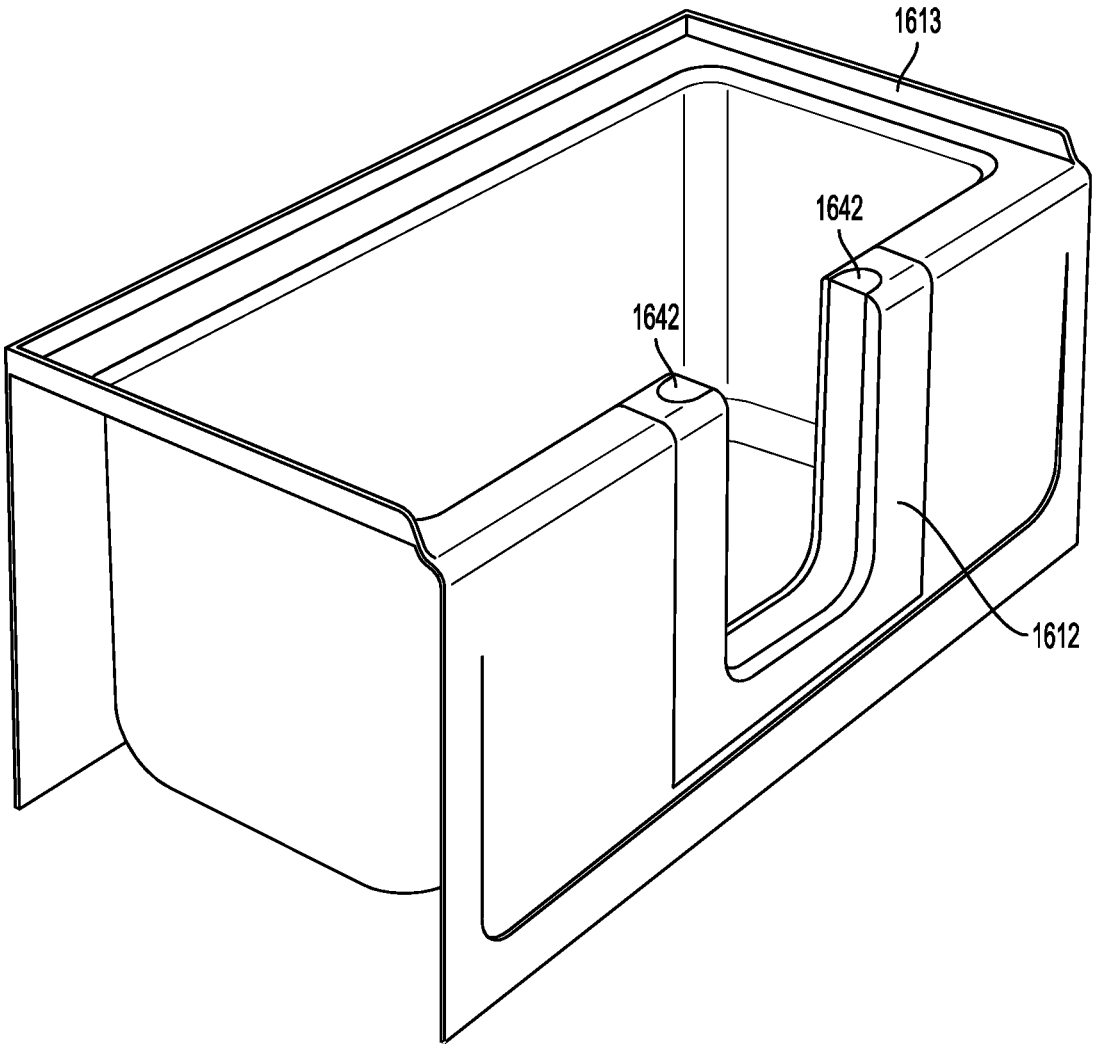

FIG. 33 is a perspective exterior view of a modular bathtub overlay system, according to one embodiment, having a step shown associated with a bathtub.

Figure 34:
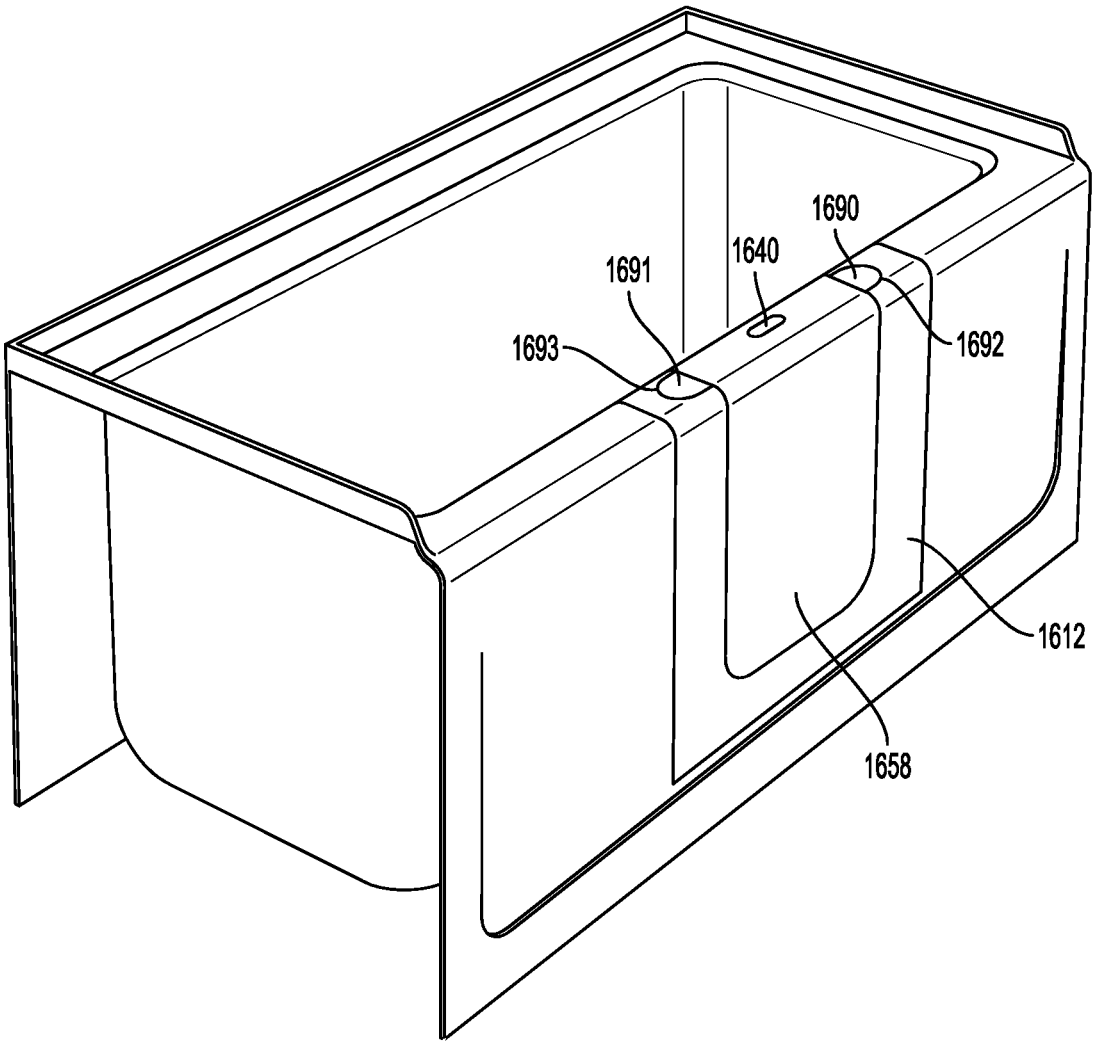

FIG. 34 is a perspective exterior view of the modular bathtub overlay system of FIG. 33 shown with a removable plug associated with the step.

Figure 35:
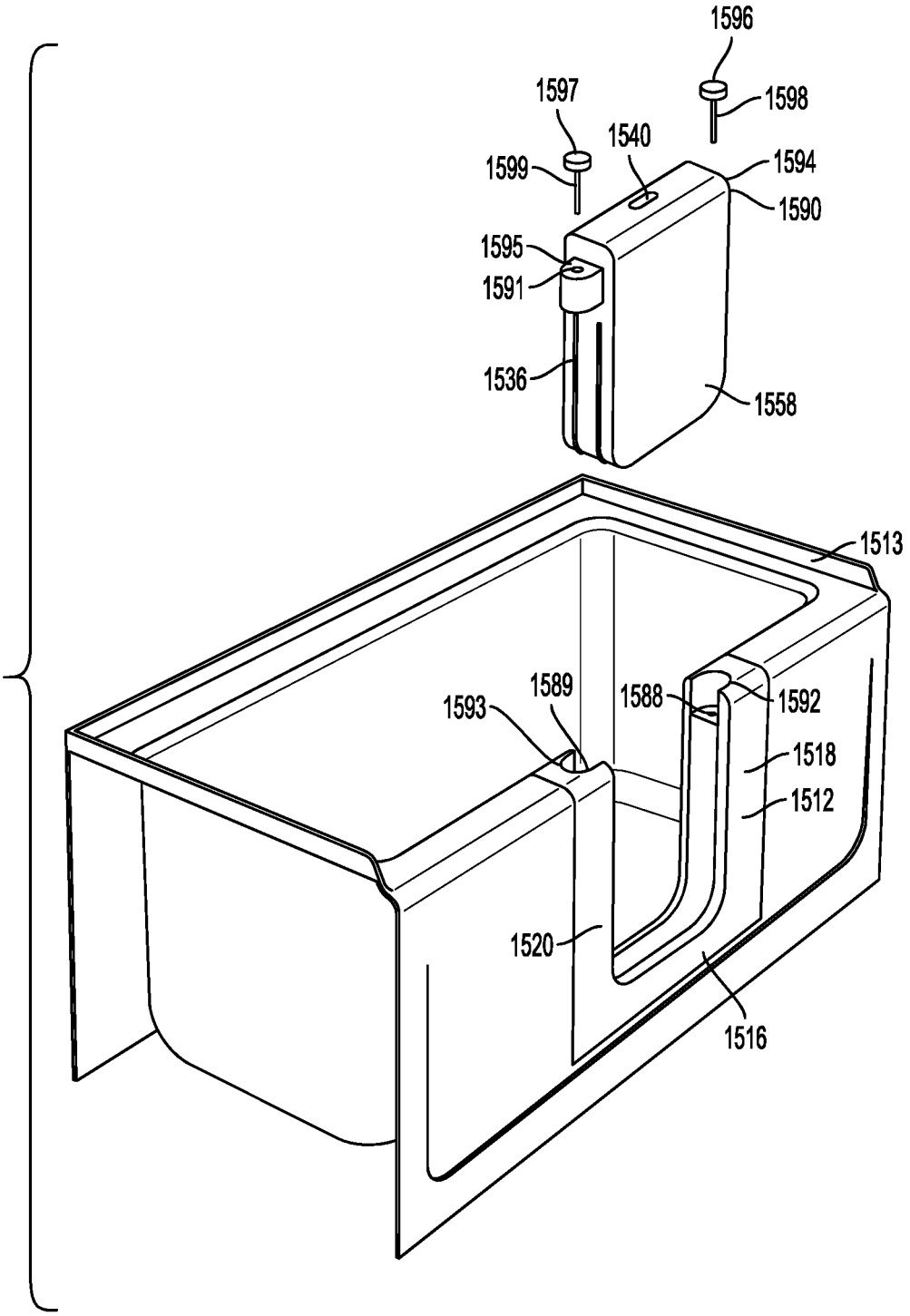

FIG. 35 is an exploded view of the modular bathtub overlay system shown in FIG. 34.

Figure 36:
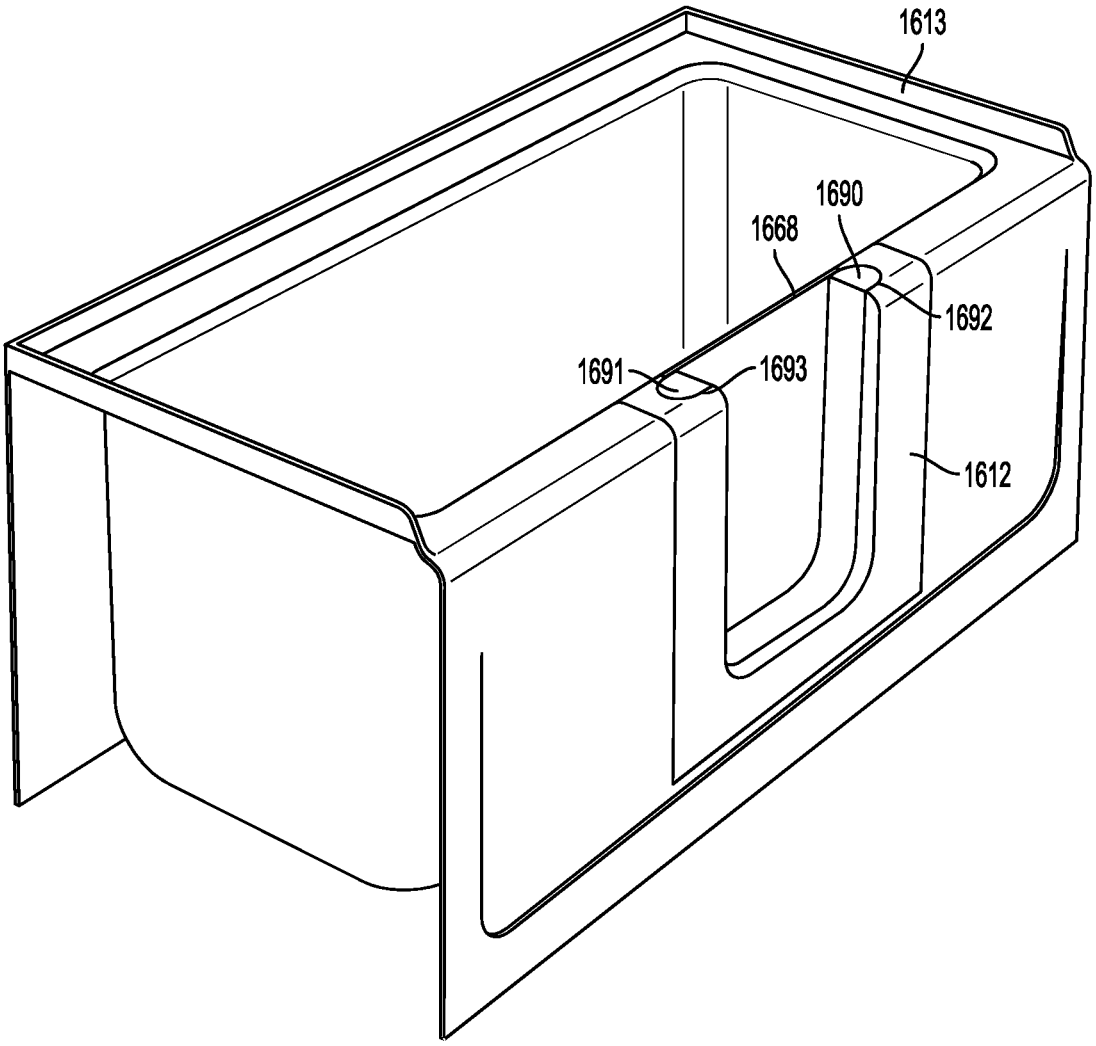

FIG. 36 is a perspective exterior view of the modular bathtub overlay system of FIG. 33 shown with a removable door associated with the step.

Figure 37:
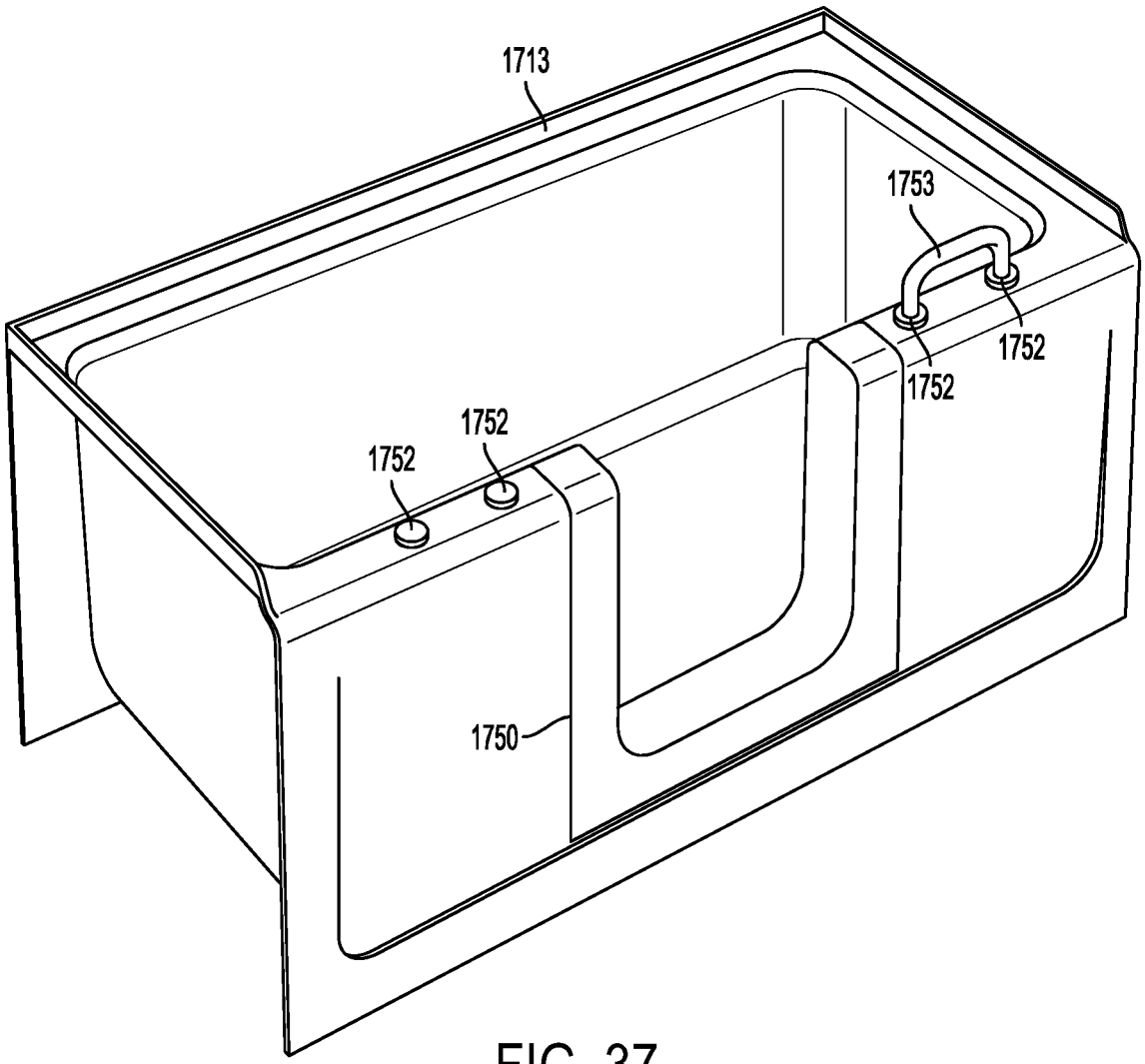

FIG. 37 is a perspective exterior view of a bathtub step and a plurality of universal adapters, according to one embodiment, shown associated with a bathtub.

Figure 38:
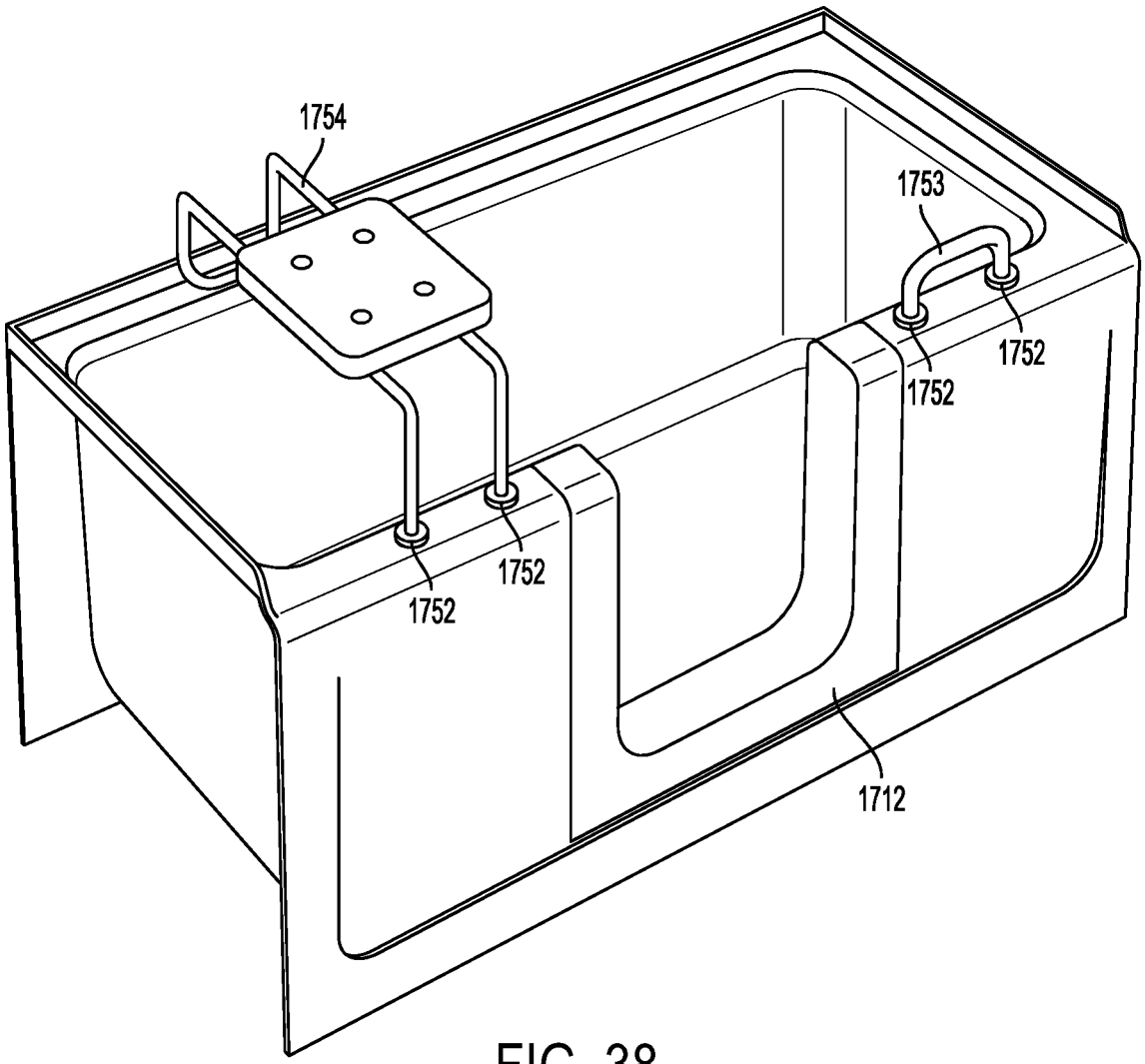

FIG. 38 is a perspective exterior view of the bathtub step of FIG. 37 shown with a seat coupled with the plurality of universal adapters.

Figure 39:
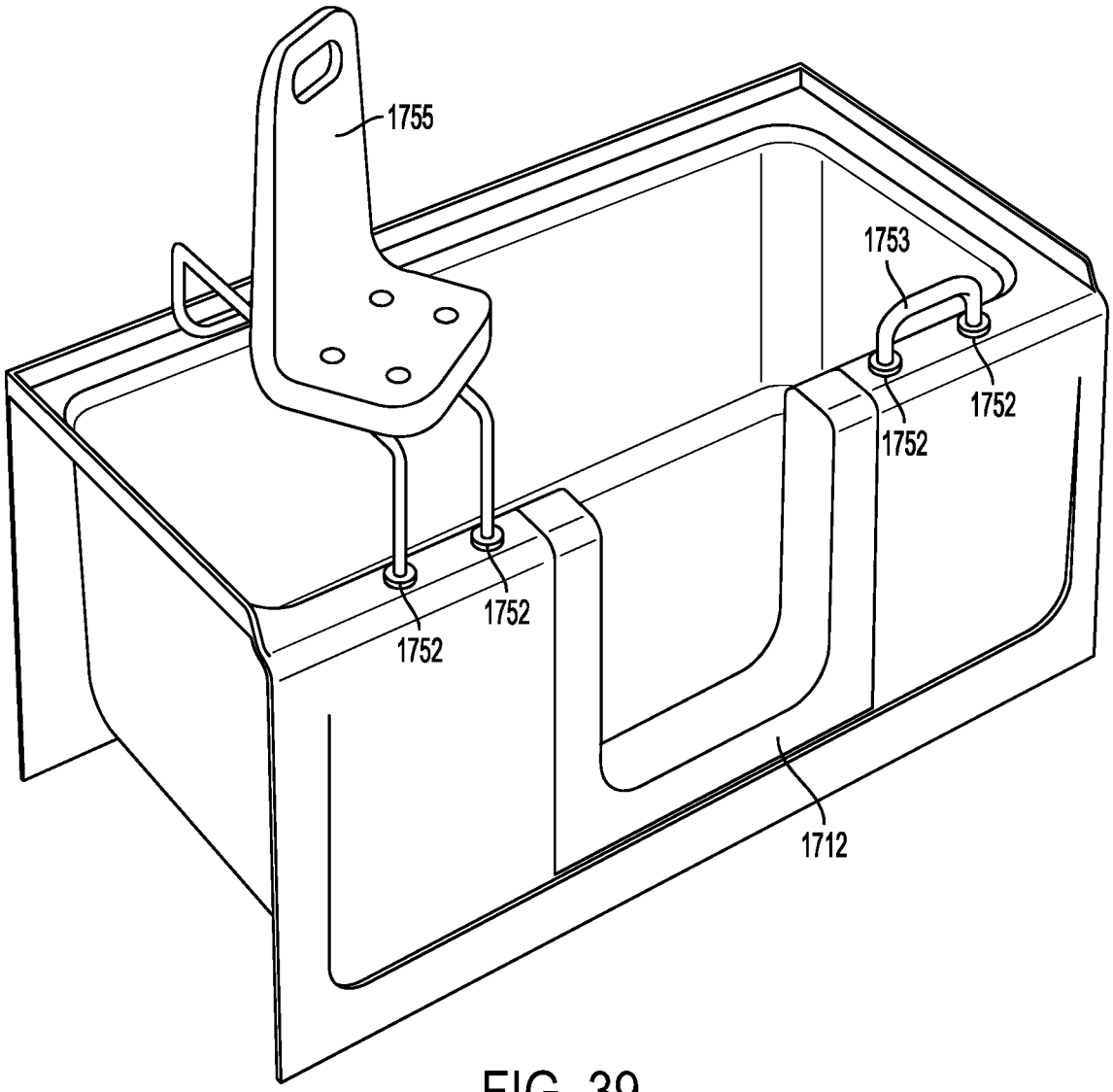

FIG. 39 is a perspective exterior view of the bathtub step of FIG. 37 shown with an alternate version of a seat coupled with the plurality of universal adapters.

Figure 40:
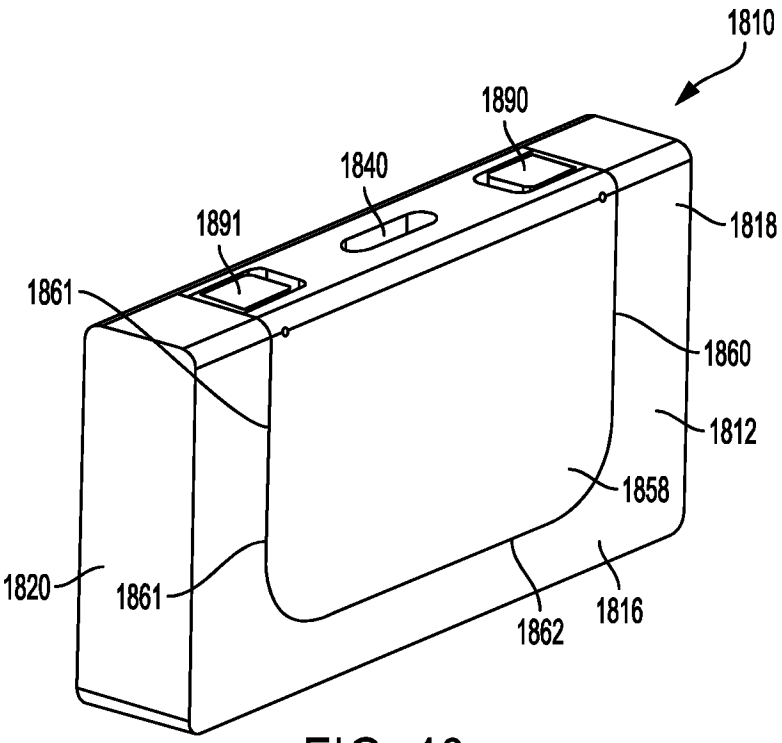

FIG. 40 is a perspective exterior view of a step and a removable plug according to one embodiment.

Figure 41:
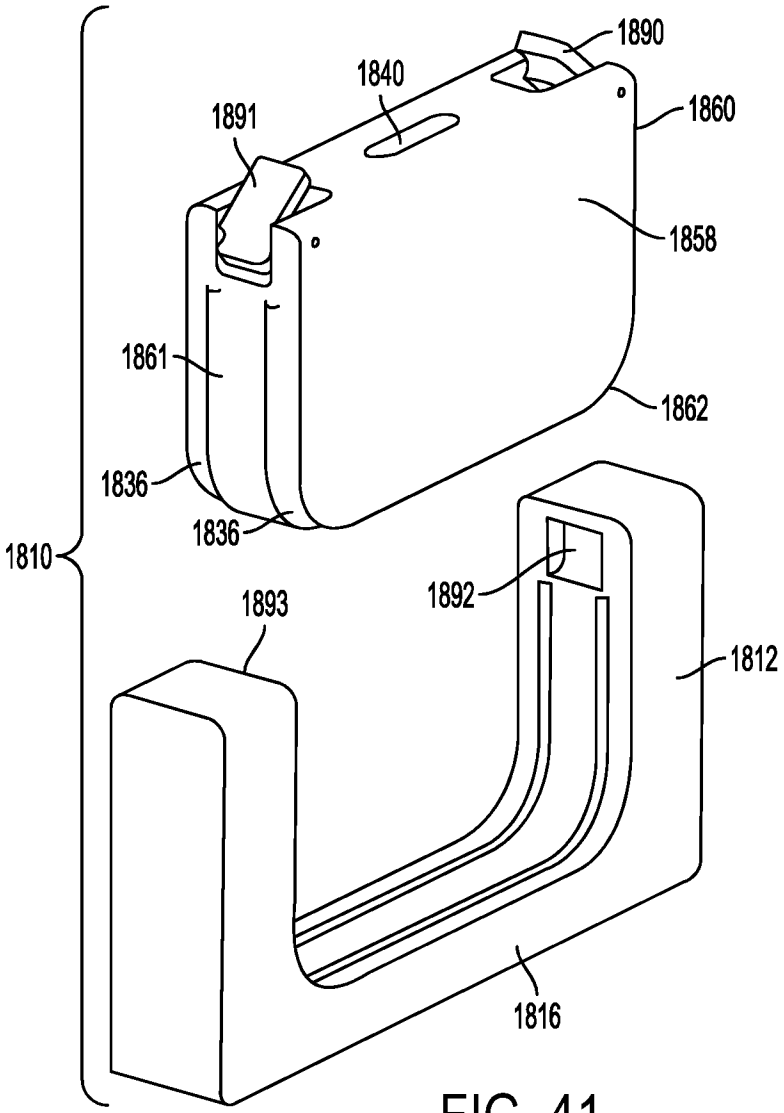

FIG. 41 is a perspective exterior view of the step and removable plug of FIG. 40 shown with the removable plug removed from the step.

Figure 42B:
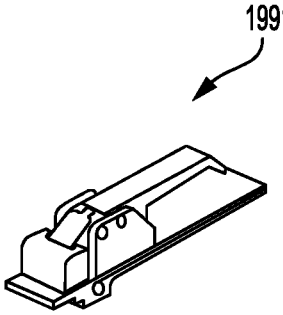
Figure 42A:
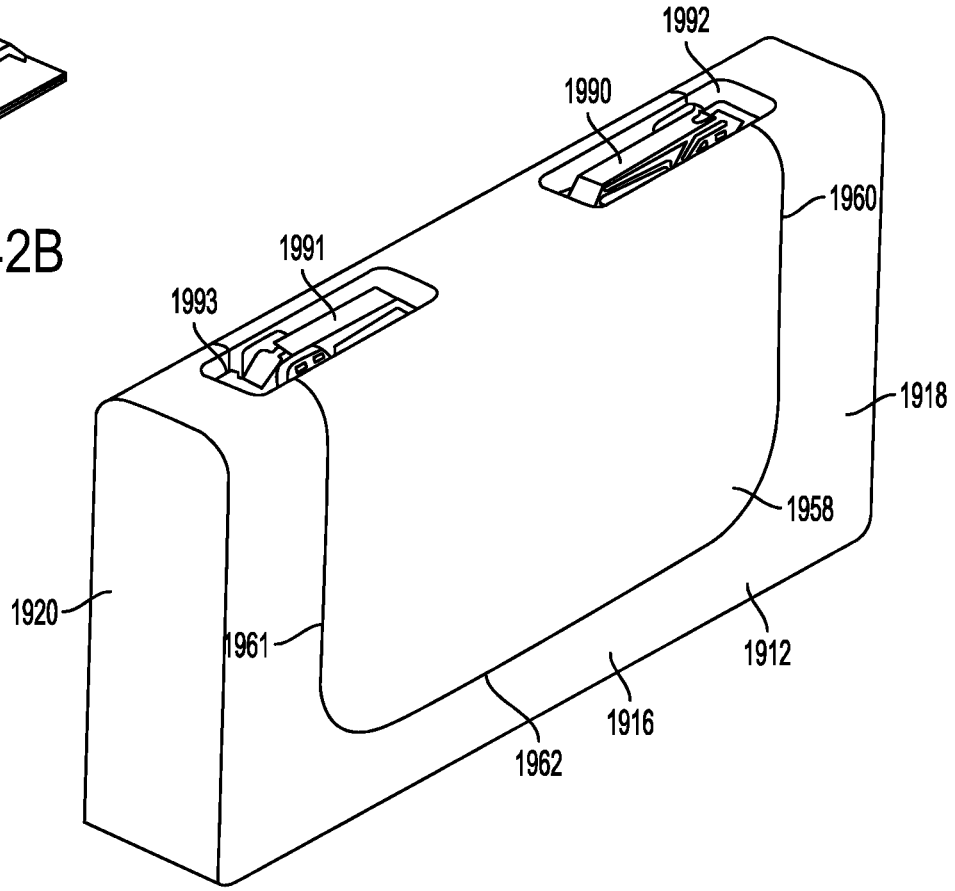

FIG. 42A is a perspective exterior view of a step and a removable plug, according to an alternate embodiment, the removable plug shown having a plurality of compression levers.

FIG. 42B is a perspective view of a compression lever shown in FIG. 42A.

Figure 43:
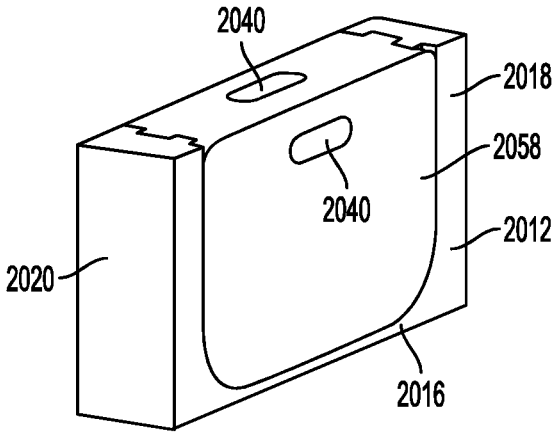

FIG. 43 is a perspective interior view of a step and a removable plug according to one embodiment.

Figure 44:
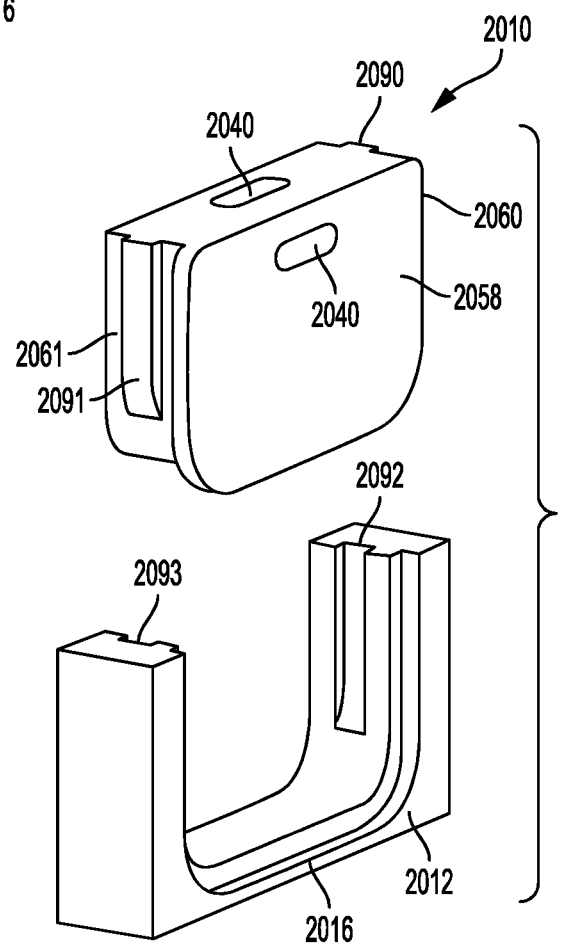

FIG. 44 is a perspective interior view of the step and removable plug of FIG. 43 shown with the removable plug removed from the step.

Figure 45:
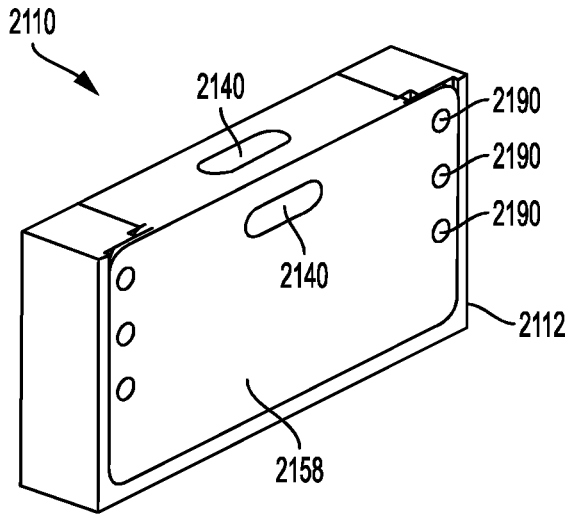

FIG. 45 is a perspective interior view of a step and a removable plug and cover according to one embodiment.

Figure 46:
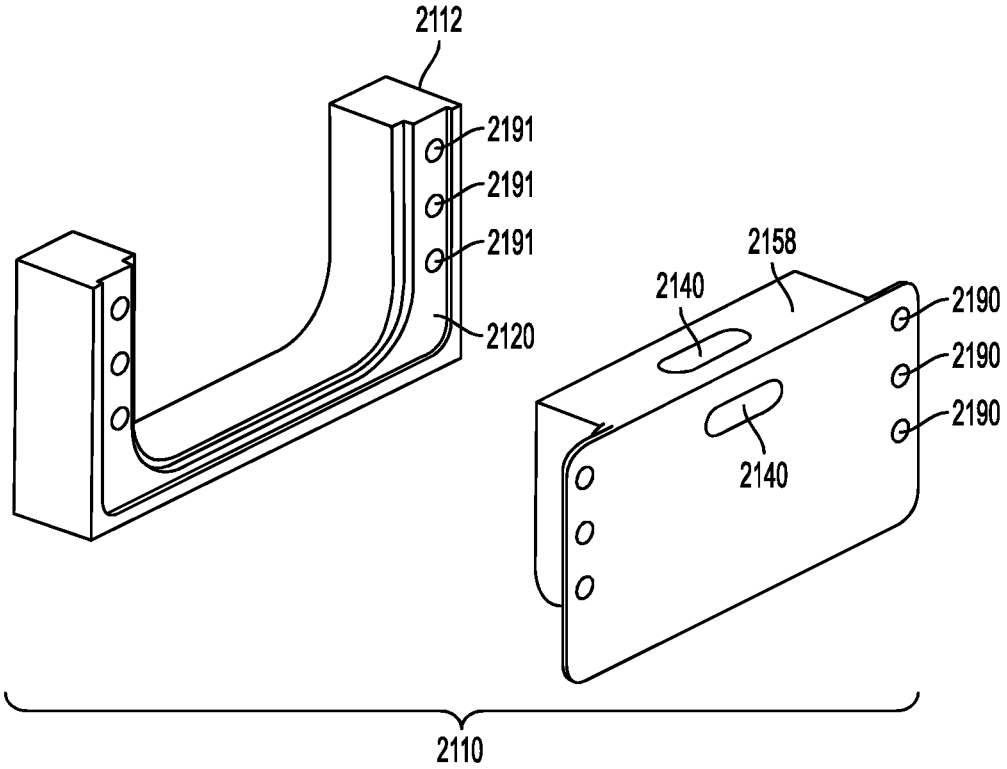

FIG. 46 is a perspective interior view of the step and removable plug and cover of FIG. 45 shown with the removable plug removed from the step.

Figure 47:
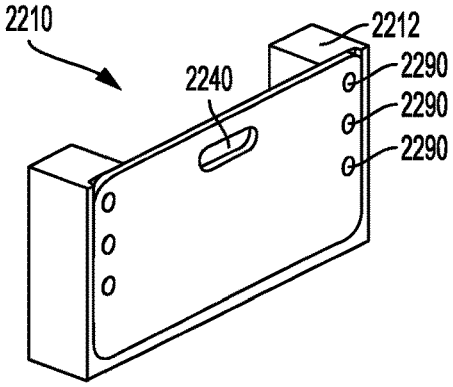

FIG. 47 is a perspective interior view of a step and a removable cover according to one embodiment.

Figure 48:
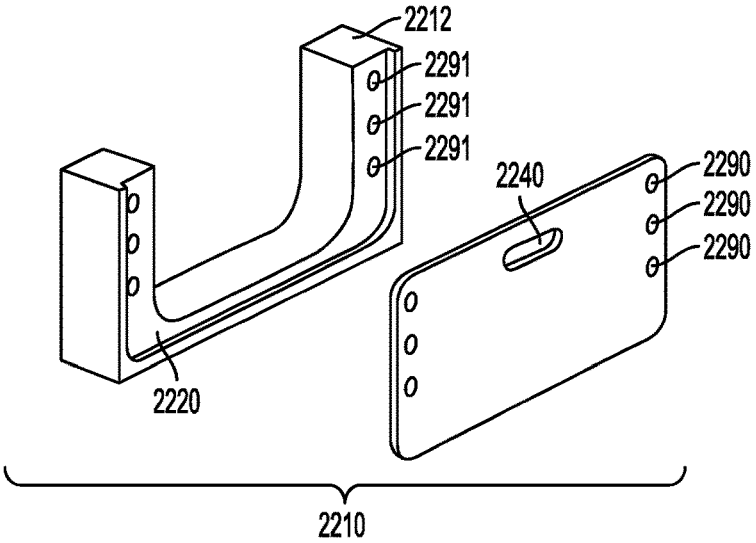

FIG. 48 is a perspective interior view of the step and removable cover of FIG. 47 shown with the removable cover removed from the step.

Figure 49:
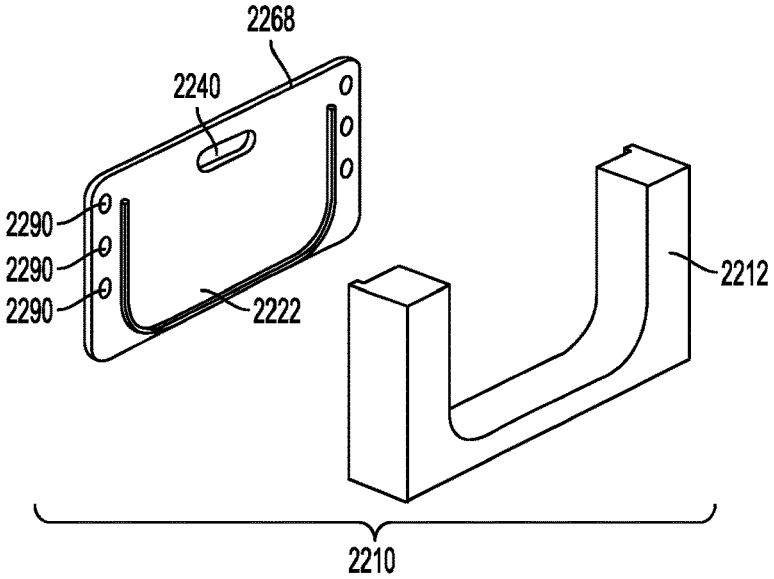

FIG. 49 is a perspective exterior view of the step and removable cover of FIG. 47 shown with the removable cover removed from the step.

Figure 50:
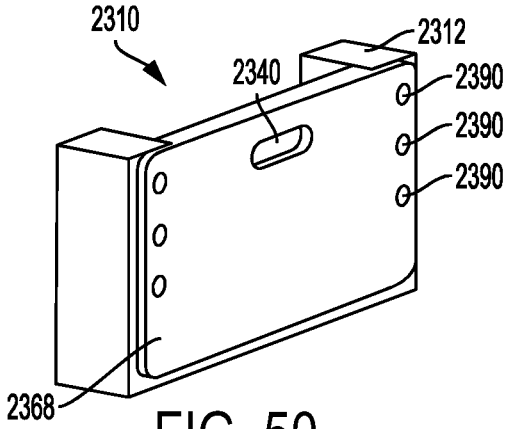

FIG. 50 is a perspective interior view of a step and a removable cover according to one embodiment.

Figure 51:
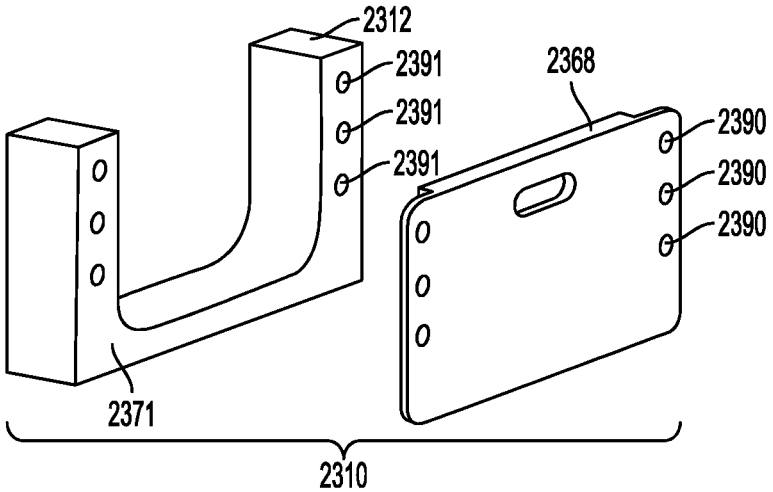

FIG. 51 is a perspective interior view of the step and removable cover of FIG. 50 shown with the removable cover removed from the step.

Figure 52:
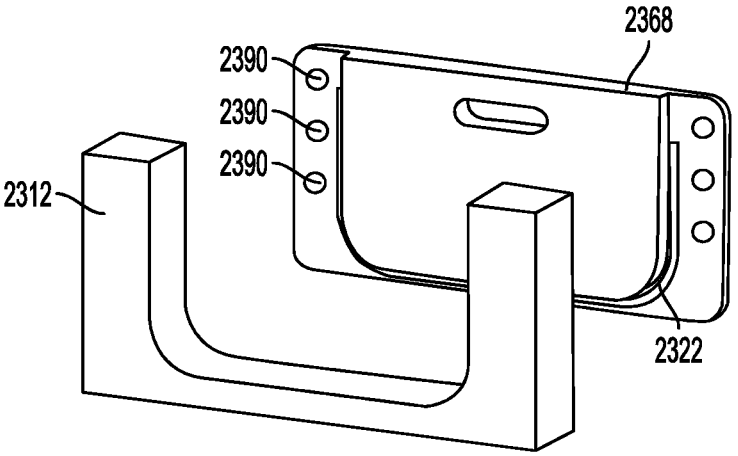

FIG. 52 is a perspective exterior view of the step and removable cover of FIG. 50 shown with the removable cover removed from the step.

Figure 53:
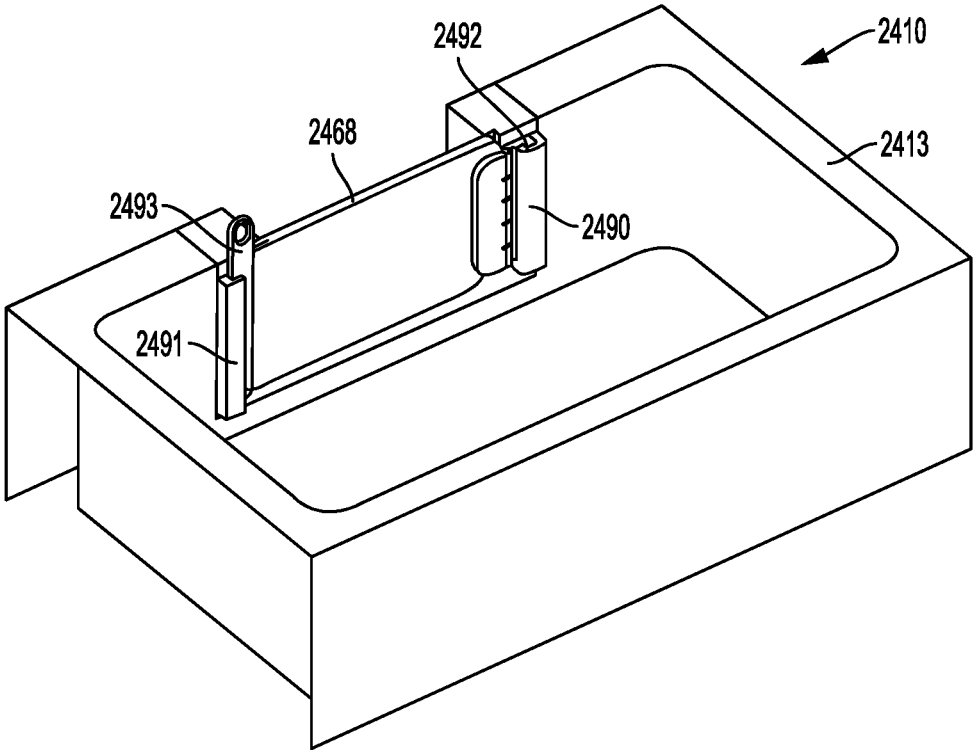

FIG. 53 is a perspective interior view of a step associated with a removable door, according to one embodiment, shown associated with a bathtub.

Figure 54:
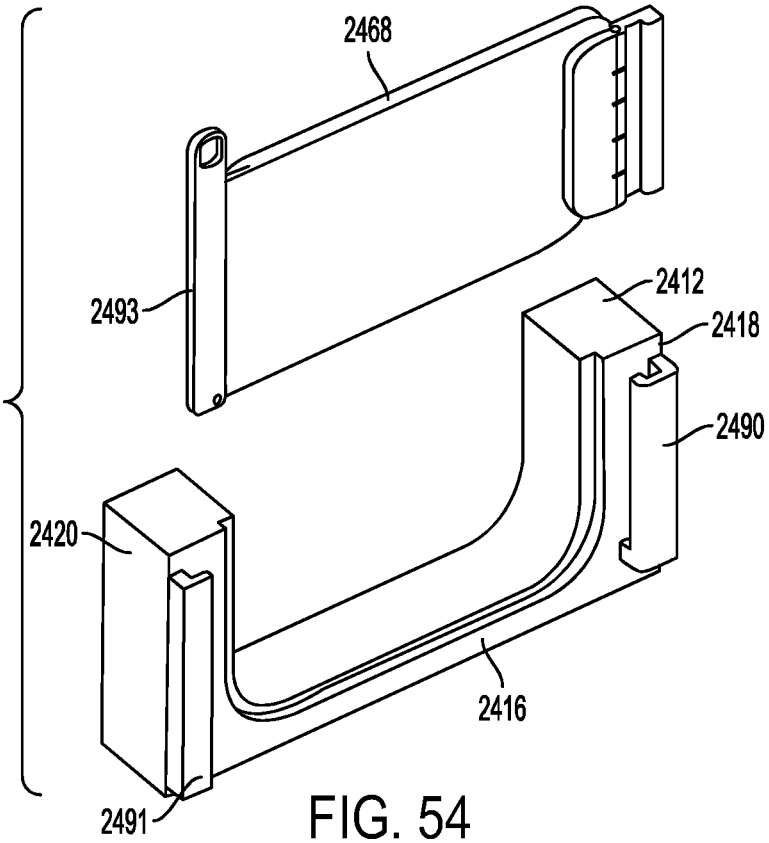

FIG. 54 is a perspective view of the removable door of FIG. 53 shown removed from the step.

Figure 55:
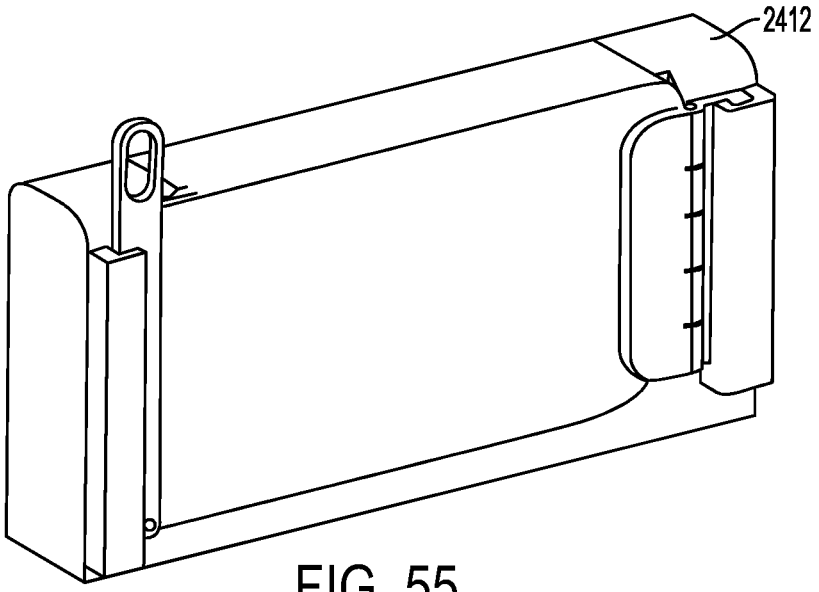

FIG. 55 is a perspective interior view of a step associated with a removable door, according to one embodiment, shown associated with a bathtub in a closed position.

Figure 56:
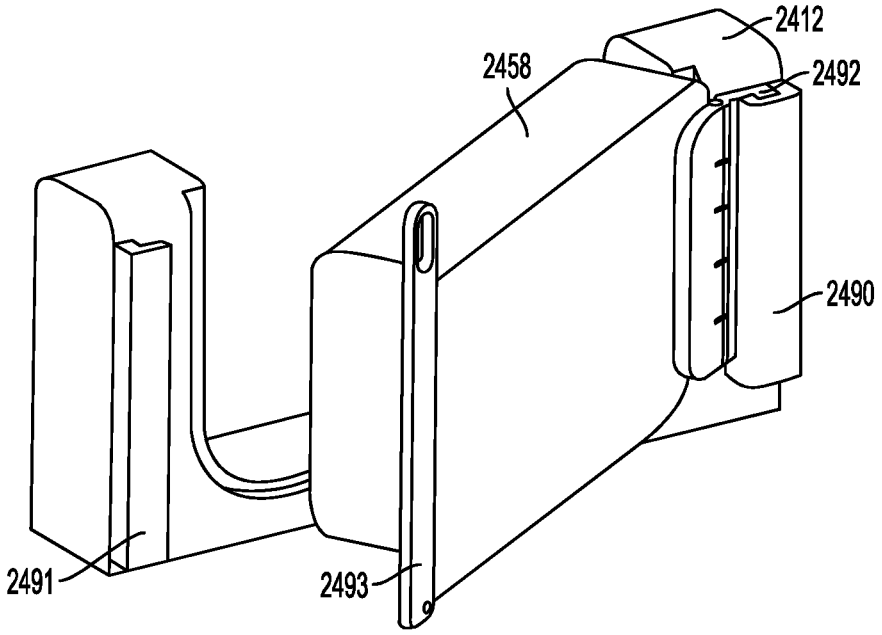

FIG. 56 is a perspective interior view of the removable door of FIG. 53 shown in an open position.

Figure 57:
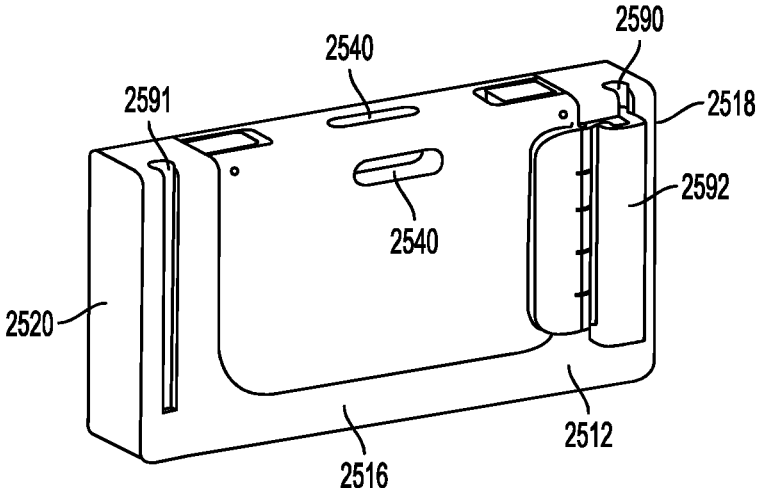

FIG. 57 is a perspective interior view of a modular step associated with a removable door and plug, according to one embodiment, shown in a closed position.

Figure 58:
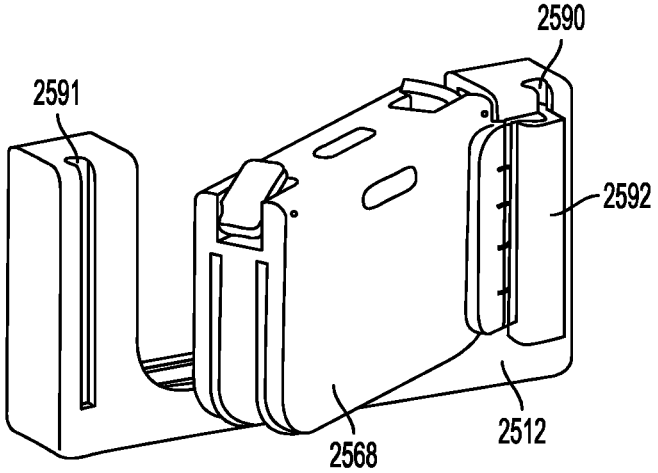

FIG. 58 is a perspective interior view of the modular step with the removable door and plug of FIG. 57 shown in an open position.

Figure 59:
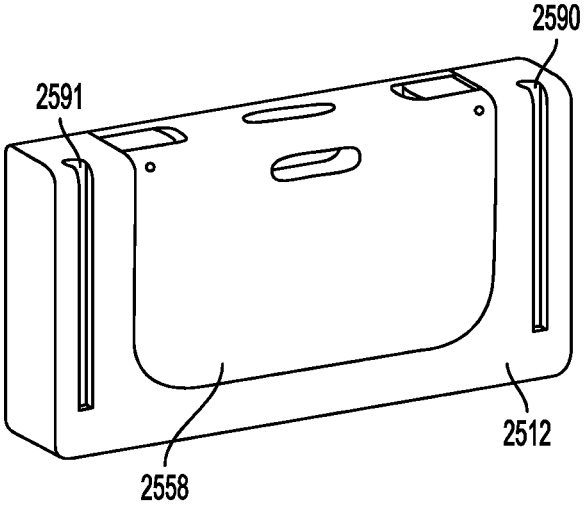

FIG. 59 is a perspective interior view of the modular step of FIG. 57 shown with only the removable plug.

Figure 60:
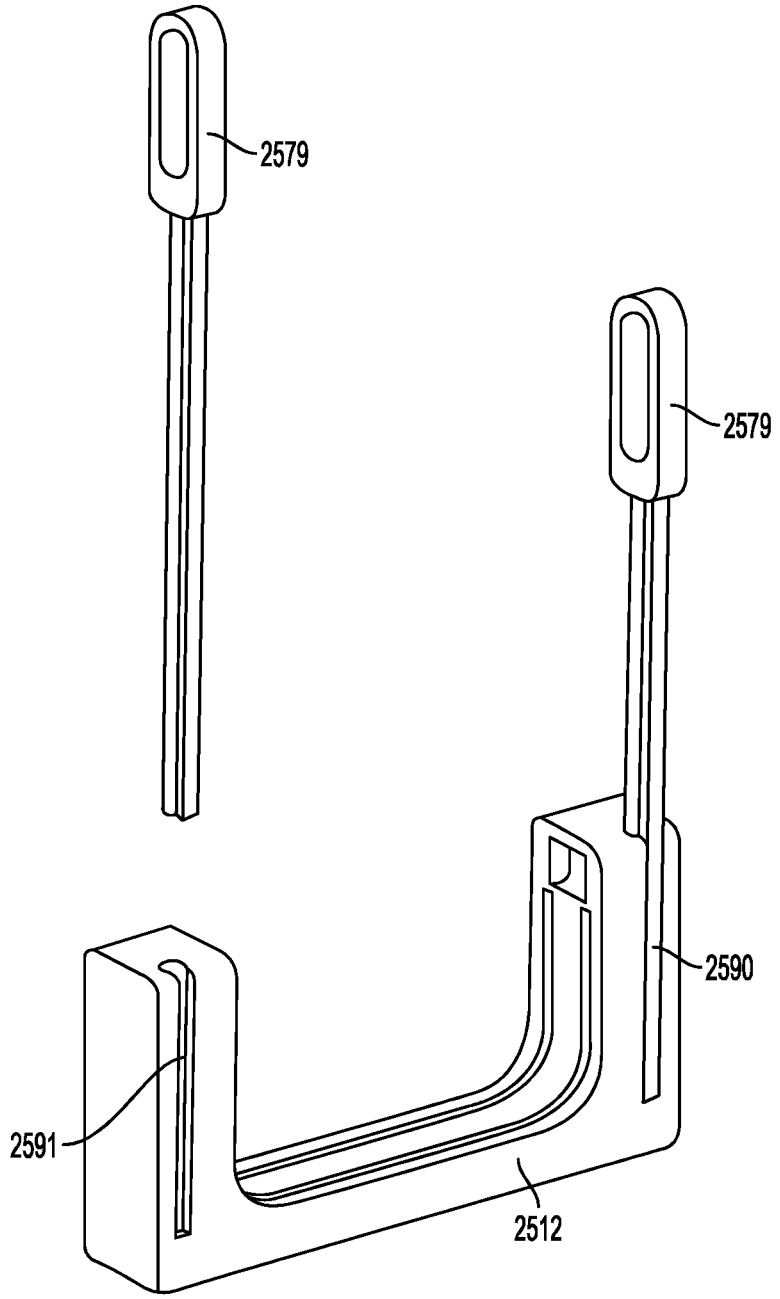

FIG. 60 is a perspective interior view of the modular step of FIG. 57 shown with a pair of grab bars inserted into a pair of attachment channels.

Figure 61:
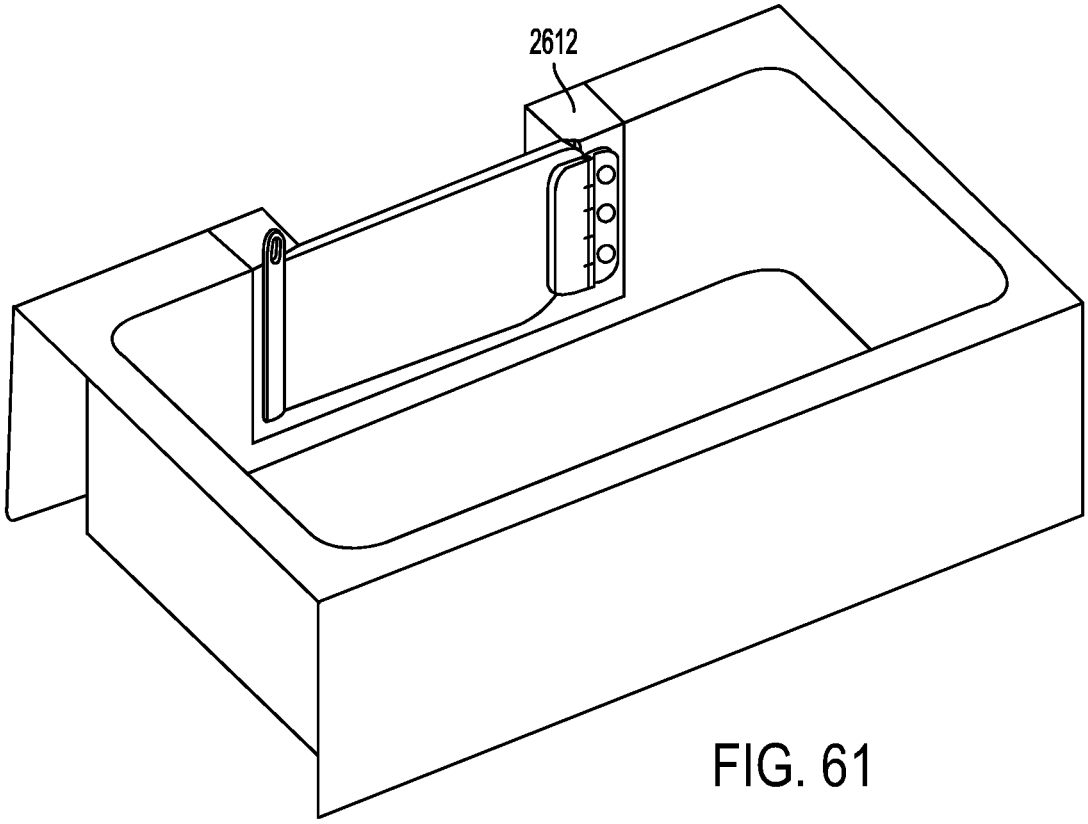

FIG. 61 is a perspective interior view of a step associated with a removable door, according to one embodiment, shown associated with a bathtub.

Figure 62:
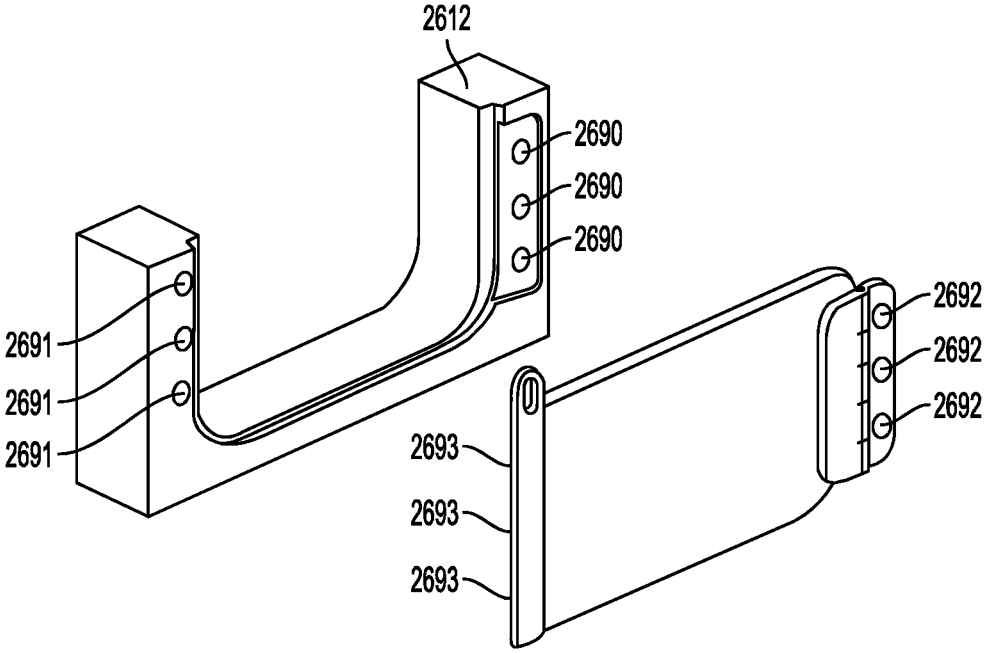

FIG. 62 is a perspective view of the removable door of FIG. 61 shown removed from the step.

Figure 63:
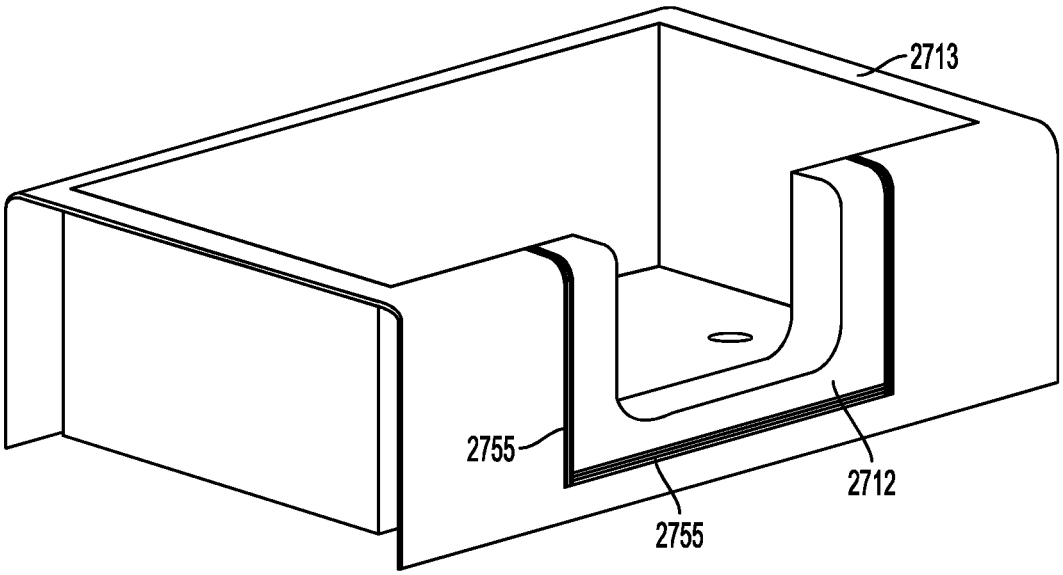

FIG. 63 is a perspective exterior view of one embodiment of a step, bathtub, and a plurality of seals positioned in the coupling between the step and bathtub.

Figure 64:
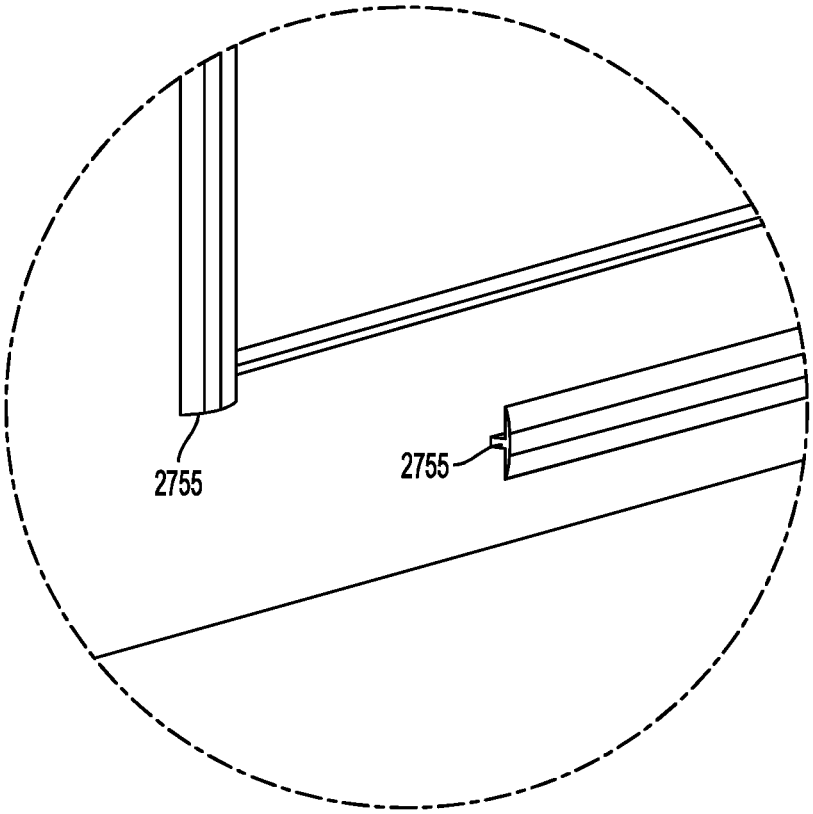

FIG. 64 is a more detailed view showing the seals of FIG. 63.

Figure 65:
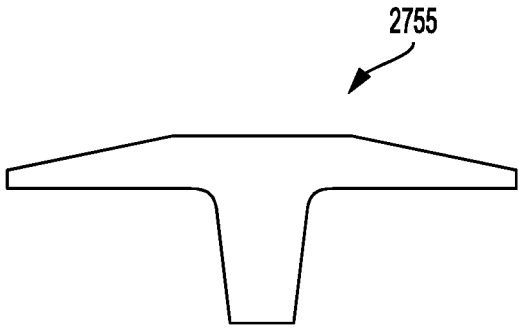

FIG. 65 is a right side view of one embodiment of a seal.

Figure 66:
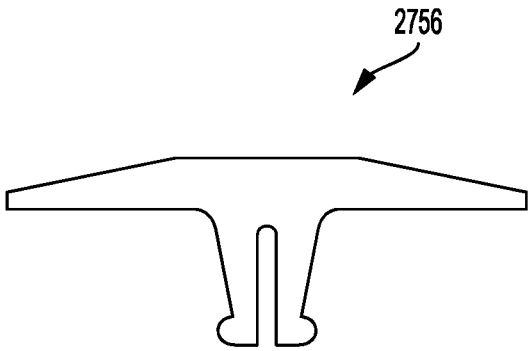

FIG. 66 is a right side view of an alternate embodiment of a seal.

Figure 67:
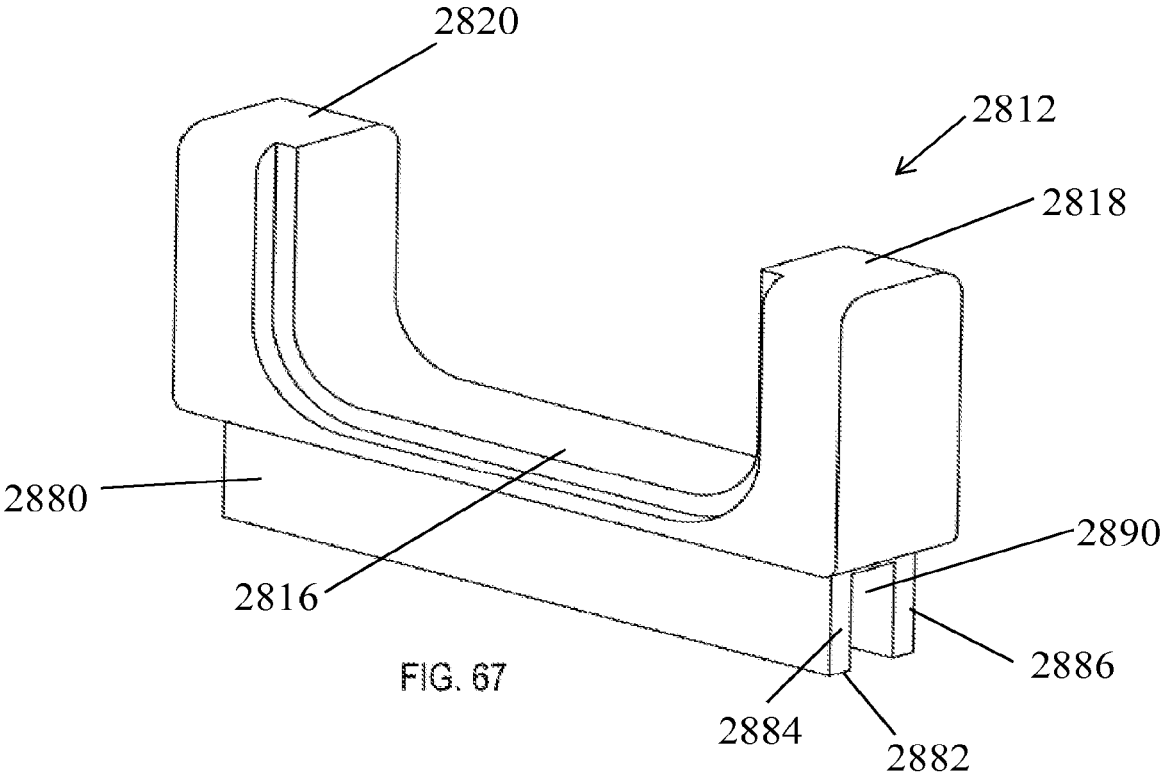

FIG. 67 is a perspective interior view of a step saddle having an integral support system according to one embodiment.

Figure 68:
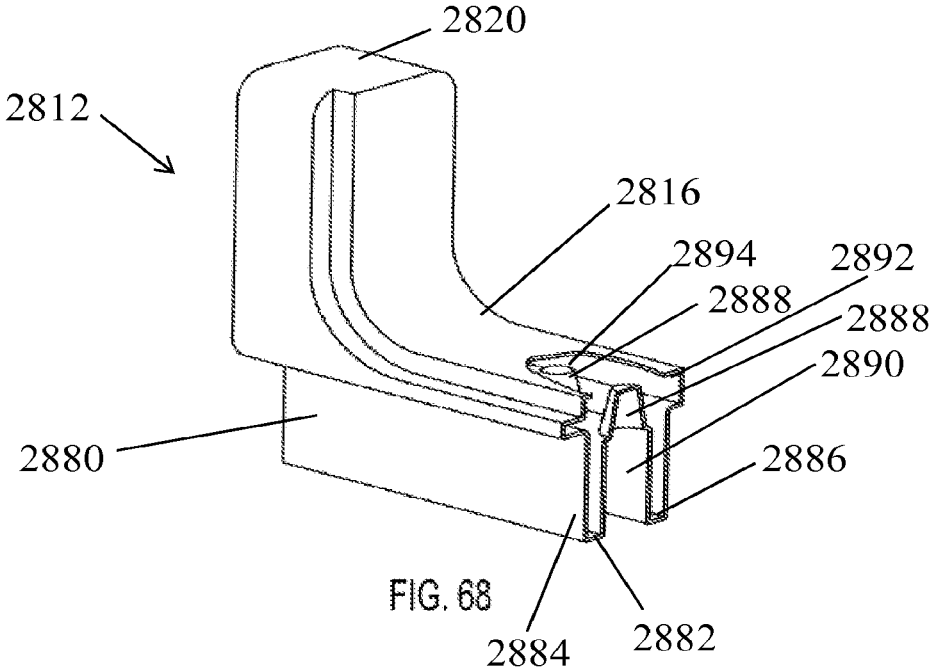

FIG. 68 is a partial cutaway view of the step saddle of FIG. 67.

Figure 69:
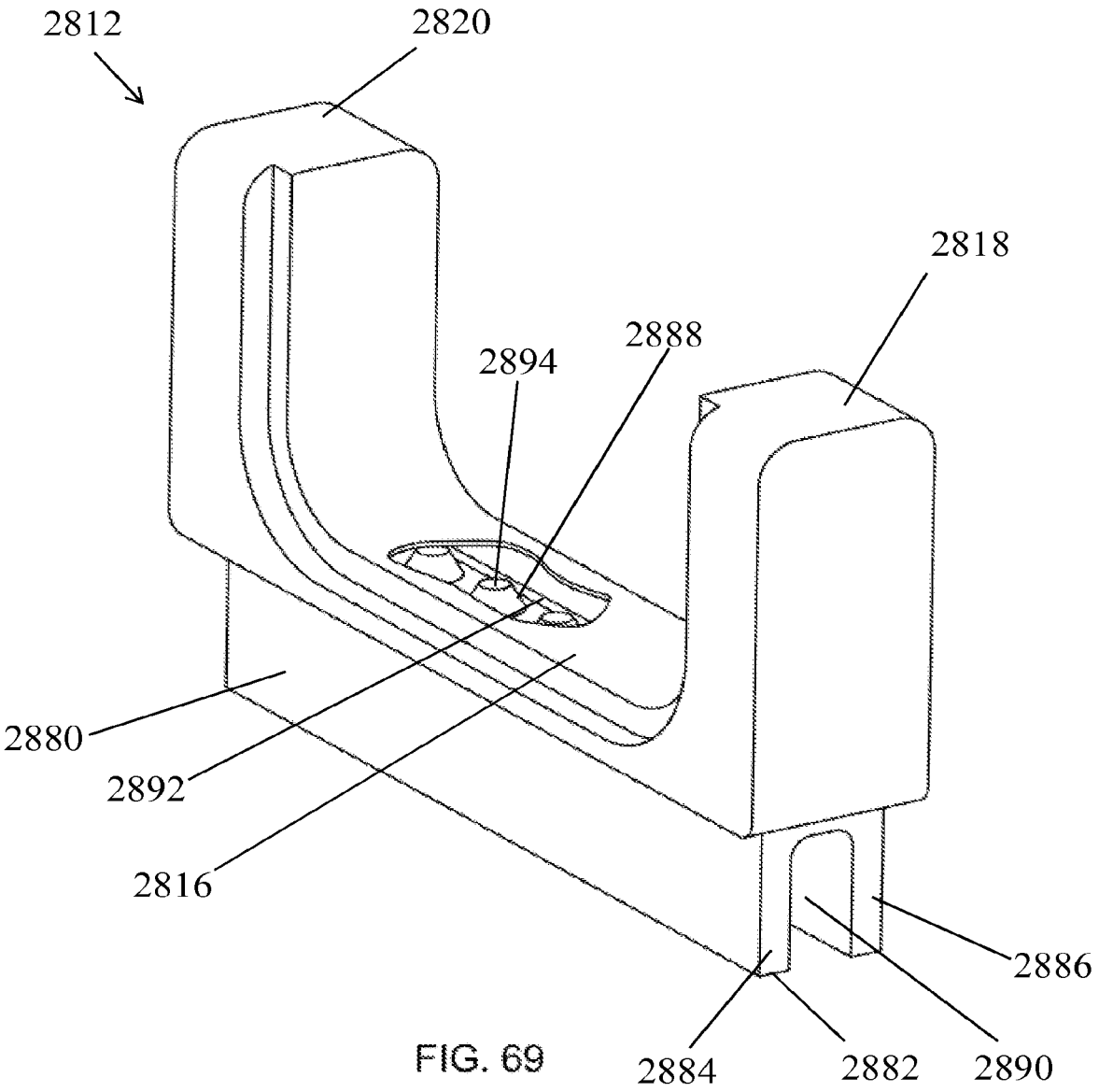

FIG. 69 is an alternate partial cutaway view of the step saddle of FIG. 67.

DETAILED DESCRIPTION

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment," or "in an embodiment" in places throughout the specification are not necessarily all referring to the same embodiment. Furthermore, the particular features, structures or characteristics may be combined in any suitable manner in one or more embodiments.

Described herein are example embodiments of apparatuses, systems, and methods for bathtub systems, covers, closures, plugs, and overlays. In one example embodiment, a bathtub closure system can include a step, which can help to facilitate ingress to and egress from a bathtub, and a barrier, which can combine with the step to retain water within the bathtub. In some embodiments, the bathtub can be retrofitted to include the step and in other embodiments an opening, such as a U-shaped opening, can be molded or otherwise manufactured with the bathtub. The step can be configured to accommodate a variety of types of barriers, such as a cover, a closure, a plug, or a combination thereof. In some embodiments, the barrier can be removable. The barrier can be positioned on the step, positioned adjacent to the step, or otherwise placed in contact with the step or a portion thereof. In some embodiments, the barrier can be secured to the step by a friction fit, a retention mechanism, or one or a plurality of fasteners, such as a clamp, magnet, or a plurality of screws. In some embodiments, the barrier can include a seal, which can further facilitate water retention within the bathtub.

Example embodiments described herein can allow a bathtub to be easily converted from an accessible shower to a usable tub. For example, a plug or closure can be used to seal an opening or aperture in the sidewall of a tub using top-down screws or fasteners. Additionally, or alternatively, the step saddle can accept a variety of components including a plug, a plurality of plugs, a door, or the like. For example, the step can have a modular configuration where the same step can accept a plug, a door, and/or accessories as desired by a user. The modular step can be sold as a kit or separate components or accessories can be purchased and/or used as needed.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Example embodiments described herein can improve ease of access to and from a bathtub while retaining a bathtub's ability to retain a substantial volume of water. A bathtub system can include a step, which can provide a lower clearance than a surrounding bathtub wall for easy access. The step can facilitate ingress to and egress from a bathtub by eliminating a potentially hazardous high step that is associated with traditional bathtubs. Despite this provision for a lower clearance, embodiments of the bathtub system described herein can selectively accommodate a water level substantially commensurate with the surrounding bathtub wall. The bathtub system can include a barrier, which can establish a clearance substantially similar to that of the surrounding bathtub wall. The barrier can accommodate a higher water level than that allowable by the step and can otherwise facilitate water retention within the bathtub. The barrier can be removable such that easier ingress to and egress from the bathtub can be permitted, for example, before and after a bath or shower. The barrier can include, for example, a plug, which can easily be placed on the step, and/or a cover, which can easily be positioned adjacent to the step. Alternatively, the barrier can be a permanent retrofit that can substantially restore a bathtub with an opening or step to the look and function of a traditional bathtub. For example, if a home is sold where a bathtub having an opening or step is no longer needed, a barrier can be permanently placed over or in the opening such that the bathtub substantially looks and operates like a traditional bathtub.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Example embodiments described herein can allow a bathtub to be easily converted from an accessible shower to a usable tub. For example, a plug can be used to seal an opening or aperture in the sidewall of a tub using top-down screws or fasteners. Additionally, or alternatively, the step saddle can accept a variety of components including a plug, a plurality of plugs, a door, or the like. It will be appreciated that a plug, door, fitting, or the like can partially or substantially block or close an aperture or cavity defined by a step saddle. For example, the step saddle or substantially U-shaped cutout can have an open position that can allow ingress and egress from a bathtub, or can be closed with a plug such that the bathtub can be operated in a traditional manner. The plug can be engaged with the U-shaped cutout or step saddle in any suitable manner. For example, the plug can include one or a plurality of latches that can engage one or a plurality of cavities in a step saddle when a plug is engaged with the step saddle. The plug can be removed by lifting up on the one or a plurality of latches such that the latch can disengage the step saddle. The plug can be secured or releasably secured to the step saddle or u-shaped cavity in any suitable manner such as with a screw, latch, compression lever, vertical screw, horizontal screw, cam, or any other suitable mechanism.

Figure 1:
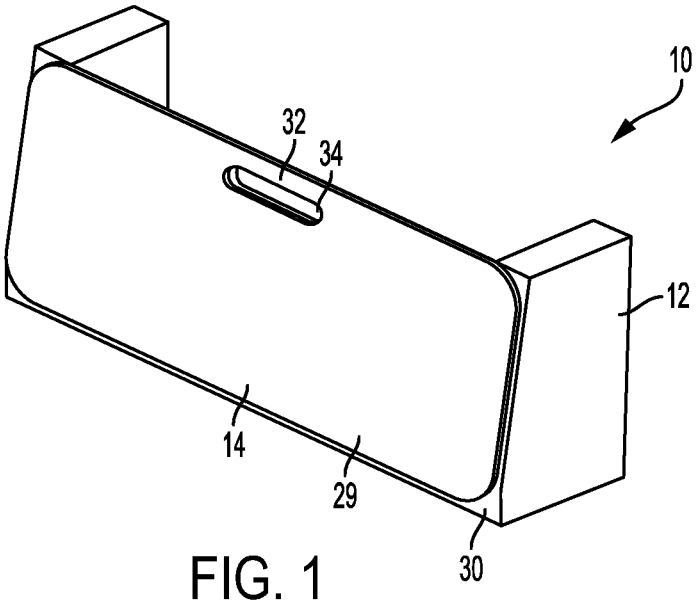
FIG. 1 is a perspective interior view of a bathtub overlay system, with a step and a cover shown in an engaged position, according to one embodiment.
Figure 2:
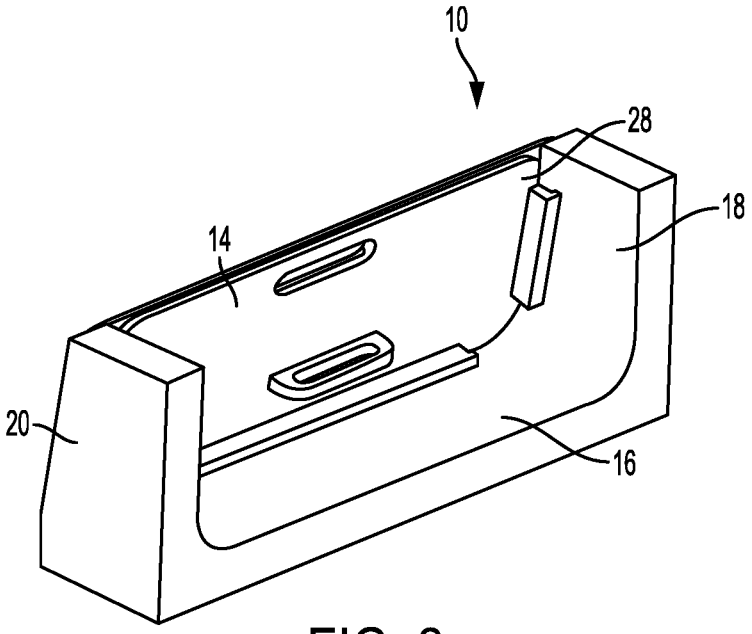
FIG. 2 is a perspective exterior view depicting the bathtub overlay system of FIG. 1.
Figure 3:
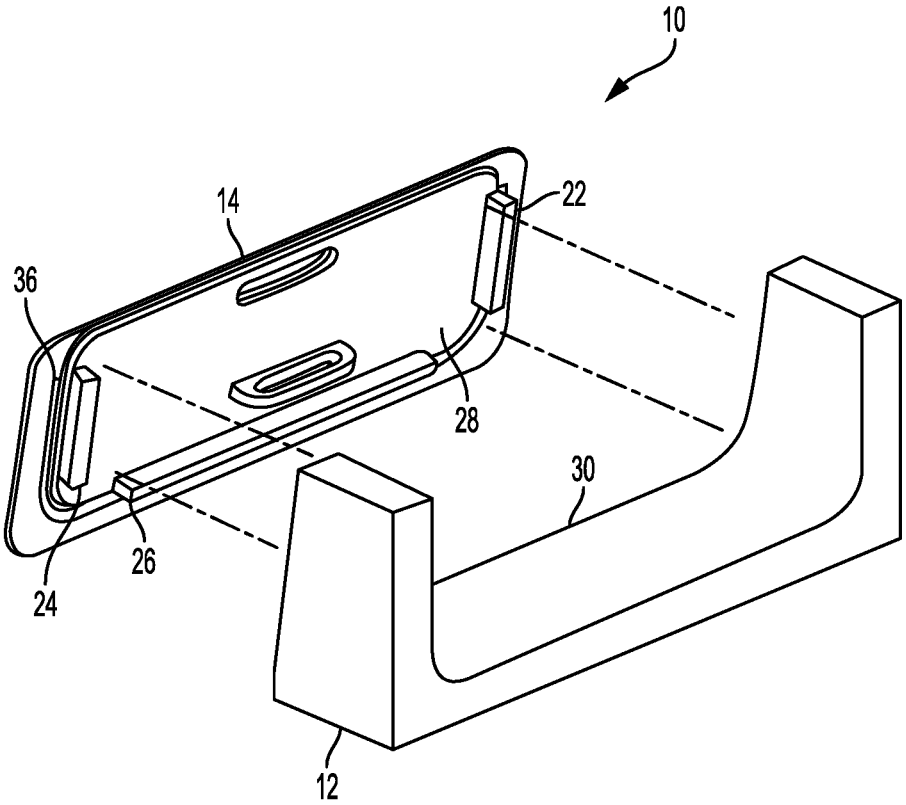
FIG. 3 is an exploded exterior view of the bathtub overlay system of FIG. 1, shown with the cover detached from the step.

Referring now to FIG. 1, a bathtub overlay system 10 can include a step 12 and a closure or cover 14. The cover 14 can be secured to the step 12 as shown in FIGS. 1-2. In the engaged position, the step 12 and the cover 14 can combine to retain water within a bathtub, where the cover 14 can be configured to function as a traditional bathtub wall. The cover 14 can be selectively detachable from the step 12 to allow improved access to and from the bathtub. As shown in FIGS. 2-3, the step 12 can include an elongated platform 16, a first side panel 18, and a second side panel 20, where the elongated platform 16 can extend between the first side panel 18 and the second side panel 20. Each of the first side panel 18 and the second side panel 20 can be connected to a portion of the bathtub (e.g., a bathtub sidewall). The elongated platform 16 can include surface effects, a non-slip pad, a textured surface, or other features to prevent accidental slippage. The step 12 can be coupled to a bathtub with caulking, sealant, seals, adhesive, foam, or any other suitable material. The step can be formed from any suitable material and can, for example, be formed from the same material as the bathtub, from plastic, or the like.

Referring to FIG. 3, the cover 14 can include a first vertical flange 22, a second vertical flange 24, and a horizontal flange 26, where each of the first vertical flange 22, the second vertical flange 24, and the horizontal flange 26 can extend from an exterior side 28 of the cover 14. In the engaged position, the exterior side 28 of the cover 14 can overlap and engage an interior side 30 of the step 12, and both the first vertical flange 22 and the second vertical flange 24 can be positioned between the first side panel 18 and the second side panel 20. The first vertical flange 22 and the second vertical flange 24 can be configured to engage the first side panel 18 and the second side panel 20, respectively, such that the cover 14 can be secured to the step 12 with a friction fit. Similarly, the horizontal flange 26 can be configured to engage the elongated platform 16 such that the cover 14 can be secured to the step 12. As a result, the first vertical flange 22, the second vertical flange 24, and the horizontal flange 26 can be configured to guide the cover 14 into the engaged position and can help to prevent incorrect placement of the cover 14 on the step 12. The cover 14 can further be held against the step 12 by the force of water contained within the bathtub, where the force of water can, for example, pressure an interior side 29 of the cover 14, such that the exterior side 28 of the cover 14 can more firmly engage the interior side 30 of the step 12.

The cover 14 can include a handle 32 and a groove 34, which can be configured to facilitate securing the cover 14 to the step 12 and removing the cover 14 from the step 12. As shown in FIGS. 1-3, the handle 32 can extend from the exterior side 28 of the cover 14 and the groove 34 can be near a top of the cover 14, where an individual can grip the cover 14 to, for example, carry the cover 14 or disengage the cover 14 from the step 12. The cover 14 can include a seal 36 (FIG. 3), which can help to retain water within the bathtub. As shown in FIG. 3, the seal 36 can be positioned on the exterior side 28 of the cover 14 such that the seal 36 can contact the interior side 30 of the step 12 with the cover 14 in the engaged position. In an alternative embodiment, the seal 36 can be positioned directly on the interior side 30 of the step 12 such that the seal 36 can contact the exterior side 28 of the cover 14 with the cover 14 in the engaged position. The handle 32 can have any suitable position or orientation and a plurality of handles are contemplated.

Figure 4:
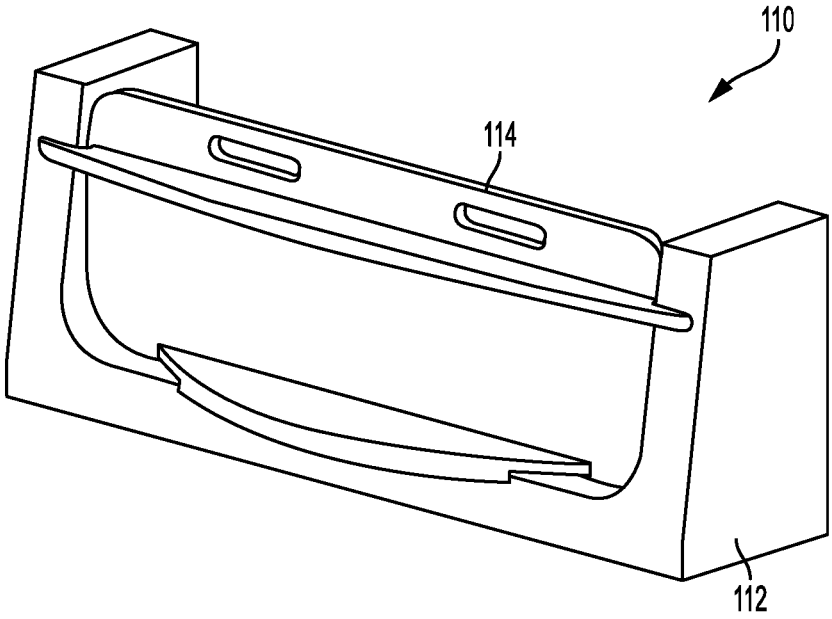
FIG. 4 is a perspective interior view of a bathtub overlay system, according to an alternate embodiment, shown with a step and a cover in an engaged position.
Figure 5:
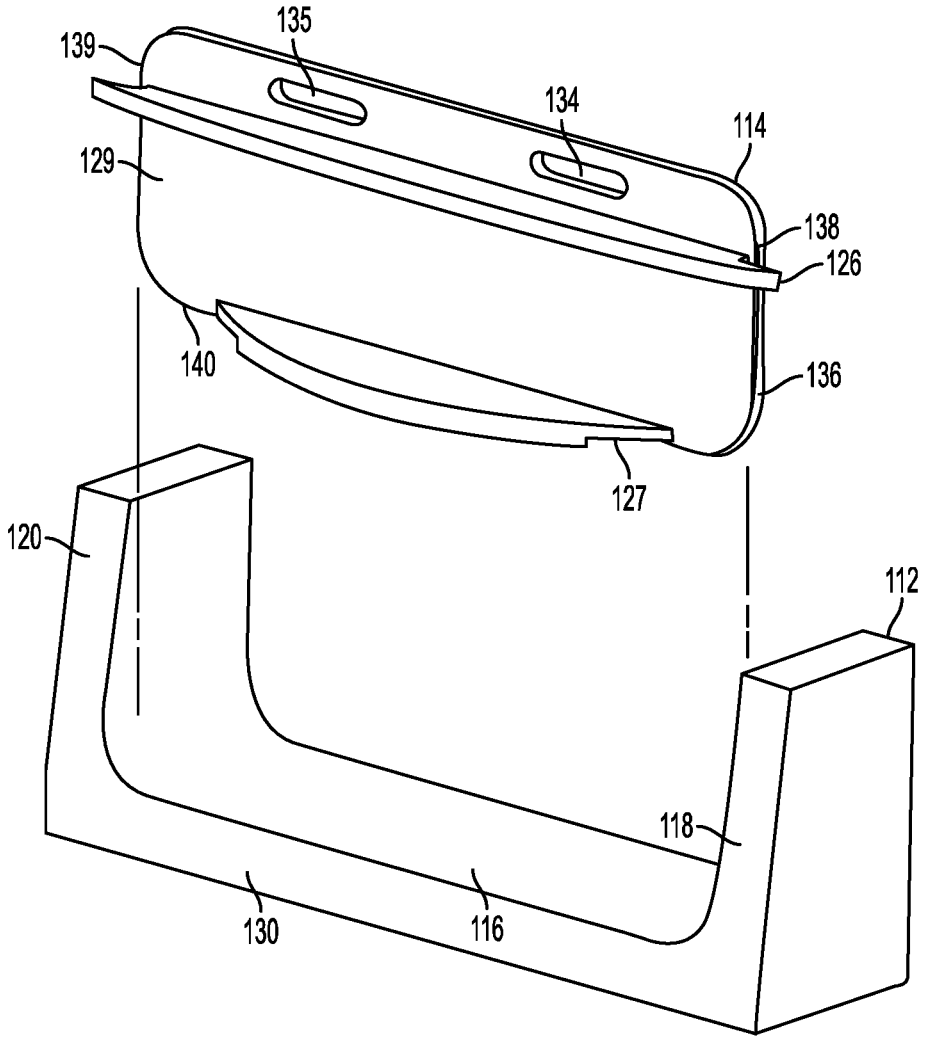
FIG. 5 is an exploded interior view of the bathtub overlay system of FIG. 4, shown with the cover detached from the step.

FIGS. 4-5 depict an alternative embodiment of a bathtub overlay system 110. The bathtub overlay system 110 can include a step 112 and a cover 114. The cover 114 can be secured to the step 112 in an engaged position, as shown in FIG. 4. In the engaged position, the step 112 and the cover 114 can combine to retain water within a bathtub, where the cover 114 can act similarly to a traditional bathtub wall. The cover 114 can be selectively detachable from the step 112 to allow improved access to and from the bathtub. For example, at least a portion of the step 112 can have a lower clearance than the cover 114 in the engaged position, such that, upon disengaging the cover 114 from the step 112, the step 112 can provide a lower obstacle for an individual entering or exiting the bathtub.

The step 112 can include an elongated platform 116, a first side panel 118, and a second side panel 120, where the elongated platform 116 can extend between the first side panel 118 and the second side panel 120. Each of the first side panel 118 and the second side panel 120 can be connected to a portion of the bathtub (e.g., a bathtub wall). In one embodiment, the elongated platform 116 of the step 112 can have a lower clearance than the cover 114 in the engaged position, such that, with the cover 114 disengaged from the step 112, an individual can step over the elongated platform 116 to more easily enter or exit the bathtub.

The cover 114 can include a first side 138, a second side 139, and a bottom portion 140. The first side 138, the second side 139, and the bottom portion 140 can engage the first side panel 118, the second side panel 120, and the elongated platform 116, respectively, such that the cover 114 can be secured to the step 112 with a friction fit, fasteners, or any other suitable mechanism. As shown in FIG. 5, the cover 114 can include a seal 136, which can be positioned on each of the first side 138, the second side 139, and the bottom portion 140 of the cover 114, such that the seal 136 can contact the first side panel 118, the second side panel 120, and the elongated platform 116 of the step 112 with the cover 114 in the engaged position. The cover 114 can include a first horizontal flange 126 and a second horizontal flange 127, where each of the first horizontal flange 126 and the second horizontal flange 127 can extend from an interior side 129 of the cover 114. In one embodiment, the first horizontal flange 126 and the second horizontal flange 127 can be substantially parallel to one another. In the engaged position, each of the first horizontal flange 126 and the second horizontal flange 127 of the cover 114 can overlap and engage an interior side 130 of the step 112. As a result, the first horizontal flange 126 and a second horizontal flange 127 can guide the cover 114 into the engaged position and can help to support the cover 114. In one embodiment, the first horizontal flange 126 and the second horizontal flange 127 can help to prevent the cover 114 from being forced outwardly from the bathtub by, for example, water contained in the bathtub. The cover 114 can define a first aperture 134 and a second aperture 135, both of which can be used to secure the cover 114 to the step 112 and remove the cover 114 from the step 112. Any suitable number of apertures, handles, or the like, is contemplated.

Figure 6:
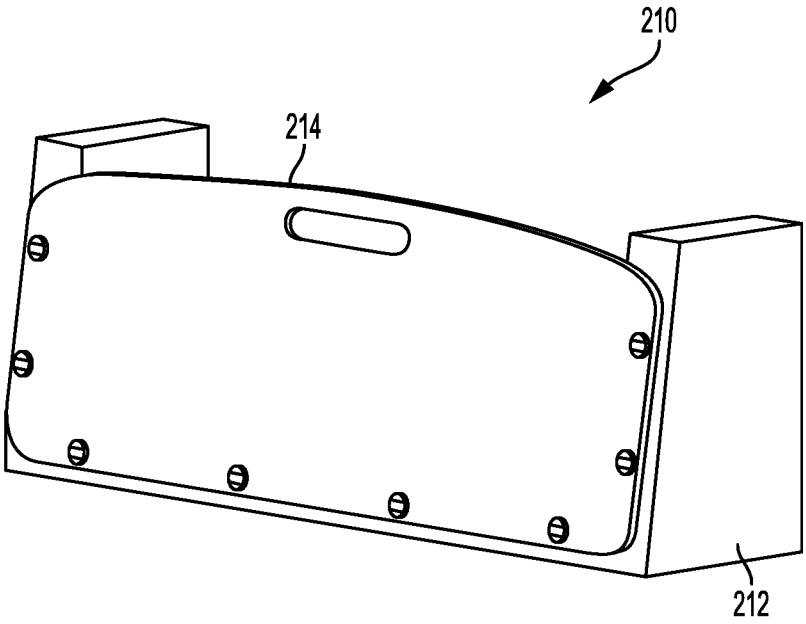
FIG. 6 is a perspective interior view of a bathtub overlay system, according to an alternate embodiment, where a cover is shown attached to a step with a plurality of fasteners.

FIGS. 6-9 depict an alternative embodiment of the bathtub overlay system 210. The bathtub overlay system 210 can include a step 212 and a cover 214. The cover 214 can be secured to the step 212 as shown in FIG. 6. In the engaged position, the step 212 and the cover 214 can combine to retain water within a bathtub as described herein. The cover 214 can be selectively detachable from the step 212 to allow improved access to and from the bathtub. The step 212 can include an elongated platform 216, a first side panel 218, and a second side panel 220, where the elongated platform 216 can extend between the first side panel 218 and the second side panel 220.

Figure 7:
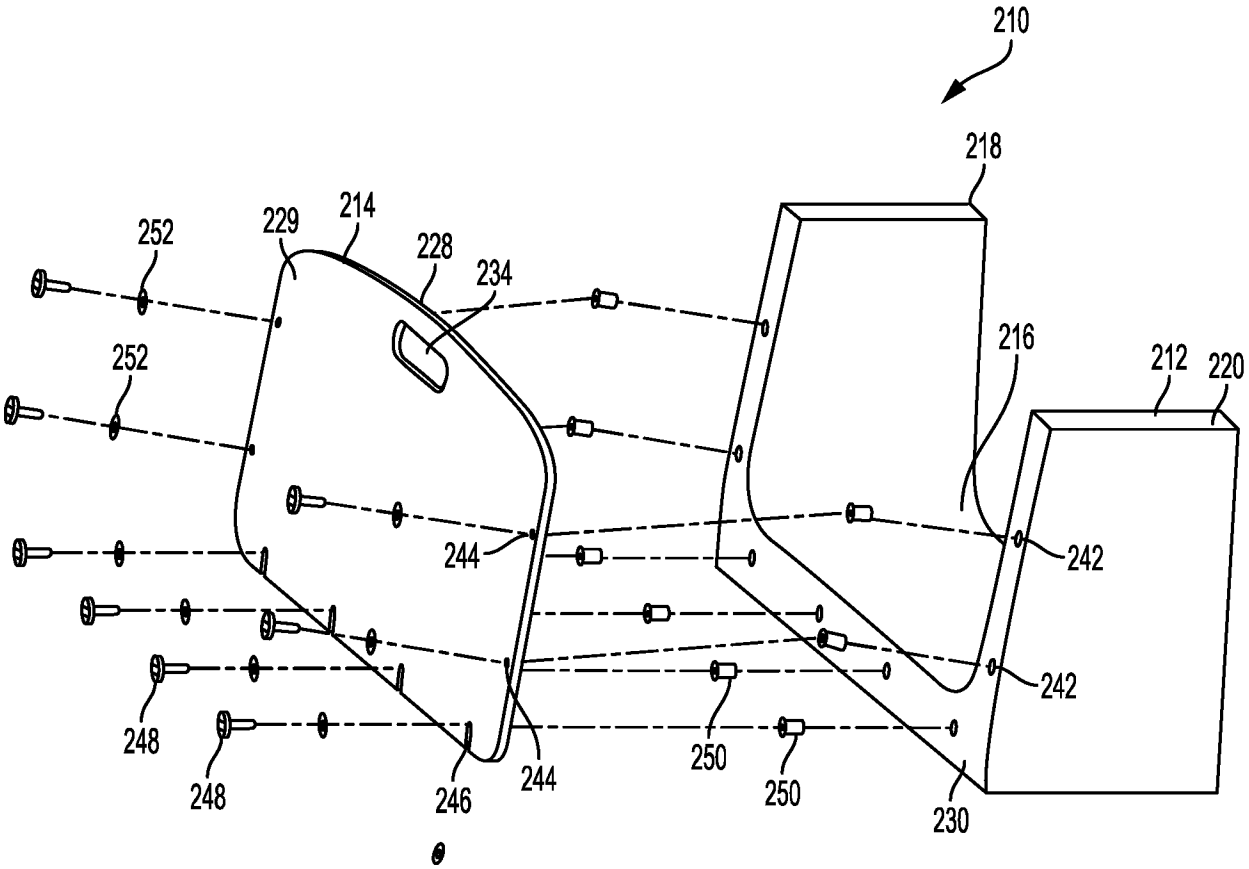
FIG. 7 is an exploded interior view of the bathtub overlay system of FIG. 6, shown with the cover detached from the step.
Figure 8:
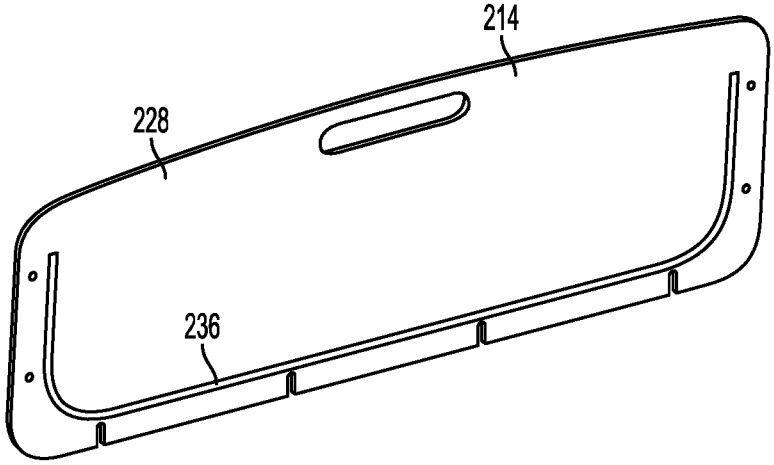
FIG. 8 is a perspective exterior view of the cover of FIG. 6, where the cover is shown with a seal, a plurality of openings, and a plurality of slots.
Figure 9:
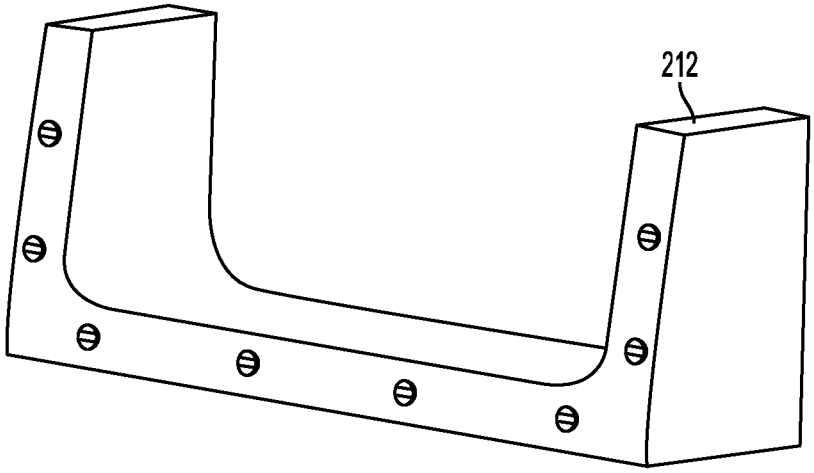
FIG. 9 is a perspective interior view of the step of FIG. 6, shown with the cover removed.

Referring to FIG. 7, an interior face 230 of the step 212 can define a plurality of apertures 242. As shown in FIGS. 7-8, the cover 214 can include a plurality of apertures 244 and a plurality of slots 246. In the engaged position, the plurality of apertures 244 and the plurality of slots 246 can be aligned with the plurality of apertures 242 on the interior face 230. Fasteners 248, such as screws having washers, can be used to secure the cover 212 to the step by engaging a plurality of anchors 250 positioned within the plurality of apertures 242. The bathtub overlay system 210 can have two modes, where a first mode can be semi-permanent such that fasteners are inserted into substantially all of the plurality of apertures 244 and the plurality of slots 246. In a second mode, which can be used for quick release, fasteners 248 can be inserted only into the plurality of slots 246 such that drawing the cover 214 upward disengages the plurality of slots 246 from the fasteners 248 and the cover 214 can be removed quickly and easily. Sliding the plurality of slots 246 back over the fasteners can reattach the cover 214 to the step 212. It will be appreciated that closures described herein can have a permanent, semi-permanent, or quick release mode.

The cover 214 can define an aperture 234, which can facilitate securing the cover 214 to the step 212, removing the cover 214 from the step 212, and carrying the cover 214 when disengaged from the step 212. The cover 214 can include a seal 236, which can help to retain water within the bathtub. As shown in FIG. 8, the seal 236 can be positioned on the exterior side 228 of the cover 214 such that the seal 236 can contact the interior side 230 of the step 212 with the cover 214 in the engaged position.

Figure 10:
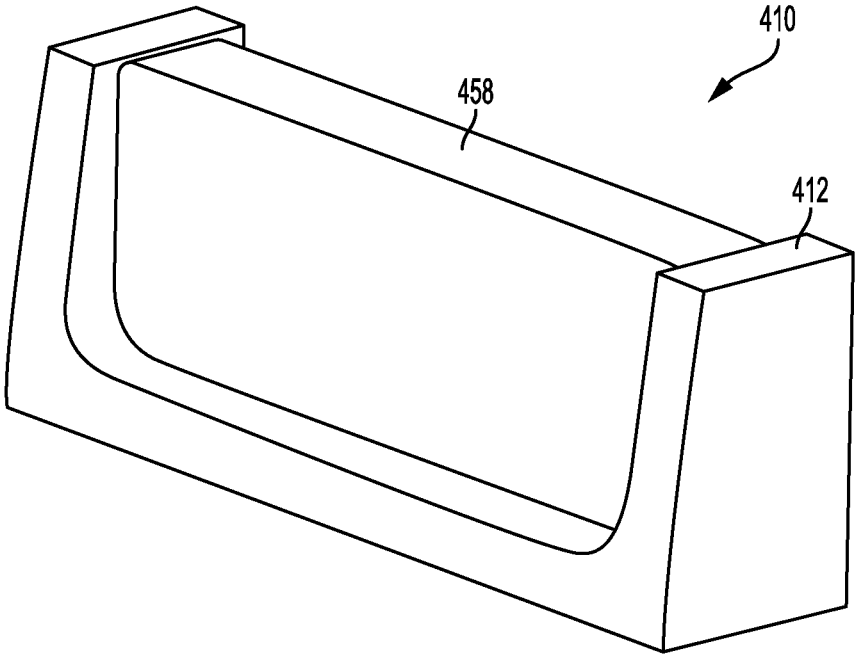
FIG. 10 is a perspective interior view of a bathtub overlay system, according to an alternate embodiment, having a step and a plug shown in an engaged position.
Figure 11:
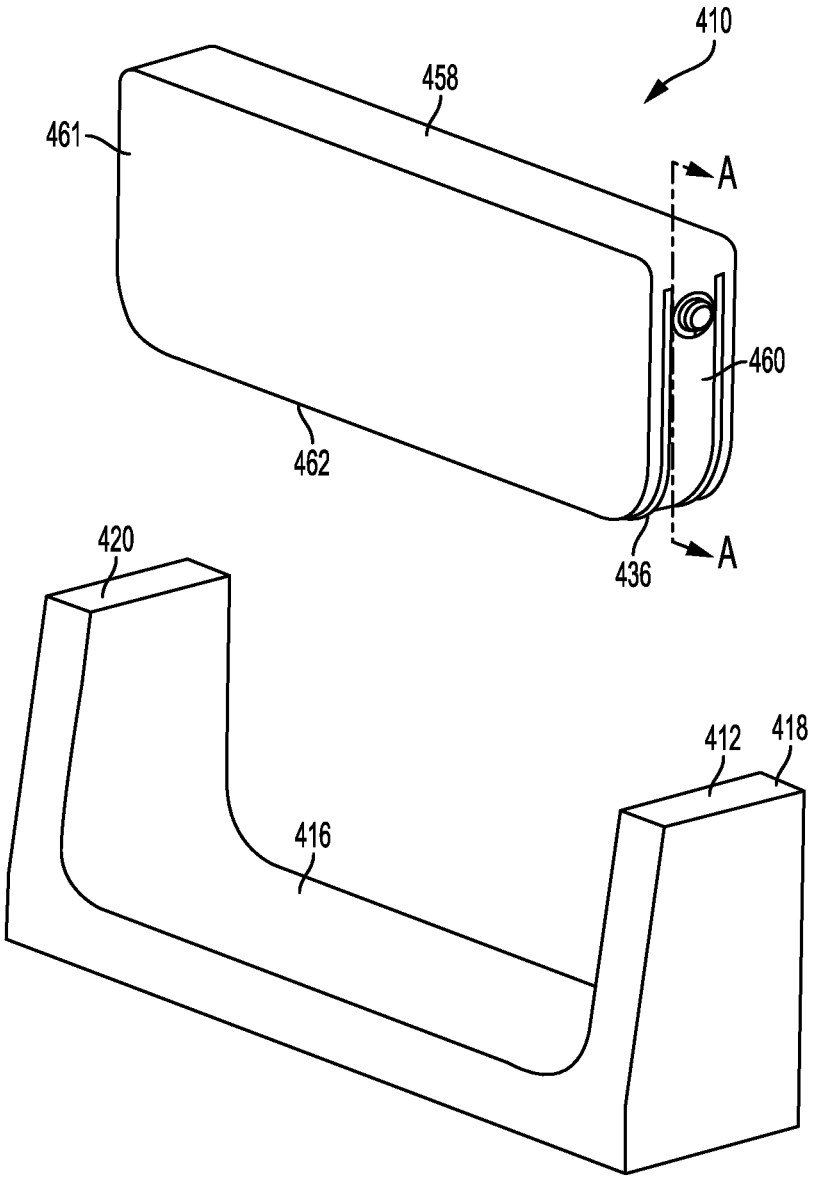
FIG. 11 is an exploded view of the bathtub overlay system of FIG. 10, shown with the plug detached from the step.
Figure 12:
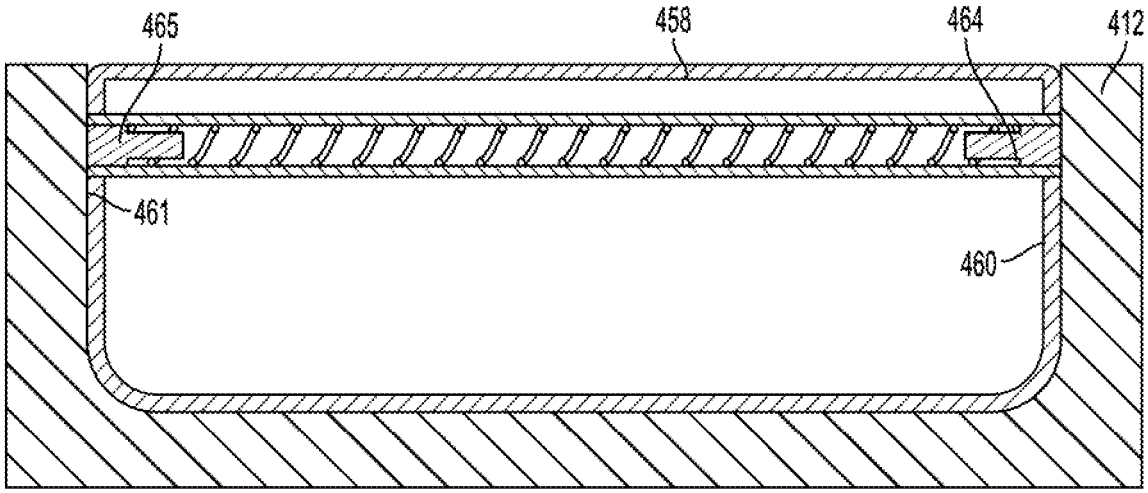
FIG. 12 is a cross-sectional view of the bathtub overlay system of FIG. 10, taken along reference plane A-A of FIG.

FIGS. 10-12 depict an alternative embodiment of the bathtub closure system 410. The bathtub closure system 410 can include a step 412, or substantially U-shaped aperture, and a closure or plug body 458. The plug body 458 can be positioned relative to the step 412 as shown in FIG. 10, for example. The step 412 and the plug 458 can cooperate to retain water within a bathtub. The plug body 458 can be selectively removable from the step 412 to allow improved access to and from the bathtub. It will be appreciated that any suitable size, shape, or configuration of plug is contemplated. The step 412 can include an elongated platform 416, a first side panel 418, and a second side panel 420, where the elongated platform 416 can extend between the first side panel 418 and the second side panel 420.

The plug body 458 can include a first side 460, a second side 461, and a bottom portion 462 (FIG. 11). The first side 460, the second side 461, and the bottom portion 462 can be configured to engage the first side panel 418, the second side panel 420, and the elongated platform 416, respectively, such that the plug body 458 can fit securely within the substantially U-shaped aperture defined by the step 412. As shown in FIG. 11, the plug body 458 can include a seal 436, which can be positioned on each of the first side 460, the second side 461, and/or the bottom portion 462 of the plug body 458. It will be appreciated that the bathtub, step, or the like, can define any size and shape of aperture into which one or more corresponding plugs or closures can be placed in accordance with embodiments described herein. The plug body or closure can substantially or partially fill the cavity defined by the step 412 or bathtub.

As shown in FIGS. 11-12, the plug body 458 can include a first lateral retention mechanism 464 and a second lateral retention mechanism 465 that can selectively secure the plug body 458 to the step 412. Each of the first lateral retention mechanism 464 and the second lateral retention mechanism 465 can define a channel that can house a cylinder biased outwardly from the plug 458 by a spring. When the plug 458 is positioned within the step 412, the outward bias of the first lateral retention mechanism 464 and second lateral retention mechanism 465 can secure the plug 458 within the step 412. In one embodiment, the first side panel 418 and the second side panel 420 of the step 412 can each include a recess (not shown) that can receive the cylinders of each of the first lateral retention mechanism 464 and the second lateral retention mechanism 465 to further secure the plug 458 to the step 412. It will be appreciated that the first lateral retention mechanism 464 and the second lateral retention mechanism 465 can include any suitable components or fastening elements.

FIGS. 13 and 14 depict an alternate embodiment of a bathtub overlay system 510. The bathtub overlay system 510 can include a step 512 and a plug 558 coupled with a cover 568. In an engaged position, the step 512, the plug 558, and the cover 568 can combine to retain water within a bathtub. The plug 558 can be selectively removable from the step 512 to allow improved access to and from the bathtub. The step 512 can include an elongated platform 516, a first side panel 518, and a second side panel 520, where the elongated platform 516 can extend between the first side panel 518 and the second side panel 520.

The plug 558 can include a first side 560, a second side 561, and a bottom portion 562 (FIG. 14). The first side 560, the second side 561, and the bottom portion 562 can engage the first side panel 518, the second side panel 520, and the elongated platform 516, respectively, such that the plug 558 can fit securely within the step 512. As shown in FIG. 14, the plug 558 can include a seal 536, which can be positioned on each of the first side 560, the second side 561, and/or the bottom portion 562 of the plug 558.

The bathtub overlay system 510 can include any suitable mechanism to secure the plug 558 to the step 512. As shown in FIG. 14, the inner cover 568 can be attached to the plug 558. The plug 558 can include a first retention mechanism 564 and a second retention mechanism 565, each of which can secure the plug 558 to the inner cover 568 at a first fitting 580 and a second fitting 582, respectively, with a pin or other fastener. In one embodiment, the inner cover 568 can pivot relative to the retention mechanisms 564, 565. In this manner, the inner cover 568 can be adjusted to accommodate a range of steps or bathtubs to create a watertight seal. The plug 558 can define a first cylindrical aperture 584 and a second cylindrical aperture 586 that can receive the first retention member 564 and the second retention member 565. A first threaded fastener 588 and a second threaded fastener 590 can threadedly engage the first retention member 564 and the second retention member 565, respectively, such that tightening the threaded fasteners draws or urges the inner cover 568 towards the plug 558. During use, the plug 558 can be inserted into the step 512 with the cover 568 loosely positioned interior of the step 512. A pair of lateral retention members 592, 594 can secure the plug 558 to the step 512. Once the plug 558 has been secured, the first threaded fastener 588 and the second threaded fastener 590 can be rotated or otherwise actuated to draw the inner cover 568 towards the plug 558 such that the inner cover and the step 512 form a watertight seal.

FIGS. 15 and 16 depict an alternate embodiment of a bathtub overlay system 610. The bathtub overlay system 610 can include a step 612 and a plug 658 coupled with a cover 668. In an engaged position, the step 612, the plug 658, and the cover 668 can combine to retain water within a bathtub. The plug 658 can be selectively removable from the step 612 to allow improved access to and from the bathtub. The step 612 can include an elongate platform 616, a first side panel 618, and a second side panel 620, where the elongate platform 616 can extend between the first side panel 618 and the second side panel 620. The step 612 can include an inner surface 630 and an exterior surface 631.

The plug 658 can include a first side 660, a second side 661, and a bottom portion 662. The plug can include an interior surface 670 and an exterior surface 671. The first side 660, the second side 661, and the bottom portion 662 can engage the first side panel 618, the second side panel 620, and the elongated platform 616, respectively, such that the plug 658 can fit securely within, or partially within, the step 612. The bathtub overlay system 610 can include any suitable mechanism to secure the plug 658 to the step 612. As shown in FIG. 16, the inner cover 668 can be attached to the plug 658. The plug 658 can include retention mechanisms 664, 665 that can secure the plug 658 to the inner cover 668 with fittings 680, 682, respectively. In one embodiment, the inner cover 668 can pivot relative to the retention mechanisms 664, 665. In this manner, the inner cover 668 can be adjusted to accommodate a range of steps or bathtubs to create a watertight seal. The plug 658 can define cylindrical apertures 684, 686 that can receive the retention members 664, 665. Threaded fasteners 688, 690 can threadedly engage the retention members 664, 665, respectively, such that tightening the threaded fasteners draws the inner cover 668 towards the plug 558. During use, the plug 658 can be inserted into the step 612 with the cover 668 loosely positioned interior of the step 612. In one embodiment, the exterior surface 671 of the plug 658 can be substantially coplanar with the exterior surface 631 of the step 612 such that a smooth or flush finish is achieved. The threaded fasteners 688, 690 can include flanges 692, 694 that can partially engage the exterior surface 671 of the plug 658 and the exterior surface 671 of the step 612. After the plug 658 has been positioned as shown in FIG. 15, the threaded fasteners 688, 690 can be rotated or otherwise actuated to draw the inner cover 668 towards the plug 658 such that the inner cover and the step 612 form a watertight seal. In the illustrated embodiment, the step 612 can be tensioned between the inner cover 668 and the threaded fasteners 688, 690 such that an effective seal can be established and the plug 658 can be securely attached to the step 612.

FIGS. 17-19B depict an alternate embodiment of a bathtub overlay system 710. The bathtub overlay system 710 can include a step 712 and a plug 758 coupled with a cover 768. In an engaged position, the step 712, the plug 758, and the cover 768 can combine to retain water within a bathtub. The plug 758 can be selectively removable from the step 712 to allow improved access to and from the bathtub. The step 712 can include an elongate platform 716, a first side panel 718, and a second side panel 720, where the elongate platform 716 can extend between the first side panel 718 and the second side panel 720. The step 712 can include an inner surface 730 and an exterior surface 731.

The plug 758 can include a first side 760, a second side 761, and a bottom portion 762. The plug can include an interior surface 770 and an exterior surface 771. The first side 760, the second side 761, and the bottom portion 762 can engage the first side panel 718, the second side panel 720, and the elongated platform 716, respectively, such that the plug 758 can fit securely within the step 712. The bathtub overlay system 710 can include any suitable mechanism to secure the plug 758 to the step 712. As shown in FIG. 18, the inner cover 768 can be attached to the plug 758. The plug 758 can include retention mechanisms 764, 765 that can secure the plug 758 to the inner cover 768 with fittings 780, 782, respectively. In one embodiment, the inner cover 768 can pivot relative to the retention mechanisms 764, 765. In this manner, the inner cover 768 can be adjusted to accommodate a range of steps or bathtubs to create a watertight seal. The plug 758 can define cylindrical apertures 784, 786 that can receive the retention members 764, 765. Threaded fasteners 788, 790 can threadedly engage the retention members 764, 765, respectively, such that tightening the threaded fasteners draws the inner cover 668 towards the plug 758. During use, the plug 758 can be inserted into the step 712 with the cover 768 loosely positioned interior of the step 712. The exterior surface 771 of the plug 758 can include flared edges 776, 777 as shown in FIGS. 19A and 19B. The flared edges 776, 777 can engage the step 712 and function as stops that can prevent the plug 758 from being drawn into the inward.

After the plug 758 has been positioned as shown in FIGS. 19A and 19B, the threaded fasteners 788, 790 can be rotated or otherwise actuated to draw the inner cover 768 towards the plug 758 such that the inner cover 768 and the step 712 form a substantially watertight seal. In the illustrated embodiment, the step 712 can be tensioned between the inner cover 768 and the flared edges 776, 777 of the plug 768 such that an effective seal can be created with a wide range of steps or bathtubs. It will be appreciated that the flared edges 776, 777 can have any suitable angle, shape, or configuration in accordance with embodiments described herein. Any suitable projection is contemplated that can engage the exterior surface of the step.

Referring to FIGS. 20 and 21, an alternative embodiment of a bathtub overlay system 810 can include a step 812 and a cover 868. The cover 868 can be secured to the step 812 as shown in FIG. 20. In the engaged position, the step 812 and the cover 868 can combine to retain water within a bathtub. The step 812 can include an elongate platform 816, a first side panel 818, and a second side panel 820, where the elongate platform 816 can extend between the first side panel 818 and the second side panel 820. The step 812 can include an inner surface 830 and an exterior surface 831.

The cover 868 can include a first hinged clamp 832, a second hinged clamp 834, and base hinged clamp 836, where each of the first hinged clamp 832, the second hinged clamp 834, and the base hinged clamp 836 can be pivotally coupled to an exterior side 872 of the cover 868. In the engaged position, the exterior side 872 of the cover can overlap and engage the interior surface 830 of the step 812. Each of the first hinged clamp 832, the second hinged clamp 834, and the base hinged clamp 836 can pivot relative to the cover 868 to engage the exterior surface 831 of the step 812. In one embodiment, one or more of the first hinged clamp 832, the second hinged clamp 834, and the base hinged clamp 836 can be adjustable to accommodate various sizes or features of the step 812. The cover 868 can include a seal 840 (FIG. 21), which can help to retain water within the bathtub. The seal 840 can be positioned on the exterior surface 872 of the cover 868 such that the seal 840 can contact the interior surface 830 of the step 812 with the cover 868 in the engaged position. In an alternative embodiment, the seal 840 can be positioned directly on the interior surface 830 of the step 812.

It will be appreciated that any suitable number of clamps having any suitable shape, size, and configuration are contemplated. For example, the clamps can be substantially J-shaped as shown in FIGS. 20 and 21. The clamps can be adjustable or telescoping such that the clamp can tension the cover against the step to create a substantially watertight seal. The clamps can have any suitable range of motion, can have a limited range of motion, and can lock into place upon engagement with the step such that a release (not shown) can be pressed to move the clamps, in one embodiment. The clamps can include a cam mechanism that can allow the clamps to be adjusted until the desired tension with the step is achieved. In one embodiment, when the cover is not in use, the clamps can be pivoted inward such that they have a low profile for easy storage. The clamps can be sized for specific steps or bathtubs or, in an alternate embodiment, can be configured for use with a plurality of different tubs or steps as a universal closure.

FIGS. 22 and 23 depict an alternate embodiment of a bathtub overlay system 910. The bathtub overlay system 910 can include a step 912 and a plug 958 coupled with a cover 968. In an engaged position, the step 912, the plug 958, and the cover 968 can combine to retain water within a bathtub. The plug 958 can be selectively removable from the step 912 to allow improved access to and from the bathtub. The step 912 can include an elongate platform 916, a first side panel 918, and a second side panel 920, where the elongate platform 916 can extend between the first side panel 918 and the second side panel 920. The step 912 can include an inner surface 930 and an exterior surface 931.

The plug 958 can include a first side 960, a second side 961, and a bottom portion 962. The plug can include an interior surface 970 and an exterior surface 971. The first side 960, the second side 961, and the bottom portion 962 can engage the first side panel 918, the second side panel 920, and the elongated platform 916, respectively, such that the plug 958 can fit securely within the step 912. The bathtub overlay system 910 can include any suitable mechanism to secure the plug 958 to the step 912. As shown in FIG. 23, the inner cover 968 can be attached to the plug 958. The plug 958 can include retention mechanisms 964, 965 that can secure the plug 958 to the inner cover 968 with fittings 980, 982, respectively. In one embodiment, the inner cover 968 can pivot relative to the retention mechanisms 964, 965. In this manner, the inner cover 968 can be adjusted to accommodate a range of steps or bathtubs to create a watertight seal. The plug 958 can define cylindrical apertures 982, 983 that can receive the retention members 964, 965. Threaded fasteners 986, 987 can threadedly engage the retention members 964, 965, respectively, such that tightening the threaded fasteners draws the inner cover 968 towards the plug 958.

During use, the plug 958 can be inserted into the step 912 with the cover 968 loosely positioned interior of the step 912. The step 912 can define cavities 978, 979, and the plug 958 can include corresponding projections 981, 985. The cavities 978, 979 can be configured to receive the projections 981, 985 of the plug 958 such that, in the engaged position, the plug 958 can be interlocked with the step 912. As a result, the cavities 978, 979 and projections 981, 985 can cooperate to prevent the plug 958 from being inwardly or outwardly displaced from the step 912. The attachment recesses or cavities 978, 978 can be channels, grooves, keyed slots, or the like and can have a stop or abutment that engages the bottom of the projections to prevent further movement. The projections or attachment members can have any suitable shape, number, or profile such as a semi-circle, block, tapered flange, or the like.

The plug 958 can include a handle (not shown) that can facilitate vertical displacement of the plug 958 for removal from the step 912. A suitable shape, size, or configuration of handle is contemplated such as two offset and inset handles positioned substantially perpendicular to the plug 958. After the plug 958 has been positioned as shown in FIG. 22, the threaded fasteners 986, 987 can be rotated or otherwise actuated to draw the inner cover 968 towards the plug 958 such that the inner cover 968 and the step 912 form a substantially watertight seal.

FIG. 24 depicts an alternative embodiment of a bathtub overlay system 1010. The bathtub overlay system 1010 can include a bathtub 1012 and a corresponding plug 1058. The plug 1058 can selectively cooperate with the bathtub 1012 to prevent water from leaking during a traditional show or bath. It will be appreciated that the tub 1012 can be independently molded or otherwise created separately from the plug 1058. The tub 1012 can include a substantially U-shaped cavity 1013 that can include an elongated platform 1016, a first side panel 1018, and a second side panel 1020, where the elongated platform 1016 can extend between the first side panel 1018 and the second side panel 1020. Each of the first side panel 1018 and the second side panel 1020 can be integral or of a unitary construction with a portion of the tub 1012 (e.g., a bathtub wall). In an engaged position, the U-shaped cavity 1013, the plug 1058, and the cover 1068 can combine to retain water within a bathtub. The plug 1058 can be selectively removable from the U-shaped cavity 1013 to allow improved access to and from the bathtub 1012. The bathtub 1012 can include an inner surface 1030 and an exterior surface 1031.

The plug 1058 can include a first side 1060, a second side 1061, and a bottom portion 1062. The plug 1058 can include an interior surface 1070 and an exterior surface 1071. The first side 1060, the second side 1061, and the bottom portion 1062 can engage the first side panel 1018, the second side panel 1020, and the elongated platform 1016, respectively, such that the plug 1058 can fit securely within the step 1012. The bathtub overlay system 1010 can include any suitable mechanism to secure the plug 1058 to the bathtub 1012. As shown in FIG. 24, the inner cover 1068 can be attached to the plug 1058. The plug 1058 can include retention mechanisms 1064, 1065 that can secure the plug 1058 to the inner cover 1068 with fittings 1080, 1082, respectively. In one embodiment, the inner cover 1068 can pivot relative to the retention mechanisms 1064, 1065. In this manner, the inner cover 1068 can be adjusted to accommodate a range of steps or bathtubs to create a watertight seal. The plug 1058 can define cylindrical apertures 1082, 1083 that can receive the retention members 1064, 1065. Threaded fasteners 1074 can threadedly engage the retention members 1064, 1065 such that tightening the threaded fasteners 1074 urges or draws the inner cover 1068 towards the plug 1058.

During use, the plug 1058 can be inserted into the bathtub 1012 with the cover 1068 loosely positioned interior of the bathtub 1012. The bathtub 1012 can define cavities 1078, 1079, and the plug 1058 can include corresponding projections 1081, 985. The cavities 1078, 1079 can be configured to receive the projections 1081, 1085 of the plug 1058 such that, in the engaged position, the plug 1058 can be interlocked with the bathtub 1012. As a result, the cavities 1078, 1079 and projections 1081, 1085 can cooperate to prevent the plug 1058 from being inwardly or outwardly displaced from the step 1012. The plug 1058 can include a handle (not shown) that can facilitate vertical displacement of the plug 1058 for removal from the bathtub 1012. After the plug 1058 has been positioned in the U-shaped cavity 1013 of the bathtub 1013, the threaded fasteners 1074 can be rotated or otherwise actuated to draw the inner cover 1068 towards the plug 1058 such that the inner cover 1068 and the bathtub 1012 form a watertight seal.

Any suitable bathtub, such as a molded tub with a substantially U-shaped cavity, can include a cover, overlay, or plug. For example, a cavity, U-shaped cavity, or step through can be formed when a bathtub is molded or otherwise constructed. For example, the tub 1012 illustrated in FIG. 24 can be molded as illustrated, where any suitable corresponding overlay, such as plug 1058, can be provided separately. It will be appreciated that tubs can be created, molded, or otherwise formed during manufacture to accept any suitable cover, plug, or overlay, such as the embodiments described herein. In one version, a U-shaped cavity in a molded or manufactured tub can include apertures into which lateral projections can extend to secure a plug to the tub. Tubs can be configured with any suitable features, such as attachment features, that can allow one or a plurality of different overlays or inserts to be provided. It will be appreciated that a tub can be molded or otherwise formed that can accept a number of different types of covers, overlays, or plugs, where such a universal tub may allow maximum flexibility for the association of different components or features. In an example embodiment, the overlay or plug can be inserted such that the plug or overlay fills a pre-formed U-shaped cavity and looks substantially like a standard bathtub wall.

FIG. 25 illustrates one version of a bathtub closure system 1110 that can include a bathtub 1113 and a substantially U-shaped step 1112 that can be associated with a door 1114. The step 1112 can be formed with the bathtub, retrofit onto the bathtub, associated with the bathtub during manufacturing, or otherwise coupled or formed with the bathtub. The step 1112 can include an elongate platform 1116, a first side panel 1118, and a second side panel 1120, where the elongate platform 1116 can extend between the first side panel 1118 and the second side panel 1120. The step 1112 can include an inner surface 1130 and an exterior surface 1131. The elongate platform 1116 can have any suitable depth relative to the bathtub 1113 where, for example, the top surface of the elongate platform 1116 can be from about 6 inches to about 8 inches above the bottom surface of the bathtub 1113. Providing a higher threshold may help prevent water from spilling out of the bathtub 1113 during use.

FIG. 26 illustrates one version of a bathtub closure system 1210 that can include a bathtub 1113 and a substantially U-shaped step 1212 that can be associated with a door 1214. The step 1212 can be formed with the bathtub, retrofit onto the bathtub, associated with the bathtub during manufacturing, or otherwise coupled or formed with the bathtub. The step 1212 can include an elongate platform 1216, a first side panel 1218, and a second side panel 1220, where the elongate platform 1216 can extend between the first side panel 1218 and the second side panel 1220. The step 1212 can include an inner surface 1230 and an exterior surface 1231. The elongate platform 1216 can have any suitable depth relative to the bathtub 1213 where, for example, the top surface of the elongate platform 1116 can be from about 2 inches to about 4 inches above the bottom surface of the bathtub 1213. Providing a lower threshold, such as for example lower relative to the embodiment shown in FIG. 25, may help improve the ease of ingress and egress from the bathtub 1213.

FIG. 27 illustrates one version of a bathtub closure system 1310 that can include a bathtub 1313 and a substantially U-shaped step 1312 that can be associated with a door 1314. The step 1312 can be formed with the bathtub, retrofit onto the bathtub, associated with the bathtub during manufacturing, or otherwise coupled or formed with the bathtub. The step 1312 can include an elongate platform 1316, a first side panel 1318, and a second side panel 1320, where the elongate platform 1316 can extend between the first side panel 1318 and the second side panel 1320. The step 1312 can include an inner surface 1330 and an exterior surface 1331. In the illustrated embodiment, the bathtub 1313 can have an exterior surface 1330 that is substantially flush or coplanar with the exterior surface 1331 of the step 1312. The step 1312 can be flush or substantially flush with one or a plurality of the walls or surfaces of the bathtub 1313. It will be appreciated that the step 1312 or threshold can be partially or entirely co-molded or otherwise formed with the bathtub 1313 such that one or more of the components are a unitary structure. Providing a substantially flush exterior surface may improve the aesthetics of the bathtub 1313 and may also reduce potentially hazardous surfaces, projections, and the like that could contribute to a fall or injury. The step 1312 can be manufactured for a specific bathtub from a specific manufacturer such that the step matches the bathtub in shape, color, texture, gloss, or the like.

FIG. 28 illustrates one version of a bathtub closure system 1410 that can include a bathtub 1413 and a substantially U-shaped step 1412 that can be associated with a door 1414. The step 1412 can be formed with the bathtub, retrofit onto the bathtub, associated with the bathtub during manufacturing, or otherwise coupled or formed with the bathtub. The step 1412 can include an elongate platform 1416, a first side panel 1418, and a second side panel 1420, where the elongate platform 1416 can extend between the first side panel 1418 and the second side panel 1420. The step 1412 can include an inner surface 1430 and an exterior surface 1431. The elongate platform 1416 can have any suitable depth relative to the bathtub 1413 where, for example, the top surface of the elongate platform 1416 can be from about 0 inches to about 1 inch above the bottom surface of the bathtub 1213. Providing a lower threshold, such as for example lower relative to the embodiment shown in FIG. 26, may further help improve the ease of ingress and egress from the bathtub 1213. In one embodiment, the top surface of the elongate platform 1416 can be substantially planar with the bottom surface of the bathtub 1413. As illustrated in FIG. 29, the step can extend to substantially the floor of the bathroom in one embodiment. As illustrated in FIG. 30, the interior surface of the step can have any suitable configuration such as a bevel that substantially matches the shape and contour of the bathtub floor. Such a configuration may reduce the likelihood of trips or falls during use. In an alternate embodiment, the step can include a ramp or the like leading into the step or bathtub. Similarly, the step can include a ramp or the like on the interior of the bathtub or step.

FIG. 31 depicts an alternate embodiment of a bathtub closure system 1510. The bathtub closure system 1510 can include a bathtub 1513, a step 1512, or substantially U-shaped aperture, and a closure or plug 1558. The plug 1558 can be positioned relative to the step 1512 as shown in FIG. 29, for example. The step 1512 and the plug 1558 can cooperate to retain water within the bathtub 1513. The plug 1558 can be selectively removable from the step 1512 to allow improved access to and from the bathtub 1513. It will be appreciated that any suitable size, shape, or configuration of plug 1558 is contemplated. The step 1512 can include an elongated platform 1516, a first side panel 1518, and a second side panel 1520, where the elongated platform 1516 can extend between the first side panel 1518 and the second side panel 1520.

The plug 1558 can include a first side 1560, a second side 1561, and a bottom portion 1562. The first side 1560, the second side 1561, and the bottom portion 1562 can be configured to engage the first side panel 1518, the second side panel 1520, and the elongated platform 1516, respectively, such that the plug 1558 can fit securely within the substantially U-shaped aperture defined by the step 1512. The plug 1558 can include one or a plurality of seals 1536 (FIG. 35), which can be positioned on each of the first side 1560, the second side 1561, and/or the bottom portion 1562 of the plug 1558. It will be appreciated that the bathtub, step, or the like, can define any size and shape of aperture into which one or more corresponding plugs or closures can be placed in accordance with embodiments described herein.

As shown in FIG. 35, the plug 1558 can include lateral projections 1590, 1592 that can selectively engage cavities 1592, 1593 defined by the step 1512. The step 1512 can further define threaded apertures 1588, 1589. As shown, the lateral projections 1590, 1591 and cavities 1592, 1593 can have corresponding semi-circular shapes, however any suitable shape is contemplated. The lateral projections 1590, 1591 can define channels 1594, 1595 that can accept fasteners 1596, 1597 having threaded posts 1598, 1599. In the illustrated embodiment, the channels 1594, 1595 are substantially coaxial with the threaded apertures 1588, 1589 when the lateral projections 1590, 1592 are inserted into the cavities 1592, 1593. During use, the plug 1558 can be placed into the U-shaped cavity defined by the step 1512 such that the lateral projections 1590 are seated in the cavities 1592, 1593. The fasteners 1596, 1597 can be used to couple the plug 1558 to the step 1512 by screwing the threaded posts 1598, 1599 through the channels 1594, 1595 into the threaded apertures 1588, 1589. The fasteners 1596, 1597 can be used to compress the plug 1558 against the step 1512 until a substantially watertight seal is created. When the plug 1558 is no longer needed the fasteners 1596, 1597 can be unscrewed and the plug 1558 can be vertically removed from the step 1512. An inset handle 1560 positioned on the plug 1558 can facilitate removal from the bathtub 1513.

FIGS. 32A-32C depict an alternate embodiment of a modular bathtub closure system 1610. The modular bathtub closure system 1610 can include a step 1612, a closure or plug 1658, and/or a door 1668. The plug 1658 can be positioned relative to the step 1612 as shown in FIG. 32B, for example, or the door 1668 can be used as shown in FIG. 32C. The step 1612, the plug 1658, and/or the door 1668 can cooperate to retain water within a bathtub. The plug 1658 can be selectively removable from the step 1612 to allow improved access to and from the bathtub 1613 as shown in FIG. 33. It will be appreciated that any suitable size, shape, or configuration of plug 1658 is contemplated. The step 1612 can include an elongated platform 1616, a first side panel 1618, and a second side panel 1620, where the elongated platform 1616 can extend between the first side panel 1618 and the second side panel 1620.

The plug 1658 can include a first side 1660, a second side 1661, and a bottom portion 1662. The first side 1660, the second side 1661, and the bottom portion 1662 can be configured to engage the first side panel 1618, the second side panel 1620, and the elongated platform 1616, respectively, such that the plug 1658 can fit securely within the substantially U-shaped aperture defined by the step 1612. The plug 1658 can include one or a plurality of seals, which can be positioned on each of the first side 1660, the second side 1661, and/or the bottom portion 1662 of the plug 1658. It will be appreciated that the bathtub, step, or the like, can define any size and shape of aperture into which one or more corresponding plugs, doors, or closures can be placed in accordance with embodiments described herein.

As shown in FIG. 32B, the plug 1658 can include lateral projections 1690, 1691 that can selectively engage recesses or cavities 1692, 1693 defined by the step 1612. During use, the plug 1658 can be placed into the U-shaped cavity defined by the step 1612 such that the lateral projections 1690, 1691 are seated in the cavities 1692, 1693. Fasteners (such as those shown in FIG. 35) can be used to couple the plug 1658 to the step 1612. The fasteners can compress the plug 1658 against the step 1612 until a substantially watertight seal is created. An inset handle 1640 positioned on the plug 1658 can facilitate removal from the bathtub 1613. As shown in FIGS. 32A and 33, when the modular bathtub closure system 1610 is not being used with a plug, door, or other accessory, a pair of blanks 1642, cover, or fillers can be inserted into the cavities 1692, 1693. As shown in FIGS. 32C and 36, the door 1668 can also include lateral projections 1690, 1691 that can correspond to cavities 1692, 1693. As illustrated, a plurality of different closure accessories can include projections that can correspond to cavities, keyed slots, channels, or the like in the step or bathtub such that a variety of interchangeable accessories can be used with a single step or bathtub. Any suitable fasteners, such as threaded fasteners, levers, or the like, can be used to couple, compress, or otherwise engage the plug with the corresponding step or bathtub. It will be appreciated, in an alternate embodiment, that a step can include one or a plurality of projections that can engage with a cavity defined by a plug or other accessory in a modular system. It will be appreciated that a universal system in accordance with embodiments described herein can be achieved with a wide range of features and configurations to achieve the intended purpose of using multiple accessories with single step or bathtub.

FIG. 37 illustrates one version of a step 1712, where the step 1712 can be associated with the attachment of one or a plurality of accessories 1753 that can be associated with a bathtub. For example, accessory attachment points 1752 can be installed via a cavity created by making a U-shaped cutout 1750 in a bathtub 1713. In an alternate embodiment, the accessory attachment points 1752 can be installed during manufacture of the bathtub 1713 or can otherwise be attached to the bathtub 1713, such as with an adhesive or external coupling. The accessory attachment points 1752 can be supported by supports (not shown) positioned within the bathtub 1713 such that the accessories can be load bearing. The accessory attachment points 1752 can include one or a plurality of universal connectors that can be associated with caps or closures when not in use. The universal connectors can be used to attach to a plurality of systems, such as the seat 1754 shown in FIG. 38, and can be closed or covered when not in use. A bathtub system 1710 can include one or a plurality of accessory attachment points 1752, which can be placed at any suitable location, such that a user can have maximum flexibility in designing their bath experience. In this manner, a single tub can accommodate a broad range of attachment options and designs. The accessory attachment points 1752 can be uniform, can be universal, or can be specific to certain types of accessories. In one embodiment, users can custom design the position of the accessory attachment points, such as online, to create their ideal bathtub. In one embodiment, the accessory attachment points 1752 can be retrofit into an existing bathtub. FIG. 39 illustrates the bathtub 1713 having a seat 1755 according to one embodiment.

FIG. 40 depicts an alternate embodiment of a bathtub closure system 1810. The bathtub closure system 1810 can include a bathtub (not shown), a step 1812, or substantially U-shaped aperture, and a closure or plug 1858. The plug 1858 can be positioned relative to the step 1812 as shown in FIG. 40, for example. The step 1812 and the plug 1858 can cooperate to retain water within the bathtub. The plug 1858 can be selectively removable from the step 1812 to allow improved access to and from the bathtub. It will be appreciated that any suitable size, shape, or configuration of plug 1858 is contemplated. The step 1812 can include an elongated platform 1816, a first side panel 1818, and a second side panel 1820, where the elongated platform 1816 can extend between the first side panel 1818 and the second side panel 1820.

The plug 1858 can include a first side 1860, a second side 1861, and a bottom portion 1862. The first side 1860, the second side 1861, and the bottom portion 1862 can be configured to engage the first side panel 1818, the second side panel 1820, and the elongated platform 1816, respectively, such that the plug 1858 can fit securely within the substantially U-shaped aperture defined by the step 1812. The plug 1858 can include one or a plurality of seals 1836 (FIG. 41), which can be positioned on each of the first side 1860, the second side 1861, and/or the bottom portion 1862 of the plug 1858. It will be appreciated that the bathtub, step, or the like, can define any size and shape of aperture into which one or more corresponding plugs or closures can be placed in accordance with embodiments described herein. It will be appreciated that a bathtub can be molded with or can otherwise include a cutout or cavity such that the step is not needed for use with the plugs, doors, and closures described herein. In such examples the bathtub can include all of the features described herein with respect to the step.

As shown in FIG. 41, the plug 1858 can include hinged levers 1890, 1891 that can selectively engage cavities 1892, 1893 defined by the step 1812. The hinged levers 1890, 1891 can be affixed to and pivotable relative to the plug 1858. As shown, the hinged levers 1890, 1891 and cavities 1892, 1893 can have corresponding shapes such that in the closed position, as shown in FIG. 40, the plug 1858 is secured to the step 1812. As shown in FIG. 41, in the open position the hinged levers 1890, 1891 can be pivoted such that they are no longer engaged with the step 1812. During use, the plug 1858 can be placed into the U-shaped cavity defined by the step 1812 and the hinged levers 1890, 1891 can be pivoted and seated in the cavities 1892, 1893. The hinged levers 1890, 1891 can be used to compress the plug 1858 against the step 1812 until a substantially watertight seal is created. When the plug 1858 is no longer needed the hinged levers 1890,1891 can be pivoted to disengage from the cavities 1892, 1893 and the plug 1858 can be vertically removed from the step 1812. An inset handle 1840 positioned on the plug 1858 can facilitate removal from the bathtub 1813. The hinged levers 1890, 1891 can be housed substantially within recesses defined by the plug 1858 in the closed position, as shown in FIG. 40, such that they have no profile or a low profile. The recesses can be sized such that a user can reach in and actuate the hinged levers 1890, 1891 to the open position. Other release or attachment mechanisms, such as spring loaded levers, ADA compliant actuators, or the like, are contemplated. In one embodiment, the same plug body can be used with a variety of different levers, attachment projections, or the like such that a user can select the most advantageous system for their specific needs. For example, a user with a particular disability can select attachment and removal features that best accommodate their disability.

FIGS. 42A and 42B depict an alternate embodiment of a bathtub closure system 1910. The bathtub closure system 1910 can include a bathtub (not shown), a step 1912, or substantially U-shaped aperture, and a closure or plug 1958. The plug 1958 can be positioned relative to the step 1912 as shown in FIG. 42A, for example. The step 1912 and the plug 1958 can cooperate to retain water within the bathtub. The plug 1858 can be selectively removable from the step 1912 to allow improved access to and from the bathtub. It will be appreciated that any suitable size, shape, or configuration of plug 1958 is contemplated. The step 1912 can include an elongated platform 1916, a first side panel 1918, and a second side panel 1920, where the elongated platform 1916 can extend between the first side panel 1918 and the second side panel 1920.

The plug 1958 can include a first side 1960, a second side 1961, and a bottom portion 1962. The first side 1960, the second side 1961, and the bottom portion 1962 can be configured to engage the first side panel 1918, the second side panel 1920, and the elongated platform 1916, respectively, such that the plug 1958 can fit securely within the substantially U-shaped aperture defined by the step 1912. The plug 1958 can include one or a plurality of seals 1936 (FIG. 41), which can be positioned on each of the first side 1960, the second side 1961, and/or the bottom portion 1962 of the plug 1958. It will be appreciated that the bathtub, step, or the like, can define any size and shape of aperture into which one or more corresponding plugs or closures can be placed in accordance with embodiments described herein. It will be appreciated that a bathtub can be molded with or can otherwise include a cutout or cavity such that the step is not needed for use with the plugs, doors, and closures described herein. In such examples the bathtub can include all of the features described herein with respect to the step.

As shown in FIG. 42A, the plug 1958 can include compression levers 1990, 1991 that can selectively engage cavities 1992, 1993 defined by the step 1912. Compression lever 1991 is shown in more detail in FIG. 42B. During use, the plug 1958 can be placed into the U-shaped cavity defined by the step 1912 and the compression levers 1990, 1991 can engage the cavities 1992, 1993. The compression levers 1990, 1991 can be used to compress the plug 1958 against the step 1912 until a substantially watertight seal is created. When the plug 1958 is no longer needed the compression levers 1990,1991 can disengage from the cavities 1992, 1993 and the plug 1958 can be vertically removed from the step 1912.

FIGS. 43 and 44 depict an alternate embodiment of a bathtub closure system 2010. The bathtub closure system 2010 can include a bathtub (not shown), a step 2012, or substantially U-shaped aperture, and a closure or plug 2058. The plug 2058 can be positioned relative to the step 2012 as shown in FIG. 43, for example. The step 2012 and the plug 2058 can cooperate to retain water within the bathtub. The plug 2058 can be selectively removable from the step 2012 to allow improved access to and from the bathtub. It will be appreciated that any suitable size, shape, or configuration of plug 2058 is contemplated. The step 2012 can include an elongated platform 2016, a first side panel 2018, and a second side panel 2020, where the elongated platform 2016 can extend between the first side panel 2018 and the second side panel 2020.

The plug 2058 can include a first side 2060, a second side 2061, and a bottom portion 2062. The first side 2060, the second side 2061, and the bottom portion 2062 can be configured to engage the first side panel 2018, the second side panel 2020, and the elongated platform 2016, respectively, such that the plug 2058 can fit securely within the substantially U-shaped aperture defined by the step 2012. The plug 2058 can include one or a plurality of seals (not shown), which can be positioned on each of the first side 2060, the second side 2061, and/or the bottom portion 2062 of the plug 2058. It will be appreciated that the bathtub, step, or the like, can define any size and shape of aperture into which one or more corresponding plugs or closures can be placed in accordance with embodiments described herein. It will be appreciated that a bathtub can be molded with or can otherwise include a cutout or cavity such that the step is not needed for use with the plugs, doors, and closures described herein. In such examples the bathtub can include all of the features described herein with respect to the step.

As shown in FIG. 44, the plug 2058 can include tapered vertical projections 2090, 2091 that can selectively engage cavities 2092, 2093 defined by the step 2012. As shown, the projections 2090, 2091 and cavities 2092, 2093 can have corresponding shapes such that in the closed position, as shown in FIG. 43, the plug 2058 is secured to the step 2012 with a friction fit. The plug 2058 and the step 2012 can form a torturous path when engaged such that water is prevented from leaking out of the bathtub. During use, the plug 2058 can be placed into the U-shaped cavity defined by the step 2012 and the projections 1890, 1891 can be seated in the keyed and corresponding cavities 2092, 2093. The weight of the plug 2058 can be used to compress the plug 2058 against the step 2012 such that a substantially watertight seal is created. A handle 2040 positioned on the plug 2058 can facilitate removal from the bathtub or step 2012. In the closed position, in one embodiment, the plug 2058 can be substantially flush or coplanar with one or more surfaces of the step 2012 as shown in FIG. 43.

FIGS. 45 and 46 show a step 2112 and a plug 2158 according to an alternate embodiment. The plug 2112 can include a cover portion 2168 that can be associated with one or a plurality of magnets 2190. The step 2012 can include corresponding magnets 2191 or a material containing iron, such that the cover portion 2168 can be magnetically attached thereto. An inset region 2120 of the step 2112 can accept the cover portion 2168 such that the cover portion 2168 is substantially flush with the step 2112. The inset region 2120 can include a gasket (not shown) to further seal the step 2112 and the plug 2158. A handle 2140 can assist in removing the plug 2158. It will be appreciated that any suitable shape and configuration of magnets is contemplated for use on any step, bathtub, door, plug, or closure, such as those described herein.

FIGS. 47-49 show a step 2212 and a cover 2268 according to one embodiment. The cover portion 2268 can be associated with one or a plurality of magnets 2290. The step 2212 can include corresponding magnets 2291 or a material containing iron, such that the cover portion 2268 can be magnetically attached thereto. An inset region 2220 of the step 2212 can accept the cover portion 2268 such that the cover portion 2268 is substantially flush with the step 2212. The cover 2268 can include a gasket 2222 to further seal the step 2212 and the cover 2268. A handle 2240 can assist in removing the cover 2268. It will be appreciated that any suitable shape and configuration of magnets is contemplated for use on any step, bathtub, door, plug, cover, or closure, such as those described herein. Any magnetic or adhesive relationship is contemplated.

FIGS. 50-52 show a step 2312 and a cover 2368 according to one embodiment. The cover portion 2368 can be associated with one or a plurality of magnets 2390. The step 2312 can include corresponding magnets 2391 or a material containing iron, such that the cover portion 2368 can be magnetically attached thereto. An outer surface 2371 of the step 2312 can accept the cover portion 2368. The cover 2368 can include a gasket 2322 to further seal the step 2312 and the cover 2368. A handle 2340 can assist in removing the cover 2368. It will be appreciated that any suitable shape and configuration of magnets is contemplated for use on any step, bathtub, door, plug, cover, or closure, such as those described herein.

FIGS. 53-56 depict an alternate embodiment of a modular bathtub closure system 2410. The modular bathtub closure system 2410 can include a step 2412, a hinged plug 2458 (FIG. 55), and/or a door 2468. The door 2468 can be positioned relative to the step 2412 as shown in FIG. 53, for example, or the hinged plug 2458 can used as shown in FIGS. 55 and 56. The step 2412, the hinged plug 2458, and the door 2468 can cooperate to retain water within a bathtub. The door 2468 and the hinged plug 2458 can be selectively removable from the step 2412 to allow improved access to and from the bathtub 2413 as shown in FIG. 54. It will be appreciated that any suitable size, shape, or configuration of door 2468 or hinged plug 2458 is contemplated. The step 2412 can include an elongated platform 2416, a first side panel 2418, and a second side panel 2420, where the elongated platform 2416 can extend between the first side panel 2418 and the second side panel 2420.

As shown in FIG. 54, the step 2412 can include keyed channels 2490, 2491 that can selectively engage projections 2492, 2493 associated with the door 2468. The projection 2492 can be hinged such that the door 2468 can pivot relative to the step 2412. The projection 2493 can be a hinge lock that can pivot relative to the door 2468 to engage the keyed channel 2490. In the embodiment illustrated in FIGS. 53 and 54 an operable door 2468 can be selectively removable from the step 2412 where, for example, more versatility than a removable plug is desired. During use, the door 2468 projections 2492, 2493 can be placed into the keyed channels 2490, 2491 such that the door 2468 is engaged with the step 2412 and the door 2468 is in a closed position. In the illustrated embodiment, the projection 2493 in the form of the hinged lock can be actuated out of the keyed channel 2491 such that the door 2468 can swing open and pivot relative to the projection 2492. With reference to FIGS. 55 and 56, the hinged plug 2458 can include projections 2492, 2493 that can engage the keyed channels 2490, 2491 in the same manner as described with respect to the door 2468.

A plurality of different closure accessories, in addition to the door 2468 and the hinged plug 2458, can include projections or other engagement features that can correspond to cavities, keyed slots, channels, or the like in the step or bathtub such that a variety of interchangeable accessories can be used with a single step or bathtub. Any suitable engagement features, such as threaded fasteners, levers, or the like, can be used to couple, compress, or otherwise engage the interchangeable accessory with the corresponding step or bathtub. It will be appreciated that a modular or universal system in accordance with embodiments described herein can be achieved with a wide range of features and configurations to achieve the intended purpose of using multiple accessories with single step or bathtub.

FIGS. 57-60 depict an alternate embodiment of a modular bathtub closure system 2510. The modular bathtub closure system 2510 can include a step 2512, a hinged plug 2568, and/or a plug 2568. The hinged plug 2568 can be positioned relative to the step 2512 as shown in FIG. 57, for example, or the plug 2558 alone can used as shown in FIG. 59. The step 2512, the hinged plug 2568, and the plug 2558 can cooperate to retain water within a bathtub. The hinged plug 2568 and the plug 2558 can be selectively removable from the step 2512 to allow improved access to and from the bathtub. It will be appreciated that any suitable size, shape, or configuration of hinged plug 2568 or plug 2558 is contemplated. The step 2512 can include an elongated platform 2516, a first side panel 2518, and a second side panel 2520, where the elongated platform 2516 can extend between the first side panel 2518 and the second side panel 2520.

As shown in FIGS. 61 and 62, the step 2612 can include magnets 2690, 2691 that can selectively engage a corresponding set of magnets 2692, 2693 associated with a hinged door 2568. The hinged door 2568 can be hinged such that the hinged door 2668 can pivot relative to the step 2612 from an open position to a closed position. In the embodiment illustrated in FIG. 61, the hinged door 2568 can function as an operable door that can be selectively removable from the step 2612. In this manner, the step 2612 can be used with either a door feature or as an open step. Any suitable attachment feature is contemplated where, for example, different features can be coupled to magnets 2690 and/or 2691 as desirable to outfit the step or bathtub with accessories.

FIGS. 63-66 show a tub 2713, step 2712, and a plurality of seals 2755 according to one embodiment. The cross-section of the seal 2755 can be T-shaped, as shown in FIG. 65. An alternate cross-section of a seal 2756 is shown in FIG. 66, which can provide a locking capability. The seals 2755 can fill any gap between the bathtub 2713 and the step 2712 and can be attached with a sealant material. Any suitable number, size, shape, or design of seals is contemplated.

Referring to FIG. 67, one embodiment of a step 2812 is shown. The step 2812 can include an elongated platform 2816, a first side panel 2818, and a second side panel 2820, where the elongated platform 2816 can extend between the first side panel 2818 and the second side panel 2820. The step 2812 can be coupled with, integral with, molded with, co-molded, or otherwise associated with a support portion 2880. The support portion can have a substantially U-shaped configuration, having a bottom surface 2882, that projects in a generally downward direction from the step 2812. The bottom surface 2882 can be positioned or secured to any suitable location to support the step 2812 such as on the floor of a bathroom, on the bottom surface of a bathtub, on the bottom surface of a bathtub within a cutout formed in the bathtub, or any suitable surface or location. The bottom surface 2882 can be associated with a flexible material, such as foam or a pad, that can accommodate uneven surfaces or varying geometries in the bottom of a tub or on the floor.

Referring to FIGS. 67-69, the support portion 2880 is shown having a generally U-shaped configuration, but it will be appreciate that any shape or configuration is contemplated. The arch or U-shaped structure may provide the step 2812 with adequate support while using a minimum of material, which may reduce product costs. The support portion 2880 can be solid, can have a generally V-shaped configuration, a T-shaped configuration, an inverted T-shaped configuration, can taper inward at the width and/or the length of the support portion, or have any other suitable shape. The support portion 2812 can include a first leg 2884 and a second leg 2886 that can be substantially vertical in orientation, spaced apart, and substantially parallel to one another. The first leg 2884 and the second leg 2886 can be substantially identical in configuration or, alternatively, one leg can be different from the other leg to accommodate different bathtub geometries. The first leg 2884 and the second leg 2886 can cooperate with a frustoconical structure 2888 to define a support portion cavity 2890. The cavity 2890 can be substantially uniform along the length of the support portion 2880 or vary in geometry for increased strength or for other design considerations. It will be appreciated that ribs (not shown), including a plurality of vertical or horizontal supports or structures, or other structures can be provided or formed with the support portion to support the step 2812. It will be appreciated that the ends of the support portion 2880 can be closed such that an internal cavity can be defined.

As illustrated in FIG. 68, the support portion 2880 can be substantially hollow. The support portion 2880 can define an internal cavity 2892 that can be empty or can be filled with material such as support material, insulation, or the like. Providing a large cavity 2892 may reduce the amount of material needed to construct the step. In one embodiment, the step 2812 can be inserted into a bathtub and then the internal cavity 2892 can be filled with material after placement, such as support foam, to provide additional strength to the step 2812. It will be appreciated that the step can be formed without a cavity 2892 such that the step and support portion 2880 are substantially solid.

Referring to FIGS. 68 and 69, the step 2812 and support portion 2880 can include a plurality of frustoconical portions 2888 positioned along the length of the elongated platform 2816 of the step 2812. Each of the frustoconical portions 2888 can include a top surface 2894 that can be positioned adjacent to or in contact with the bottom surface of the elongated platform 2816. In this manner, the frustoconical portions 2888 can add support to the elongated platform 2816 without the need for additional mass in the step 2812 or support portion 2880. The frustoconical portions 2888 can be any support member, having any configuration, that can provide support to the step and reduce the material requirements for the step. The top surface 2894 of the frustoconical portions 2888 can be integral with the elongated platform, adhered to the elongated platform 2816, or adjacent the elongated platform 2816 such that they function as a "kiss off" when force is applied to the elongated platform 2816. For example, the top surface 2894 can be spaced apart from about 1 mm to about 5 mm from the bottom surface of the elongated platform. It will be appreciated that the frustoconical portions can be any support member having any suitable shape such as conical members, cylindrical members, hexagonal members, cuboid members, or the like.

It will be appreciated that the support portions as described herein can be used with any apparatus or device described herein such as, for example, a step having a door. The support portion can be a static structure or, in an alternate embodiment, can have adjustable features such as telescoping legs. The support portion can rest on a surface or, in an alternate embodiment, can include fasteners that can be used to secure the step and support portion. The support portion can have any suitable length and can project downwardly from the bottom of the step, for example, from about 2 inches to about 12 inches, from about 4 inches to about 6 inches, from about 3 inches to about 6 inches, from about 6 inches to about 18 inches, from about 12 inches to about 24 inches, or any suitable distance. The sized can be configured to reach the floor of a bathtub. The width of the support portion can be from about 1 inch to about 8 inches, from about 2 inches to about 6 inches, from about 4 inches to about 8 inches, or any other suitable dimensions. The first leg and the second leg can have a width from about 0.5 inches to about 2 inches, from about 1 inch to about 1.5 inches, or any other suitable dimension. The support portion can have a length substantially matching that of the step or, in an alternate embodiment, can have a shorter length than the step. It will be appreciated that the step can be configured to accept a range of support portions, such as in a kit, to accommodate a variety of bathtub geometries.

It will be appreciated that any suitable features or components can be incorporated into the steps, plugs, closures, bathtubs, or the like disclosed herein. The features or components can include electrical or powered accessories or features such as a heating system, a hydrotherapy system, a fall alarm, USB or other port access and communication, transmitters, receivers, transceivers, a radio, entertainment accessories, speakers, exercise equipment, sensors such as biometric sensors, a motion detector that can determine if a user has moved in a pre-determined time period, a medical alert button, closed circuit television, massage systems, aeration systems, visual stimuli, audible stimuli, an intercom, or any other suitable component. The accessories can be powered by battery, AC power, user activity, solar, or any other suitable power source. The accessories or system can be connected to a network, such as the internet, can incorporate BLUETOOTH, a local area network, or any other suitable form or mode of communication.

In various embodiments disclosed herein, a single component can be replaced by multiple components and multiple components can be replaced by a single component to perform a given function or functions. Except where such substitution would not be operative, such substitution is within the intended scope of the embodiments.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

What is claimed is:

1. A retrofit bathtub closure system comprising:

(a) a step operably configured to be retrofit onto a bathtub, the step comprising;

(i) a first side panel, a second side panel, and an elongated platform defining a cavity, wherein the first side panel has a first top surface, the second side panel has a second top surface, and the cavity is configured to facilitate ingress and egress into the bathtub; and (ii) a first attachment recess defined by the step, the first attachment recess extending downward from the first top surface less than an entire height of the first side panel or extending downward from the second top surface less than an entire height of the second side panel; and (b) a plug, the plug comprising;

(i) a body having a first side, a second side, and a bottom portion; and (ii) a first attachment member affixed to the body and corresponding to the first attachment recess defined by the step;

wherein the plug cooperates with the step to form a substantially watertight seal when the first attachment member is mated with the first attachment recess and the body of the plug is positioned at least partially within the cavity defined by the step.

2. The retrofit bathtub system of claim 1, wherein the cavity defined by the first side panel, the second side panel, and the elongated platform is substantially U-shaped.

3. The retrofit bathtub closure system of claim 1, further comprising a second attachment recess defined by the step, wherein the first attachment recess extends downward from the first top surface less than the entire height of the first side panel and the second attachment recess extends downward from the second top surface less than the entire height of the second side panel.

4. The retrofit bathtub closure system of claim 3, further comprising a second attachment member corresponding to the second attachment recess.

5. The retrofit bathtub closure system of claim 4, wherein the first attachment recess and the second attachment recess are substantially semi-circular in shape, and the first attachment member and the second attachment member have a corresponding semi-circular shape.

6. The retrofit bathtub closure system of claim 4, further comprising a first fastener operably configured to secure the first attachment member in the first attachment recess and a second fastener operably configured to secure the second attachment member in the second attachment recess.

7. The retrofit bathtub closure system of claim 6, wherein the first fastener and the second fastener are threaded fasteners that urge the plug in a generally downward direction against the step when tightened the first fastener extending through the first attachment member, and the second fastener extending through the second attachment member.

8. The retrofit bathtub closure system of claim 7, wherein the first fastener and the second fastener have a substantially vertical orientation.

9. The retrofit bathtub closure system of claim 1, further comprising a fastener that secures the first attachment member to the first attachment recess.

10. The retrofit bathtub closure system of claim 9, wherein the actuation of the fastener compresses the plug against the step to form a substantially watertight seal.

11. The retrofit bathtub closure system of claim 1, wherein the plug is positioned substantially entirely within the cavity defined by the step.

12. The retrofit bathtub closure system of claim 1, wherein the plug further comprises an inset handle for placement of the plug relative to the step.

13. The retrofit bathtub closure system of claim 1, wherein a height of a top surface of the first attachment member from the bottom portion of the plug is less than a height of a top surface of the plug from the bottom portion of the plug.

14. The retrofit bathtub closure system of claim 1, wherein the plug further comprises one or more seals, wherein the one or more seals are spaced apart from the first attachment member.

15. A retrofit bathtub closure system comprising:

(a) a step saddle operably configured to be retrofit onto a bathtub, the step saddle comprising;

(i) a first side panel, a second side panel, and an elongated platform defining a substantially U-shaped cavity, wherein the first side panel has a first top surface, the second side panel has a second top surface, and the substantially U-shaped cavity is configured to facilitate ingress and egress into the bathtub;

(ii) a first cavity defined by the first side panel, the first cavity extending downward from the first top surface to a first end wall; and (iii) a second cavity defined by the second side panel, the second cavity extending downward from the second top surface to a second end wall;

(b) a plug, the plug comprising;

(i) a body having a first side, a second side, and a bottom portion, wherein the body of the plug is shaped to correspond to the substantially U-shaped cavity;

(ii) a first lateral projection, extending from the first side of the plug, corresponding to the first cavity; and (iii) a second lateral projection, extending from the second side of the plug, corresponding to the second cavity;

(c) a first fastener operably configured to secure the first lateral projection to the first cavity; and (d) a second fastener operably configured to secure the second lateral projection to the second cavity;

wherein the plug cooperates with the step saddle to form a substantially watertight seal when the first lateral projection is seated in the first cavity, the second lateral projection is seated in the second cavity, and the body of the plug is positioned in the substantially U-shaped cavity.

16. The retrofit bathtub closure system of claim 15, wherein the first fastener and the second fastener are threaded fasteners having a substantially vertical orientation, the first fastener extending through the first lateral projection, and the second fastener extending through the second lateral projection.

17. The retrofit bathtub closure system of claim 15, wherein the plug is substantially entirely retained within the U-shaped cavity defined by the step saddle.

18. The retrofit bathtub closure system of claim 15, wherein the first cavity and the second cavity have a substantially semicircular configuration.

19. The retrofit bathtub closure system of claim 15, wherein the first projection and the second projection have a substantially semicircular configuration.

20. A retrofit bathtub closure system comprising:

(a) a step means operably configured to be retrofit onto a bathtub, the step means being associated with a bathtub, the step means defining a cavity means, wherein the cavity means facilitates ingress and egress into the bathtub, and the step means defining an attachment recess means, the attachment recess means extending downward from a top surface of the step means less than an entire height of the step means; and (b) a plug means, the plug means operably configured to engage the step means, the plug means having an attachment member means corresponding to the attachment recess means, wherein the attachment member engages the attachment recess means to couple the step means with the plug means to create a substantially watertight seal in the bathtub.

* * * * *